US009641921B2

(12) United States Patent
Garfio et al.

(10) Patent No.: US 9,641,921 B2
(45) Date of Patent: May 2, 2017

(54) SPEAKER CORE WITH REMOVABLE JACKET

(71) Applicant: Fugoo Corporation, Irvine, CA (US)

(72) Inventors: Alejandro Garfio, West Covina, CA (US); Ho Koon Yau, Yorba Linda, CA (US); Kit Mok, Lakewood, CA (US); Howard Shi-How Cheng, Irvine, CA (US)

(73) Assignee: FUGOO CORPORATION, Irvine, CA (US)

( * ) Notice: Subject to any disclaimer, the term of this patent is extended or adjusted under 35 U.S.C. 154(b) by 0 days.

(21) Appl. No.: 14/588,803

(22) Filed: Jan. 2, 2015

(65) Prior Publication Data

US 2015/0195635 A1 Jul. 9, 2015

Related U.S. Application Data

(60) Provisional application No. 61/923,554, filed on Jan. 3, 2014.

(51) Int. Cl.
*H04R 1/02* (2006.01)
*H04R 31/00* (2006.01)

(52) U.S. Cl.
CPC ..... *H04R 1/02* (2013.01); *H04R 31/006* (2013.01); *H04R 2420/07* (2013.01)

(58) Field of Classification Search
CPC ..... H04R 1/02; H04R 1/023; H04R 1/025; H04R 1/026; H04R 2201/02
USPC ..... 381/87, 332, 334, 335, 336, 345, 351, 381/386, 387, 391, 393, 394, 395
See application file for complete search history.

(56) References Cited

U.S. PATENT DOCUMENTS

| | | | |
|---|---|---|---|
| D223,580 | S | 5/1972 | Richards |
| 4,439,644 | A | 3/1984 | Bruney, III |
| 4,805,729 | A | 2/1989 | Wascom |
| 6,035,962 | A | 3/2000 | Lin |
| 6,295,263 | B1 | 9/2001 | Obata |
| D471,178 | S | 3/2003 | Jordan |
| 6,665,412 | B1 | 12/2003 | Mizoguchi |
| D491,165 | S | 6/2004 | Hakoda |

(Continued)

FOREIGN PATENT DOCUMENTS

| | | | |
|---|---|---|---|
| JP | 1408180 | S | 1/2011 |
| JP | 1452612 | S | 9/2012 |

(Continued)

OTHER PUBLICATIONS

Violano, "Could the Aqua Tek S Be the Ultimate in Protection for Your iPhone?", Mar. 4, 2012, AppAdvice.*

(Continued)

*Primary Examiner* — Paul S Kim
*Assistant Examiner* — Katherine Faley
(74) *Attorney, Agent, or Firm* — Knobbe, Martens, Olson & Bear, LLP

(57) ABSTRACT

A speaker system can include a speaker core and a removable jacket. The speaker core can have a housing and a speaker positioned within the housing. The removable jacket can cover the speaker on an outside surface of the housing, the jacket extending along at least three sides of the housing. Among other features, the speaker core can be used with one of among a number of different jackets to form different speaker systems.

49 Claims, 45 Drawing Sheets

(56) References Cited

U.S. PATENT DOCUMENTS

| | | | | |
|---|---|---|---|---|
| D503,676 | S | 4/2005 | Krieger | |
| 6,910,548 | B2 | 6/2005 | Powell | |
| D507,395 | S | 7/2005 | Choi | |
| 7,155,026 | B2 | 12/2006 | Augustin, Sr. et al. | |
| D534,897 | S | 1/2007 | Bhakta | |
| D535,976 | S | 1/2007 | Ng et al. | |
| 7,221,772 | B2 | 5/2007 | Evenisse et al. | |
| 7,242,785 | B2 | 7/2007 | McNary | |
| D551,208 | S | 9/2007 | Yano | |
| D552,081 | S | 10/2007 | Yano | |
| D553,120 | S | 10/2007 | Yano | |
| D556,737 | S | 12/2007 | Oh | |
| D579,953 | S | 11/2008 | Chen | |
| 7,469,052 | B2 | 12/2008 | Peavey | |
| D611,450 | S | 3/2010 | Miyazaki | |
| D619,116 | S | 7/2010 | Skurdal | |
| 7,764,806 | B2 | 7/2010 | Pei et al. | |
| D621,383 | S | 8/2010 | Hou | |
| D642,156 | S | 7/2011 | Joseph | |
| D646,665 | S | 10/2011 | Iijima | |
| 8,090,137 | B2 | 1/2012 | Ryan | |
| D661,286 | S | 6/2012 | McManigal et al. | |
| 8,194,897 | B2 | 6/2012 | Choi | |
| D673,525 | S | 1/2013 | Goetzen et al. | |
| 8,351,638 | B2 | 1/2013 | Park | |
| 8,406,449 | B2 | 3/2013 | Wegener | |
| D705,753 | S | 5/2014 | Kimura | |
| D710,332 | S | 8/2014 | Baird | |
| D726,685 | S | 4/2015 | Cheng | |
| D733,099 | S | 6/2015 | Pupecki et al. | |
| D734,738 | S | 7/2015 | Jackson et al. | |
| D735,168 | S | 7/2015 | Cheng et al. | |
| D736,745 | S | 8/2015 | Yau et al. | |
| D736,746 | S | 8/2015 | Cheng et al. | |
| D736,747 | S | 8/2015 | Yau et al. | |
| D737,246 | S | 8/2015 | Billington | |
| D737,247 | S | 8/2015 | Billington | |
| 9,307,307 | B2 | 4/2016 | Florczak | |
| 2003/0128849 | A1 | 7/2003 | Meyer | |
| 2004/0208336 | A1 | 10/2004 | Hamada | |
| 2005/0031148 | A1 | 2/2005 | McNary | |
| 2006/0049938 | A1* | 3/2006 | Wilson | G08B 7/06 340/541 |
| 2007/0177741 | A1* | 8/2007 | Williamson | H04R 1/1083 381/71.6 |
| 2008/0132289 | A1 | 6/2008 | Wood et al. | |
| 2009/0161903 | A1 | 6/2009 | White | |
| 2009/0180662 | A1 | 7/2009 | Parker | |
| 2011/0075877 | A1 | 3/2011 | Hao et al. | |
| 2011/0170725 | A1* | 7/2011 | Liu | H04R 1/02 381/338 |
| 2012/0082317 | A1 | 4/2012 | Pance | |
| 2013/0177196 | A1 | 7/2013 | Lee | |
| 2014/0355806 | A1 | 12/2014 | Graff | |
| 2015/0195635 | A1 | 7/2015 | Garfio et al. | |

FOREIGN PATENT DOCUMENTS

| | | | |
|---|---|---|---|
| JP | 1512788 | S | 10/2014 |
| JP | 1516229 | S | 12/2014 |
| KR | 10-2007-0104190 | | 10/2007 |
| WO | WO 2007/100706 | | 9/2007 |
| WO | WO 2011/011224 | | 1/2011 |

OTHER PUBLICATIONS

Cruz, "Pursecase", Jul. 23, 2013, TechWeLike.*

Libratone Live Wireless Airplay Speakers, https://shop.libratone.com/en-us/wireless-airplay-speakers/libratone-live/c-54/c-288/p-207/, retrieved on Jan. 6, 2014.

Libratone Zipp, http://reviews.cnet.com/bluetooth-speakers/libratone-zipp-gray/4505-34810_7-35530587.html?autoplay=true, CNET review date of Nov. 12, 2012, retrieved on Jan. 8, 2014.

JBL Flip, http://reviews.cnet.com/bluetooth-speakers/jbl-flip-black/4505-34810_7-35550919.html, CNET review date of Dec. 21, 2012, retrieved on Jan. 6, 2014.

Jawbone Jambox, http://reviews.cnet.com/portable-speakers/jawbone-jambox-black-diamond/4505- 11313_7-34207708.html, CNET review date of Nov. 4, 2010, retrieved on Jan. 6, 2014.

Jawbone Big Jambox, http://reviews.cnet.com/bluetooth-speakers/jawbone-big-jambox-graphite/4505- 34810_7-35244085.html, CNET review date of Apr. 30, 2012, retrieved on Jan. 6, 2014.

Logitech UE Boom, http://reviews.cnet.com/portable-speakers/logitech-ue-boom-blue/4505-11313_7-35765418.html, CNET review date of Jun. 18, 2013, retrieved on Jan. 6, 2014.

JBL Charge, http://reviews.cnet.com/portable-speakers/jbl-charge-blue/4505-11313_7-35613369.html, CNET review date of Apr. 8, 2013, retrieved on Jan. 6, 2014.

Beats Pill, http://reviews.cnet.com/portable-speakers/beats-pill-black/4505-11313_7-35493112.html, CNET review date of Nov. 21, 2012, retrieved on Jan. 6, 2014.

Jawbone Mini Jambox, http://www.bestbuy.com/site/jawbone-mini-jambox-wireless-speaker-blue-diamond/1584782.p?id=1219056361326&skuId=1584782, retrieved on Mar. 13, 2015.

Jensen Bluetooth Wireless Stereo Speaker, http://www.bestbuy.com/site/jensen-bluetooth-wireless-stereo-speaker-black/6544488.p?id=1218748100411&skuId=6544488, retrieved on Mar. 13, 2015.

International Search Report and Written Opinion for International Application No. PCT/US2015/010057, Notification mailed Apr. 20, 2015.

* cited by examiner

SPEAKER CORE WITH REMOVABLE JACKET

INCORPORATION BY REFERENCE TO ANY PRIORITY APPLICATIONS

This application claims priority to U.S. Provisional App. No. 61/923,554 filed Jan. 3, 2014 which is hereby incorporated herein by reference in its entirety and is to be considered a part of this specification. Any and all applications for which a foreign or domestic priority claim is identified in the Application Data Sheet as filed with the present application are hereby incorporated by reference under 37 CFR 1.57. This application is also related to U.S. Provisional App. No. 61/923,670 filed Jan. 4, 2014 and the corresponding U.S. application Ser. No. 14/586,701 filed Dec. 30, 2014, entitled "CONFIGURABLE PORTABLE SOUND SYSTEMS WITH INTERCHANGEABLE ENCLOSURES" which are incorporated by reference in their entirety. This application is also related to U.S. Provisional App. No. 61/923,575 filed Jan. 3, 2014 and the corresponding U.S. application Ser. Nos. 14/588,800 and 14/588,778, both filed Jan. 2, 2015, entitled "AUDIO ARCHITECTURE FOR A PORTABLE SPEAKER SYSTEM" and "PORTABLE STEREO SOUND SYSTEM", respectively, which are incorporated by reference in their entirety.

BACKGROUND OF THE INVENTION

Field of the Invention

The embodiments disclosed herein relate generally to speaker systems. For example, the speaker systems may be portable speaker systems that can receive wireless transmissions to broadcast sound, though other types of speaker systems may also be employed. Additional embodiments relate to accessories for speaker systems.

Description of the Related Art

There are currently on the market, a number of different speaker systems used primarily to broadcast music or other sound from cell phones, tablets, or other computer devices. Many of these speaker systems connect with the computer device through Bluetooth or another wireless standard. Many also offer wired connections in addition to, or instead of the wireless connection. Many of these speaker systems are portable and are considered easy to stow in a bag or backpack or to tote to the park, patio, pool, or beach, etc.

SUMMARY OF THE INVENTION

There exists a constant need for improvement in speaker systems. A speaker system can include a speaker core and a removable jacket. The speaker core can have a housing and a speaker positioned within the housing. The removable jacket can cover the speaker on an outside surface of the housing, the jacket extending along at least three sides of the housing. Among other features, the speaker core can be used with one of among a number of different jackets to form different speaker systems.

A speaker system can be configured for one-way sliding attachment between a jacket and a speaker core. In some embodiments, a notch and a protrusion can be used to ensure proper alignment of the jacket on the speaker core. For example, the notch and protrusion can be configured to provide one-way sliding attachment of the jacket and speaker core.

In some embodiments, a speaker system can comprise a speaker core and a removable jacket. The speaker core can include a housing having six sides: a top, bottom, front, back, left, and right; two speakers positioned within the housing, each speaker positioned on a different side of the housing; a button; and one of a notch and a protrusion on an outside surface. The removable jacket can cover at least one of the two speakers on an outside surface of the housing, the jacket configured to extend along at least three of the six sides of the housing. The jacket can comprise a button user interface to be positioned over the button when the jacket is positioned on the speaker core; and the other of the notch and the protrusion on an inside surface of the jacket configured to engage the respective notch or protrusion on the speaker core to help ensure proper alignment of the jacket on the speaker core. The system can be configured for one-way sliding attachment of the jacket onto the housing. The notch and protrusion can be positioned and configured such that 1) sliding the jacket onto the housing from a first side of the six sides of the housing allows the protrusion to engage the notch and the button user interface to be the positioned over the button; and 2) sliding the jacket onto the housing from a second side opposite the first side, the protrusion prevents the jacket from fully sliding onto the speaker core such that the notch and protrusion do not engage and the button user interface is not positioned over the button.

According to some embodiments, the speaker system can further comprise a locking mechanism comprising a second protrusion and a second notch, the second protrusion configured to fit within the second notch, wherein one of either the second notch or the second protrusion is on the housing and the other is on the jacket. The locking mechanism can comprise a deflection latch configured such that locking or unlocking the locking mechanism requires articulation of the deflection latch. In some embodiments, the jacket may further comprise a drainage hole and a drainage channel configured to direct fluid between the jacket and speaker core towards the drainage hole. The jacket may comprise at least two strap attachment points. The at least two strap attachment points may be the same as the drainage holes.

In some embodiments, the speaker core can further comprise at least one rubberized end cap covering at least one of the two speakers not covered by the jacket. The at least one rubberized end cap can be on the first side such that the jacket is configured to slide over the at least one rubberized end cap onto the housing.

In some embodiments, the first side is the front side of the speaker core housing, the speaker core comprising the notch positioned on the front side and the jacket comprising the protrusion. The jacket can comprise a two piece assembly, wherein the first piece is configured for sliding onto the front side of the speaker core and the second piece is configured for sliding onto the back side of the speaker core. A second jacket can be configured for one-way sliding attachment onto the housing from a second side.

According to some embodiments, a speaker system can comprise a speaker core and a removable jacket. The speaker core can include a housing and two speakers positioned within the housing. The removable jacket can extend along at least three sides of the housing covering the two speakers. A notch and a protrusion can be included, wherein one of either the notch or the protrusion is on the housing and the other is on the jacket. The system can be configured for one-way sliding attachment of the jacket onto the housing with the notch and protrusion positioned to 1) align the housing and jacket when the protrusion is engaged with the notch when the jacket is slid onto the jacket in a first direction and to 2) prevent the housing and jacket from complete attachment when the jacket is attempted to slide onto the speaker core from a direction other than first direction.

In certain embodiments, a speaker system can comprise a speaker core and a removable jacket. The speaker core can include a housing and a speaker positioned within the housing. A removable jacket can cover the speaker on an outside surface of the housing, the jacket extending along at least three sides of the housing. A notch and a protrusion can be included, wherein one of either the notch or the protrusion is on the housing and the other is on the jacket. The system can be configured for one-way sliding attachment of the jacket onto the housing with the notch and protrusion positioned to 1) properly align the housing and jacket when the protrusion is engaged with the notch and to 2) prevent the housing and jacket from complete attachment when the protrusion and notch are incorrectly orientated such that the jacket and housing are not properly aligned.

In some embodiments, a speaker system can have a speaker core. The speaker core can comprise a housing; a speaker positioned within and connected to the housing; a battery positioned within the housing; a main printed circuit board (PCB) positioned within the housing; a secondary PCB positioned within the housing and comprising at least one of a button and an electrical connector connected to the housing; a wire connecting the secondary PCB to the main PCB; a frame positioned within the housing, the battery and main PCB connected to the frame and not connected to the housing; and a plurality of shock absorbers that connect the frame to the housing to thereby isolate the battery and main PCB from vibrations of the housing.

According to some embodiments, the frame may comprise four arms that extend outward from the frame and the plurality of shock absorbers comprise four shock absorbers, wherein each shock absorber is on one of the four arms and connects the arms to the housing. The frame can suspend the battery and main PCB within the housing such that the frame, battery and main PCB are not in contact with a bottom internal surface of the housing.

In some embodiments, the housing can comprise a main chamber and a secondary chamber. The secondary PCB can be positioned within the secondary chamber and the main PCB, the frame, and the speaker can be positioned within the main chamber. The secondary chamber can have an access door, thereby providing access to the at least one button or electrical connector. The access door can be tethered to the housing. The system may include a third PCB, wherein the housing further comprises a third chamber, the third PCB positioned within the third chamber. The second chamber can be walled off from the main chamber with the exception of a channel sized for the wire to pass between both chambers. The speaker system may also include a removable jacket covering the speaker on an outside surface of the housing, the jacket extending along at least three sides of the housing.

In some embodiments, a speaker system can comprise a speaker core comprising: a housing; a speaker positioned within and connected to the housing; a battery positioned within the housing; a main printed circuit board (PCB) positioned within the housing; a secondary PCB comprising at least one of a button and an electrical connector connected to the housing; a wire connecting the secondary PCB to the main PCB; a frame positioned within the housing, the battery and main PCB connected to the frame and not connected to the housing, the frame comprising: a plurality of arms that extend outward from the frame; and a plurality of shock absorbers, wherein each shock absorber is positioned on one of plurality of arms and connects the arms to the housing to thereby isolate the battery and main PCB from vibrations of the housing.

In some embodiments a speaker system can have a speaker core. The speaker core can comprise a waterproof housing having a main chamber and a secondary chamber, the secondary chamber being walled-off from the main chamber; a speaker positioned within the main chamber and connected to the housing; a battery positioned within the main chamber; a main printed circuit board (PCB) positioned within the main chamber; a secondary PCB positioned within the secondary chamber and comprising at least one of a button and an electrical connector connected to the housing; a wire connecting the secondary PCB to the main PCB and passing through a channel between the main chamber and the secondary chamber; a plurality of shock absorbers positioned between the battery and the main PCB and the housing to thereby isolate the battery and main PCB from vibrations of the housing.

In certain embodiments, a speaker core can utilize one of various unique construction methods described herein. For example, various waterproofing and vibration isolation systems are described. In addition, certain embodiments comprise any of the various accessories and/or accessory/strap mounting systems and methods disclosed herein.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

DETAILED DESCRIPTION OF THE PREFERRED EMBODIMENT

Figure 1:
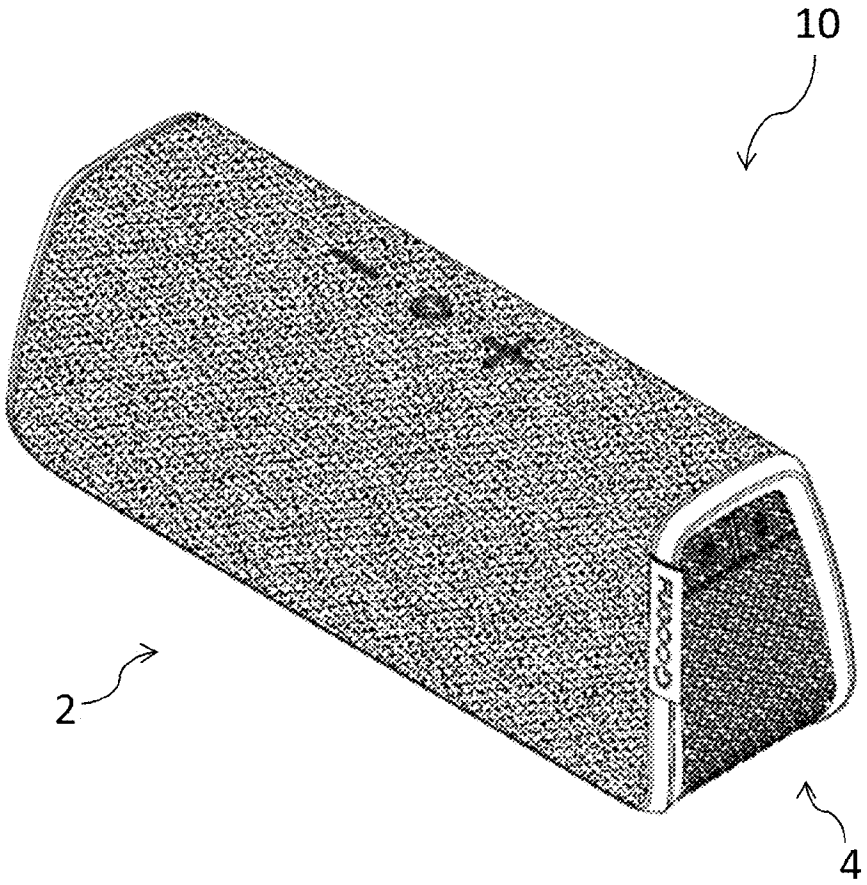
FIG. 1 is a top, front and side perspective view of a speaker system.

FIG. 1 shows a portable speaker system 10 in an assembled condition. Aspects of a portable speaker system 10 with a removable outer jacket 2 surrounding a speaker core 4 are described herein. It will be understood that many, if not all, of the concepts described herein can be applied to other types of speaker systems. Following a general description, each of the jacket 2 and speaker core 4 will be described in detail. It is to be understood that the features of the various different embodiments of jackets can be combined or considered alone. Similarly, the features of the various different embodiments of speaker cores can be combined or considered alone, and may also be combined with any of the features of the various different embodiments of jackets.

Embodiments of the disclosed portable speaker systems 10 can provide convenience to a user as they can be moved around indoors or used outdoors. In some embodiments, portable speaker systems can be lightweight and can communicate with an audio device over a wired or wireless connection, such as Bluetooth, Wi-Fi, Wireless Speaker and Audio (WiSA), and the like. In addition, portable speakers can reproduce or playback audio efficiently with low energy consumption. For example, a portable speaker can be capable of continuous playback of 10 or more hours. The portable speaker system 10 may also be configurable with interchangeable jackets, skins, or enclosures 2.

Figure 2:
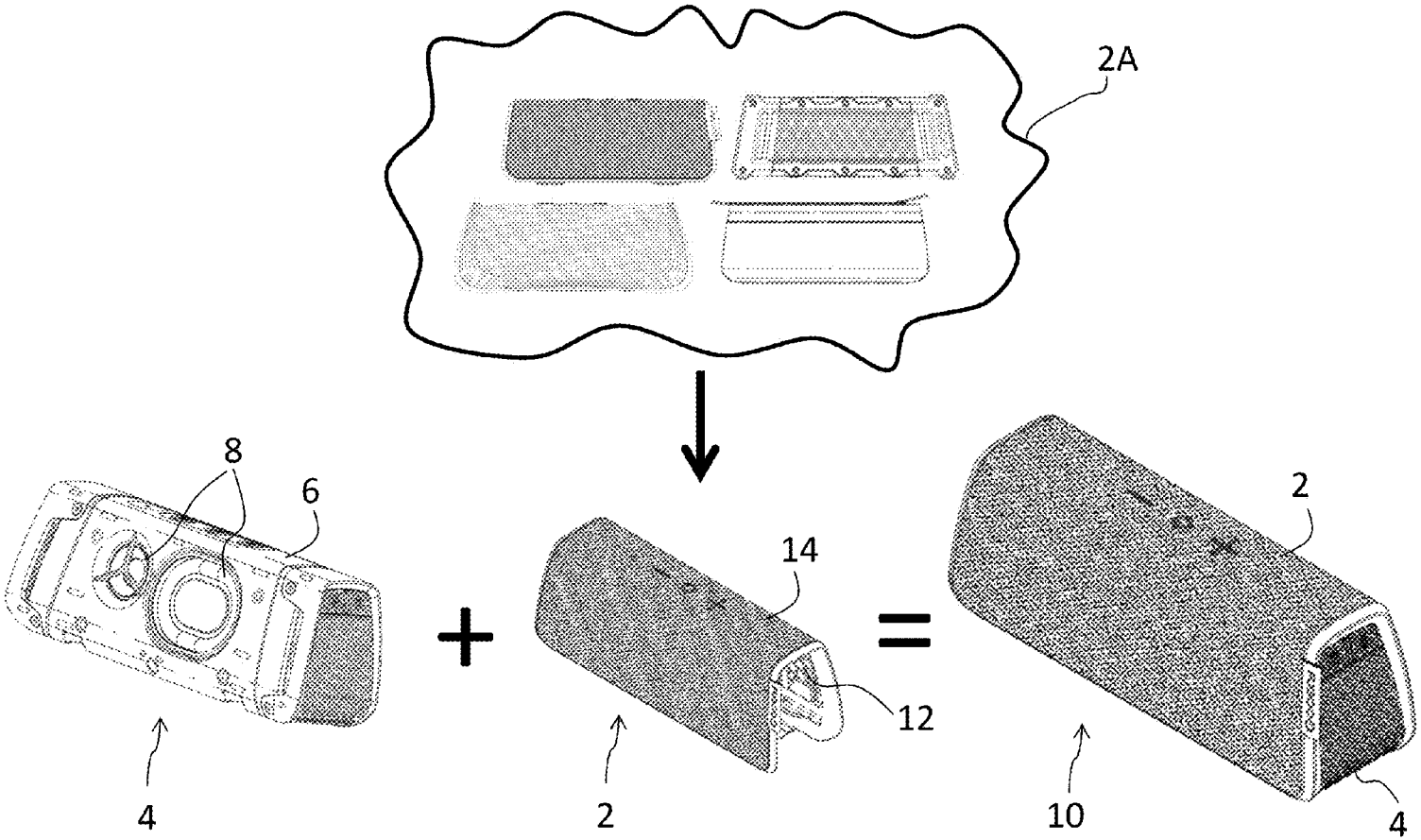
FIG. 2 shows a schematic representation of an assembly process for a speaker system.

Turning to FIG. 2 a schematic representation of an assembly process is shown. Starting with a speaker core 4, a user or manufacturer can select a jacket 2 from among a number of different styles 2A. Each jacket 2 can be easily connected to the speaker core 4, though not necessarily all in the same way. For example, as will be described in more detail below, some jackets can slide onto the speaker core from one side, while others might involve assembling different component parts of the jacket onto the speaker core 4.

In this way, different speaker systems can be created based on the same speaker core. Though, in some embodiments, minor adjustments may be made to the speaker core to create different speaker systems. The assembly of the speaker system may be done by consumers, or may be primarily done in the manufacturing stage. The different speaker systems may be different primarily in appearance, though the speaker core may also respond differently electronically, or it may provide a different acoustic response, depending on the jacket that it is paired with. In addition, the jacket may impart different properties to the speaker system such as more or less strength, shock absorption, or ruggedness. One speaker system might be ideally suited for indoor use, while another system might be designed for outdoor use. Similarly, one speaker system might be designed for use at the beach, while another system might be designed to withstand large impacts. Of course, many of these features can also be combined in one system.

In a basic form, a speaker core 4 can include a housing 6 and one or more speakers 8 positioned within the housing 6 (FIG. 2). The speaker core 4 may connect via wires or wirelessly to one or more of a television, CD or Blue Ray player, router, repeater, stereo receiver, amplifier, cell phone, tablet, laptop, desktop computer, or storage drive, among other devices. For example, the speaker core 4 may stream music or other sound from a computer device such as a cell phone or tablet via wireless Bluetooth or other wireless standard. Additional details concerning the components of certain embodiments of the speaker core 4 are provided in later parts of this detailed description.

The speaker core 4 and jacket 2 (and therefore the speaker system 10) are illustrated as a generally elongate box having a trapezoidal cross-section. This form factor can resist tip over when the speaker system 10 is placed on surfaces, providing improved stability. The trapezoidal form factor also accommodates the natural shape of the hand when gripped from the top (narrower side of trapezoid in palm), providing enhanced ergonomics as compared to some other form factors (e.g., purely rectangular form factors). In other embodiments, speaker systems and speaker cores of any suitable shapes fall within the scope of the disclosure, such as rectangular box, square box, cylindrical, spherical, conical, toroidal, pyramidal, and the like. It will also be understood that the speaker system 10, jacket 2 and speaker core 4 can have different shapes. For example, a jacket may connect to a trapezoidal cross-section speaker core 4 and form a rectangular or triangular speaker system. Similarly, the core may be rectangular and the jacket can be trapezoidal to create a trapezoidal speaker system.

Jacket

The jacket 2 can be a removable jacket for covering the one or more speakers 8 on an outside surface of the housing 6. For example, the jacket 2 can include one or more of fabric and a protective grill. The fabric can be a mesh material with a plurality of small holes, as is common in the speaker art, but may also be other types of fabric. As can be seen in FIG. 2, the illustrated jacket 2 has a protective grill 12 on the inside which is covered in a fabric material 14. When assembled, the speaker system 10 can have the jacket 2 covering one or more speaker 8. In some embodiments, the jacket can cover speakers on one or more sides of the speaker core 4. For example, in some embodiments, the jacket can cover speakers on the front and/or back of the speaker core. The jacket may or may not additionally cover speakers on the right and left sides, top and/or bottom of the speaker core. It will be noted that as used herein, "side" generally refers to different views, as opposed to separate surfaces. Thus a cylindrical speaker core may only have three surfaces, but has six sides.

As has been mentioned, the shape of the jacket may accommodate the natural shape of the hand when gripped from the top (narrower side of trapezoid in palm), providing enhanced ergonomics as compared to some other form factors. In addition, the jacket 2 may have rounded edges and corners to further better accommodate gripping by the hand.

Figure 3:
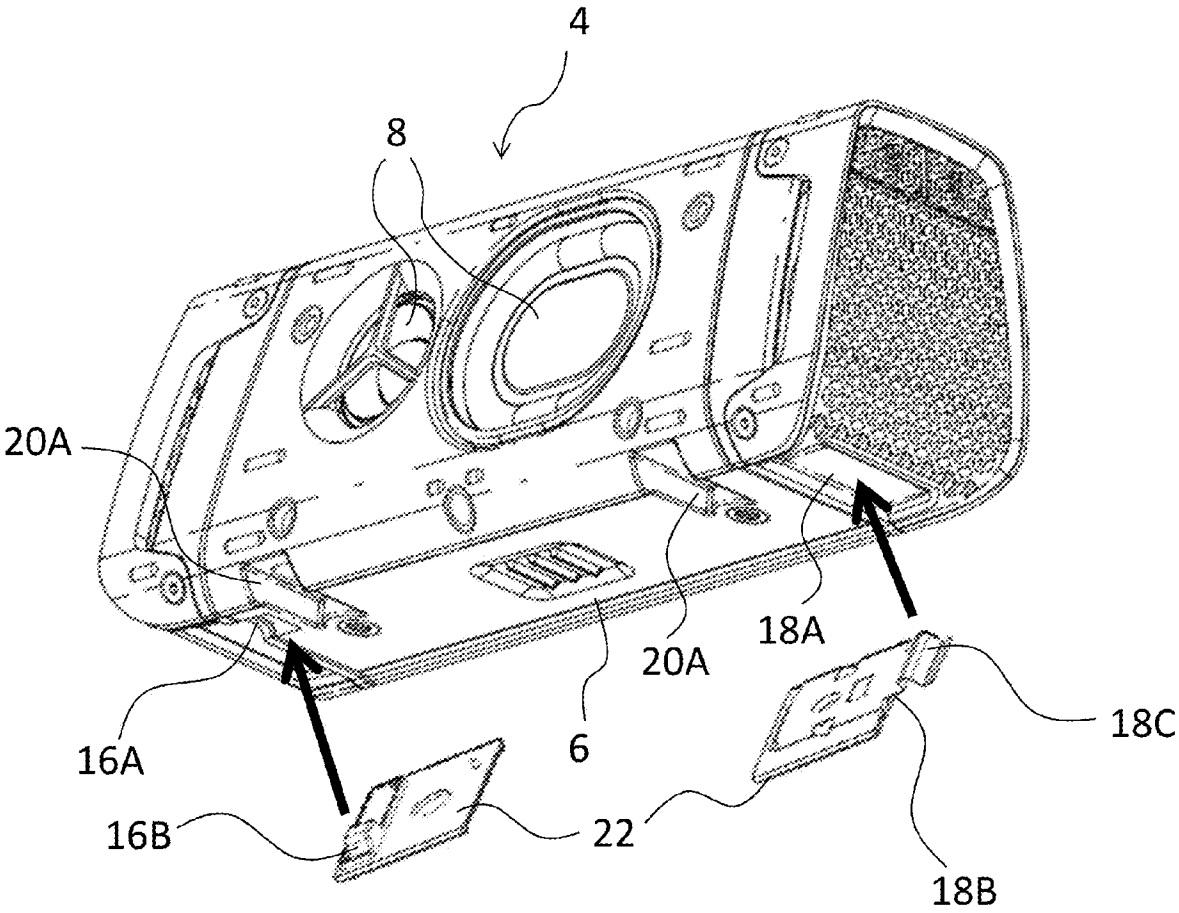
FIG. 3 illustrates the speaker core and components of a jacket that can be used to secure the assembled speaker system in a properly aligned condition.

The speaker system 10 may also include various features to align and/or secure the speaker core 4 and jacket 2 together in an assembled and properly aligned condition. FIG. 3 illustrates the speaker core 4 and components 22 of a jacket that can be used to secure the assembled speaker system in a properly aligned condition. Alignment features 16A-B, 20A and locking features 18A-B are shown. In some embodiments a single pair of corresponding features can both align and lock the jacket and speaker core in position. In other embodiments, only one of an alignment feature and a locking feature is used. For example, the shape of the speaker core or features on the speaker core can constrain the jacket to only one connection position, thus no additional alignment features may be necessary. In still other embodiments, the jacket can attach to the speaker core in two or more different orientations. In addition, some embodiments do not use a locking feature. For example, the jacket 2 can comprise an elastic sleeve that fits securely around the speaker core 4 without the need for additional locking features.

A speaker system 10 can include an alignment feature 16, 20, 24 (FIGS. 3-5). The alignment feature can be a visual, physical, and/or auditory alignment feature. The alignment feature can provide one of many benefits. For example, the alignment feature can assist the assembler in properly orienting the jacket prior to connection to the speaker core. In addition, or alternatively, the alignment feature can provide feedback to the assembler of a correct alignment of parts. The alignment feature can provide many benefits. For example, the alignment feature can help ensure that buttons on the jacket are aligned with the proper corresponding button on the speaker core.

The alignment feature can comprise a slot, hole, notch, groove or some other indentation 16A, 20A and a corresponding protrusion 16B to fit within the indentation. In FIG. 3, the speaker core 4 includes three notches 16A, 20A that are configured to receive a protrusion 16B on the jacket (components 22 of the jacket being shown). In the illustrated embodiment, only one of the notches 16A is being used by a protrusion 16B on the jacket. The other notches may also be used, or may be configured for use with other jacket designs. It will be understood that one of either the notch or the protrusion is on the speaker core and the other is on the jacket. As can be seen in FIG. 3, the left side of the speaker core 4 includes a notch 16A, but the right side does not. Thus, the protrusion 16B would have nowhere to go if it is attempted to connect the jacket and speaker core in the wrong orientation. This can indicate to the assembler that the system is being assembled incorrectly. In some embodiments, engaging the protrusion 16B and notch 16A may result in a click or other sound that can provide auditory feedback to the user of the proper connection. FIG. 4 shows a portion of the assembled and properly aligned speaker system 10.

Figure 4A:
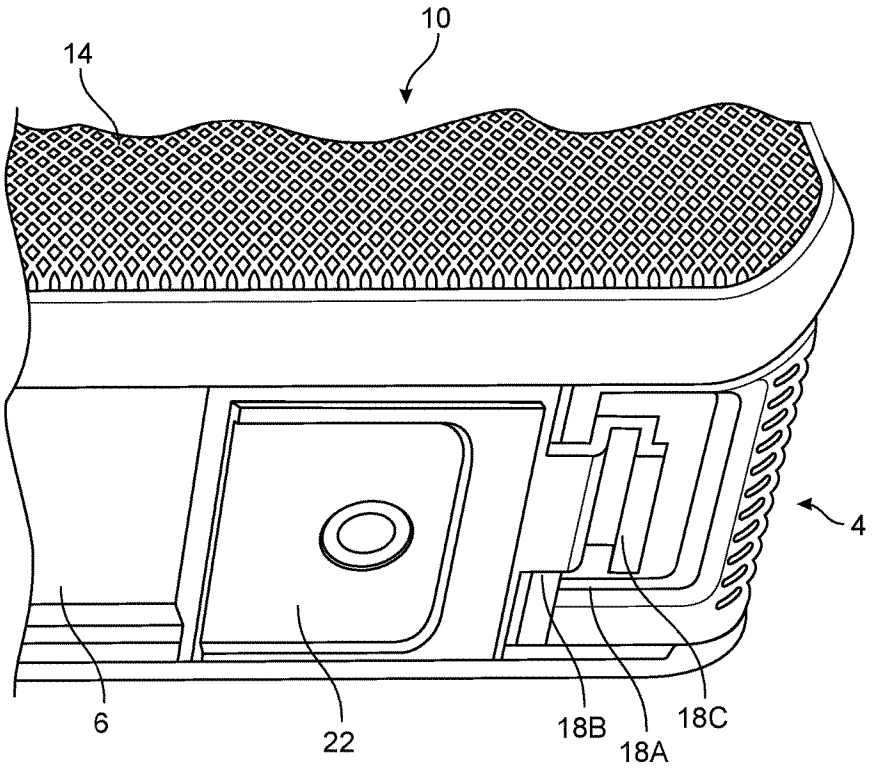
FIG. 4A is a bottom view of the assembled speaker system of FIG. 1.
Figure 4B:
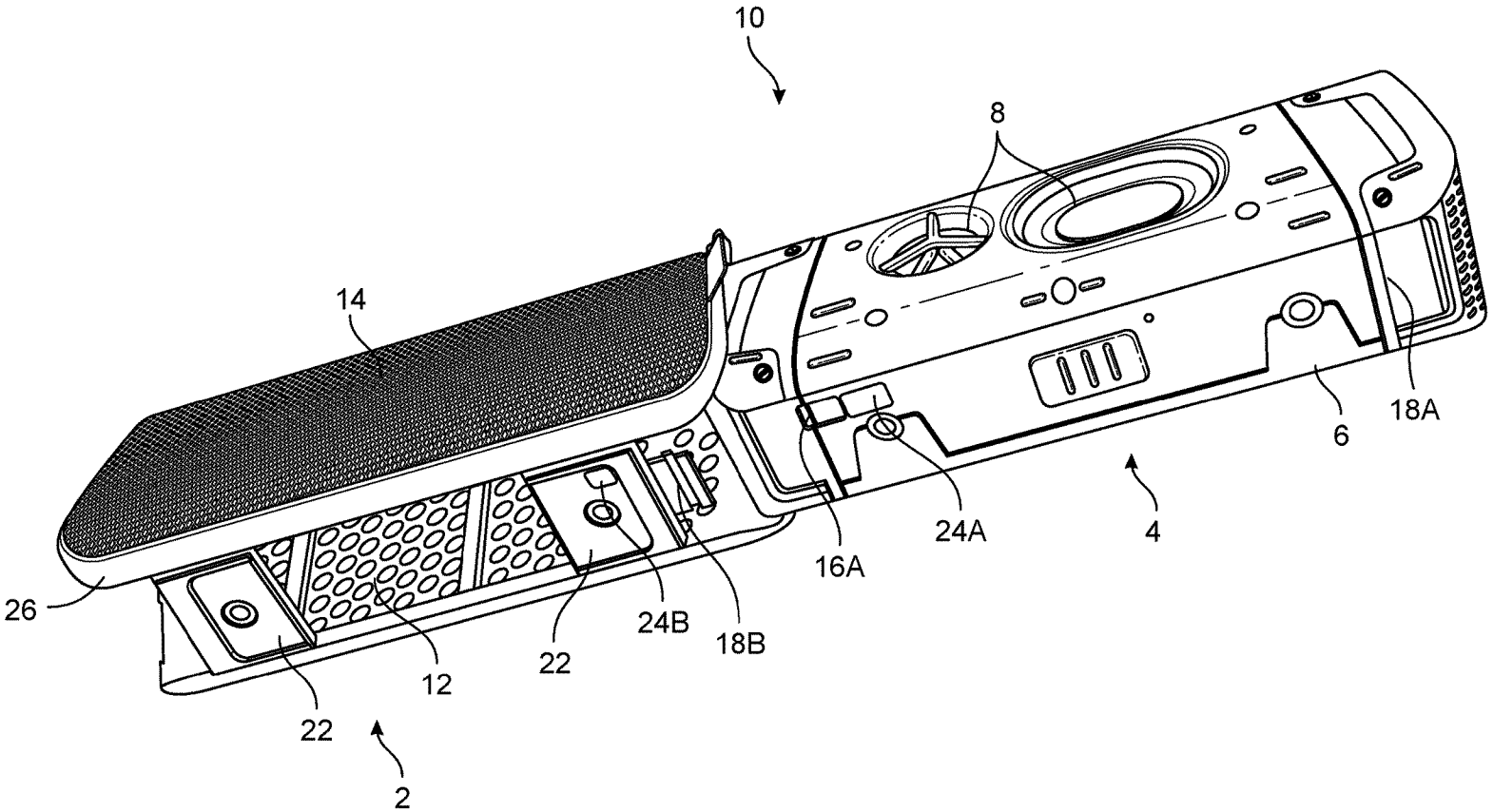
FIG. 4B shows an orientation of the jacket and speaker core for assembly of the system.

The functioning of the alignment feature may depend on how the jacket 2 connects to the speaker core 4. As shown in FIG. 4B, the jacket 2 can slide onto the speaker core 4. The protrusion 16B can slide into the notch 16A when the two parts are aligned and then connected in the proper orientation. If the jacket 2 were to be slid onto the speaker core 4 from the other side, the protrusion 16B can form a stop to engage the bottom of the speaker core 4 to thereby prevent the jacket from complete advancement onto and/or proper alignment with the speaker core.

The alignment feature may comprise a visual indicator 24A, 24B as shown in FIG. 4B. The visual indicator may be in addition to, or instead of, a physical and/or auditory alignment feature. As illustrated, the visual indicator 24A, 24B is a printed graphic pad to help the user orient the jacket 2 with respect to the speaker core 4 prior to assembly. In some embodiments, the visual indicator 24A, 24B can indicate proper alignment after assembly. The visual indicator 24A, 24B can be one or more of a color, arrow, triangle, letter, words, picture, etc.

A speaker system 10 can include a locking feature 18. The locking feature can provide one of many benefits. For example, the locking feature can lock the jacket and speaker core in position. The locking feature can also secure the assembled speaker system in a properly aligned condition. The speaker system 10 can include a locking feature in addition to, or instead of, an alignment feature.

The locking feature 18 can take one of many different forms. The locking feature can comprise a fastener and/or a latch. In the illustrated embodiment of FIG. 3, the locking feature is a deflection latch system 18A-B to automatically latch when the jacket is properly positioned on the speaker core. In other embodiments, the latch may be a latch that requires an additional step of movement of the latch to lock in position once the jacket and speaker core have been properly aligned.

Deflection latch systems can be used to hold two parts together. Use of a deflection latch system can speed the assembly process, decrease production cost and reduce the number of parts. A deflection latch system may also be known as a snap latch, hook type deflection latch, or snap fit, among other names.

A deflection latch system is a mechanical joint system where part-to-part attachment is accomplished with locating and locking features (constraint features) that are homogenous with one or the other of the components being joined. Joining requires the (flexible) locking feature 18B-C to move aside for engagement with the mating part, followed by return of the locking feature toward its original position to accomplish the interference required to latch the components together. The mating part may be a locator feature, and may provide strength and stability in the attachment by being less flexible than the locking feature. Though, this is not always the case as two flexible locking features may also engage one another.

Thus, the deflection latch system can include a slot, hole, notch, groove or some other indentation 18A and a corresponding protrusion 18C to fit within the indentation. Either one of the protrusion 18C or the notch 18A can be on the deflection arm 18B.

Looking now to the deflection latch system as shown in FIG. 3, the jacket includes a protrusion 18C on a deflection arm 18B. The deflection arm 18B can move in and out to allow the jacket 2 to snap into place on the speaker core 4 as shown in FIG. 4A. The deflection arm 18B is shown extending generally horizontally. The deflection arm can have one of many different orientations and shapes dependent on many different factors such as the desired mounting position, the space available, etc.

The protrusion 18C and notch 18A can have any number of different shapes. In a preferred embodiment, the shapes are generally corresponding, such as corresponding round shapes, but they can also be different such as a square protrusion and a circular hole or a pyramid protrusion and a square hole.

Looking now at FIGS. 5A-D, another embodiment of speaker core 400 and jacket 200 is shown. Numerical reference to components is the same as previously described, except that two zeros (00) has been added to the end of each reference number. Where such references occur, it is to be understood that the components are the same or substantially similar to previously-described components. It should be understood that the illustrated speaker core and jacket includes each of the features designated by the numbers used herein. However, as emphasized repeatedly herein, these features need not be present in all embodiments.

In this embodiment, the alignment and locking features are slightly different from that previously discussed. For example the alignment feature can have a different shape and position. As can be seen, the notch 1600A is on the speaker core and the protrusion 1600B on the jacket 200. The protrusion 1600B is shown as two small protrusions that stick up into the inside of the jacket to prevent the jacket from being connected to the speaker core in the wrong orientation.

For the locking feature, in the previously illustrated embodiment, the jacket 2 has a deflection arm 18B with a protrusion 18C and the speaker core 4 has a notch 18A to receive the protrusion. In the embodiment of FIGS. 5A-D, the notch and protrusion are reversed. The deflection arm 1800B is still on the jacket 200, but it now surrounds part of a notch or hole 1800A. The protrusion 1800C is on the speaker core 400. As illustrated, the notch is in the shape of a triangle to provide visual indication of the direction for connecting the jacket 200 to the speaker core 400. In addition, the triangular shape can facilitate removal of the jacket as the deflection arm is forced over the triangular shape to remove the jacket.

In some embodiments, a speaker system can comprise a removable jacket and a speaker core. The speaker core can comprise a housing having at least six sides and a speaker positioned within the housing. The removable jacket can cover the speaker on an outside surface of the housing, the jacket extending along at least three sides of the housing. The speaker system may further include a notch and a protrusion, wherein one of either the notch or the protrusion is on the housing and the other is on the jacket. The system can be configured for one-way sliding attachment of the jacket onto the housing with the notch and protrusion positioned to 1) properly align the housing and jacket when the protrusion is engaged with the notch and to 2) prevent the housing and jacket from complete attachment when the protrusion and notch are incorrectly orientated such that the jacket and housing are not properly aligned. In certain embodiments, the speaker system may further include a locking system comprising a second protrusion and a second notch. The second protrusion configured to fit within the second notch, wherein one of either the second notch or the second protrusion is on the housing and the other is on the jacket. In certain embodiments, the first notch and protrusion can serve as a locking system, as well as ensuring proper alignment.

Figure 6:
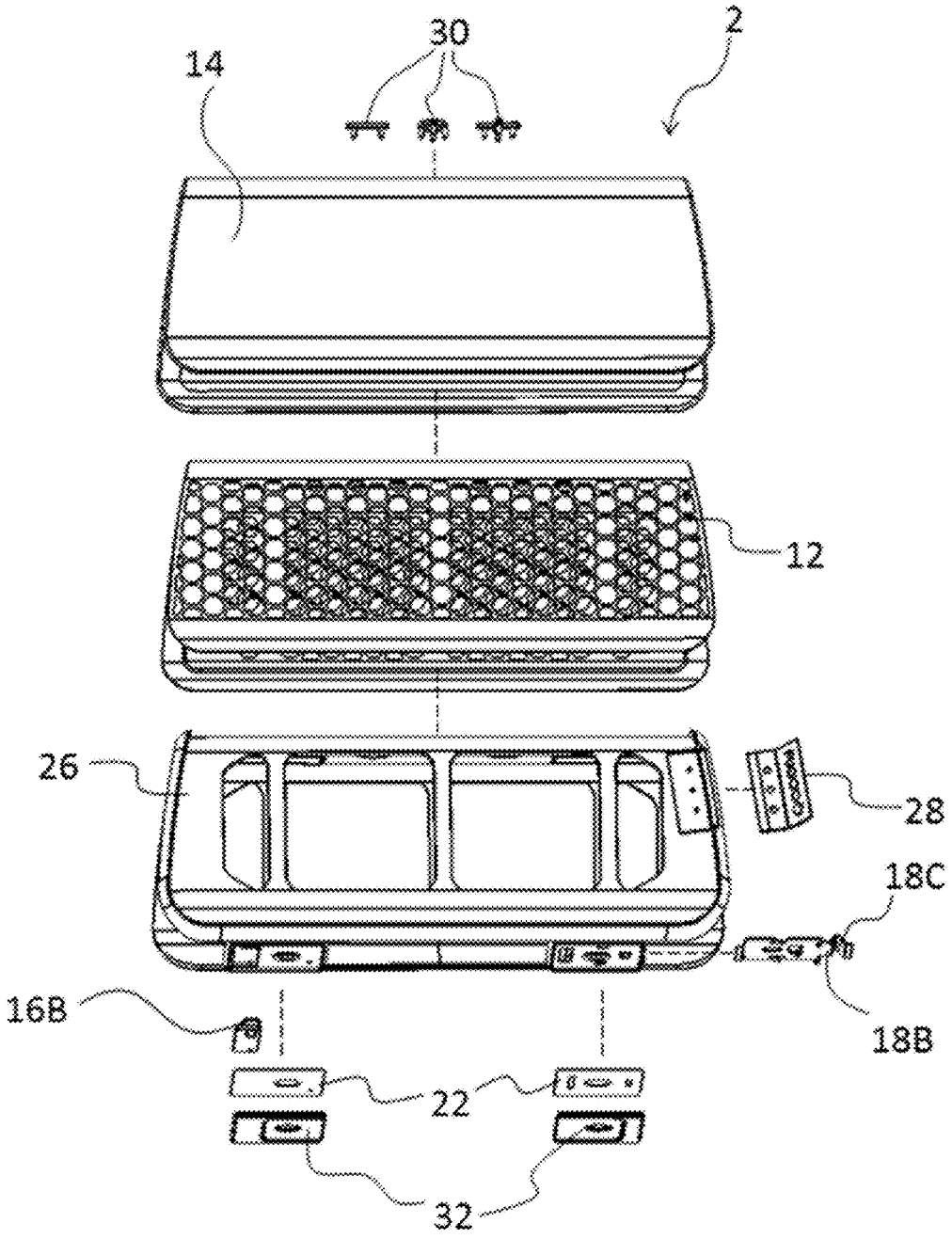
FIG. 6 shows an exploded view of a bottom and front of a jacket.
Figure 7:
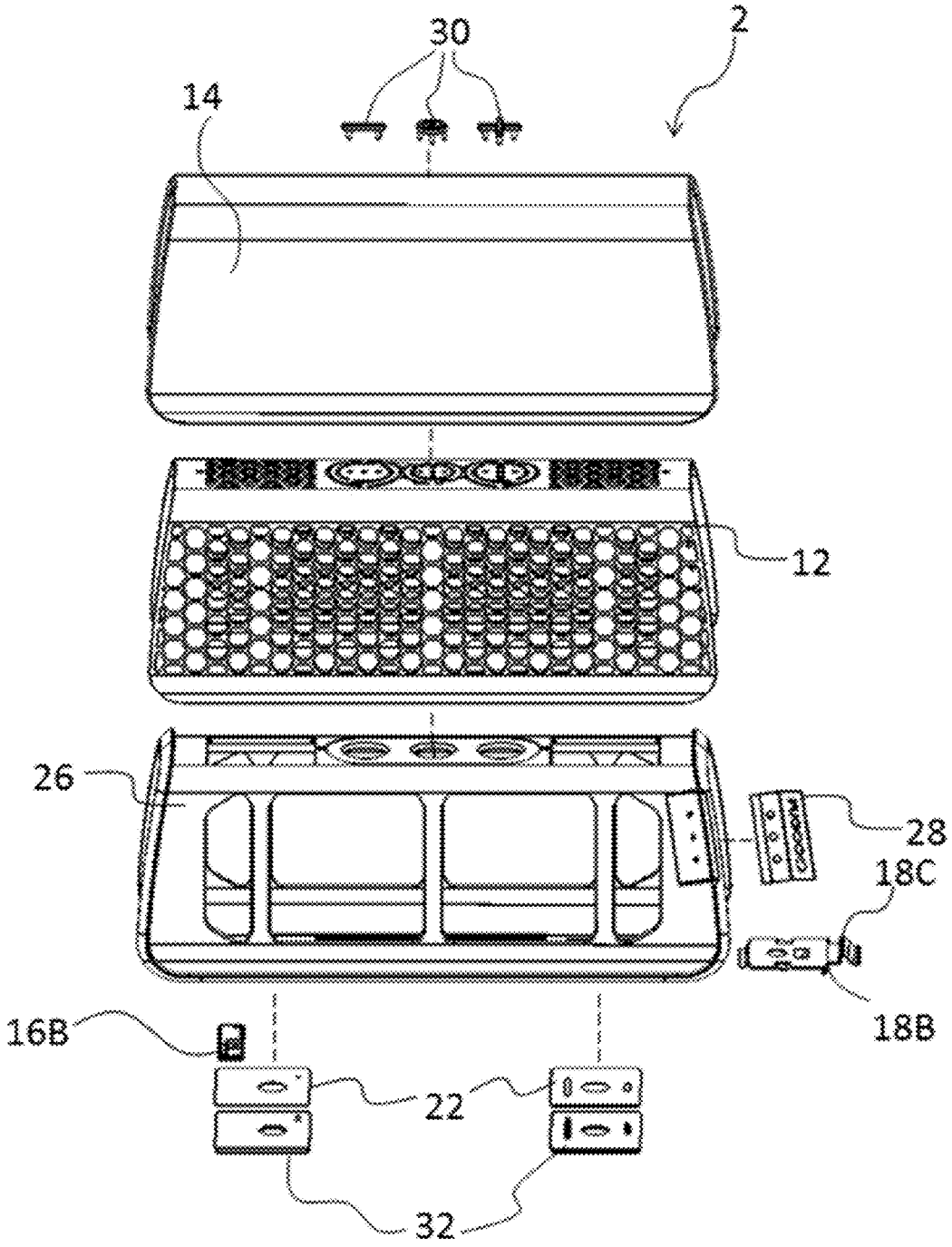
FIG. 7 is an exploded view of a top and front of the jacket of FIG. 6.

Moving now to FIGS. 6-13 aspects of various embodiments of jackets will now be described. A jacket 2 can be a removable jacket for covering the one or more speakers 8 on an outside surface of the housing 6 of the speaker core 4. FIGS. 6 and 7 show an exploded view of a jacket 2, many of the features of which having already been described. According to some embodiments, a jacket can include one or more of fabric 14 and a protective grill 12. The fabric 14 can be a mesh material with a plurality of small holes, as is common in the speaker art, but may also be other types of fabric. The illustrated jacket 2 has a protective grill 12 which can also serve as a frame for the fabric 14. The grill 12 can be positioned inside or outside of the fabric 14.

The jacket may also have a secondary frame 26. The secondary frame may be used to secure the fabric to the jacket by sandwiching a portion of the fabric between the secondary frame and the grill 12. A portion of a tag 28 for branding may also be sandwiched between the secondary frame 26 and the grill 12. The jacket may also include one or more buttons or button user interfaces 30, such as for volume, source, play, pause, stop, previous, next, power, etc. The buttons 30 may extend through the fabric 14, grill 12, and/or secondary frame 26 to engage the speaker core 4. In some embodiments, the buttons 30 are user interfaces. In some embodiments, the buttons 30, or the user interfaces, are mechanical portions of buttons, and the electrical portions are on the speaker core 4. In some embodiments, the speaker core may also include additional mechanical portions of the buttons. In some embodiments, the speaker core includes all parts of the buttons and there are no buttons and no button parts on the jacket.

As has been mentioned, the jacket 2 may also include portions of an alignment and/or locking system. Alignment feature 16B is shown as a protrusion on a bottom of the jacket. In addition, locking features of a deflection arm 18B and a protrusion 18C are shown as part of the jacket 2. The jacket 2 can also include feet 32, such as rubberized feet.

The jacket 2 can provide many benefits to the speaker system. In addition to providing a particular outward appearance, the jacket 2 can offer protection to the speaker system. For example, the jacket can protect the one or more speaker 8 from damage by providing an outer protective covering. In addition, different jackets can be used to change aspects of the speaker system based on the same or a similar speaker core. The speaker core may respond differently electronically depending on the jacket that it is paired with.

The jacket 2 may impart different properties to the speaker system such as more or less strength, shock absorption, or ruggedness. The illustrated jacket 2 can provide everyday protection while being easy for use on the go. In addition, the grill 12 and/or secondary frame 26 may also provide shock and/or drop protection to the speaker core. For example, the grill 12 and/or secondary frame 26 may be an elastic material.

Figure 8A:
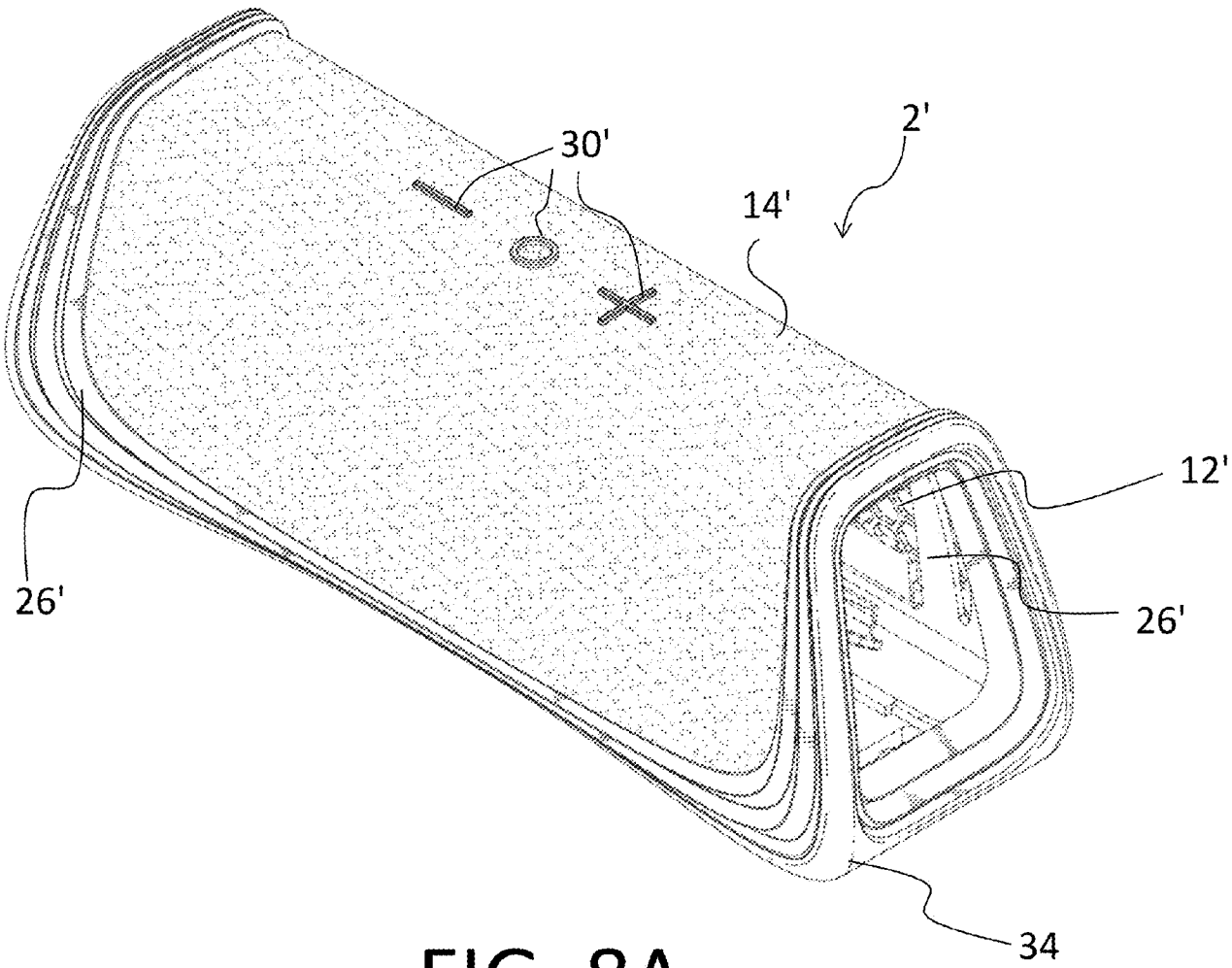
FIG. 8A illustrates a top, front and side perspective view of another embodiment of jacket.
Figure 8B:
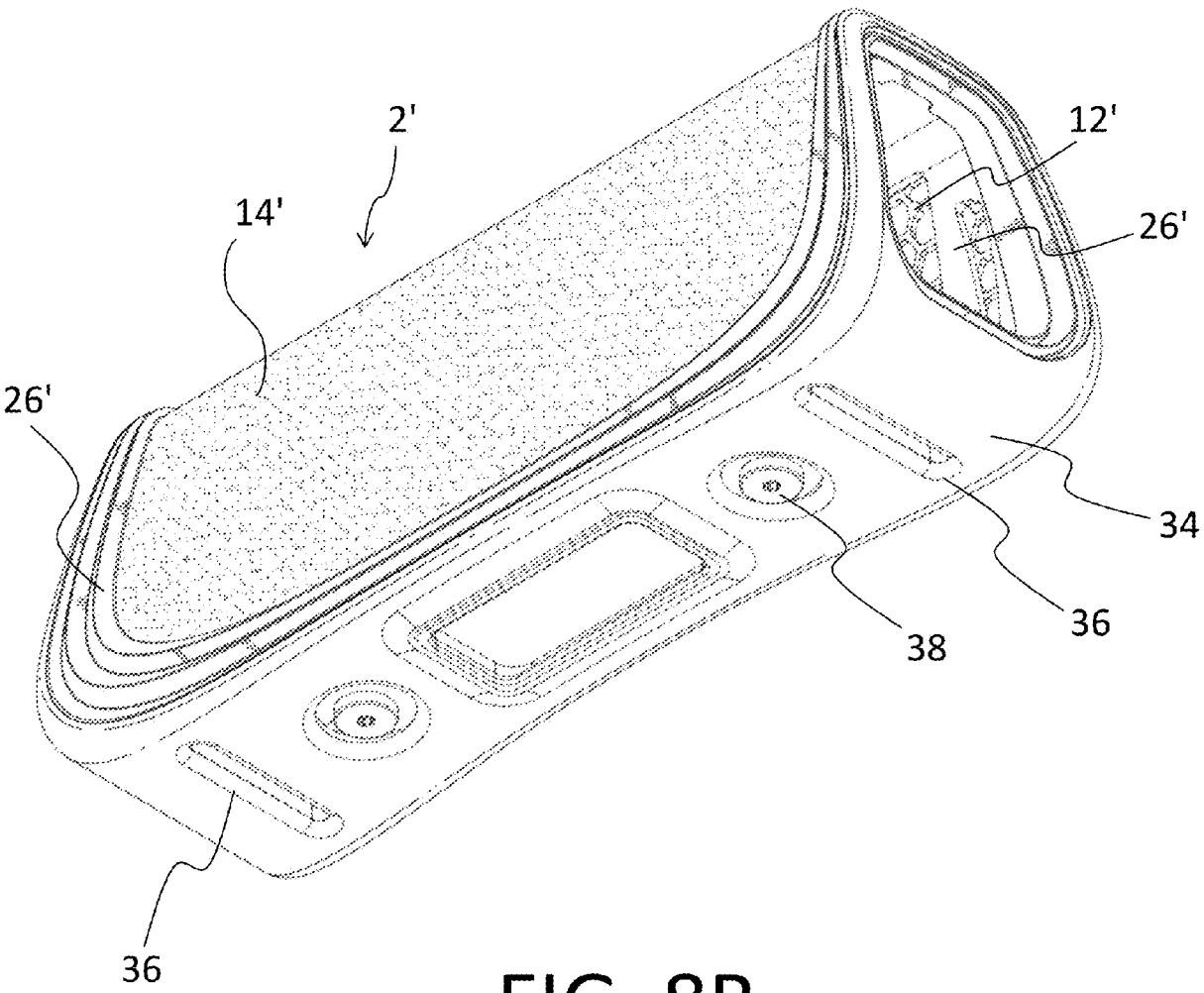
FIG. 8B is a bottom, front and side perspective view of the jacket of FIG. 8A.
Figure 9:
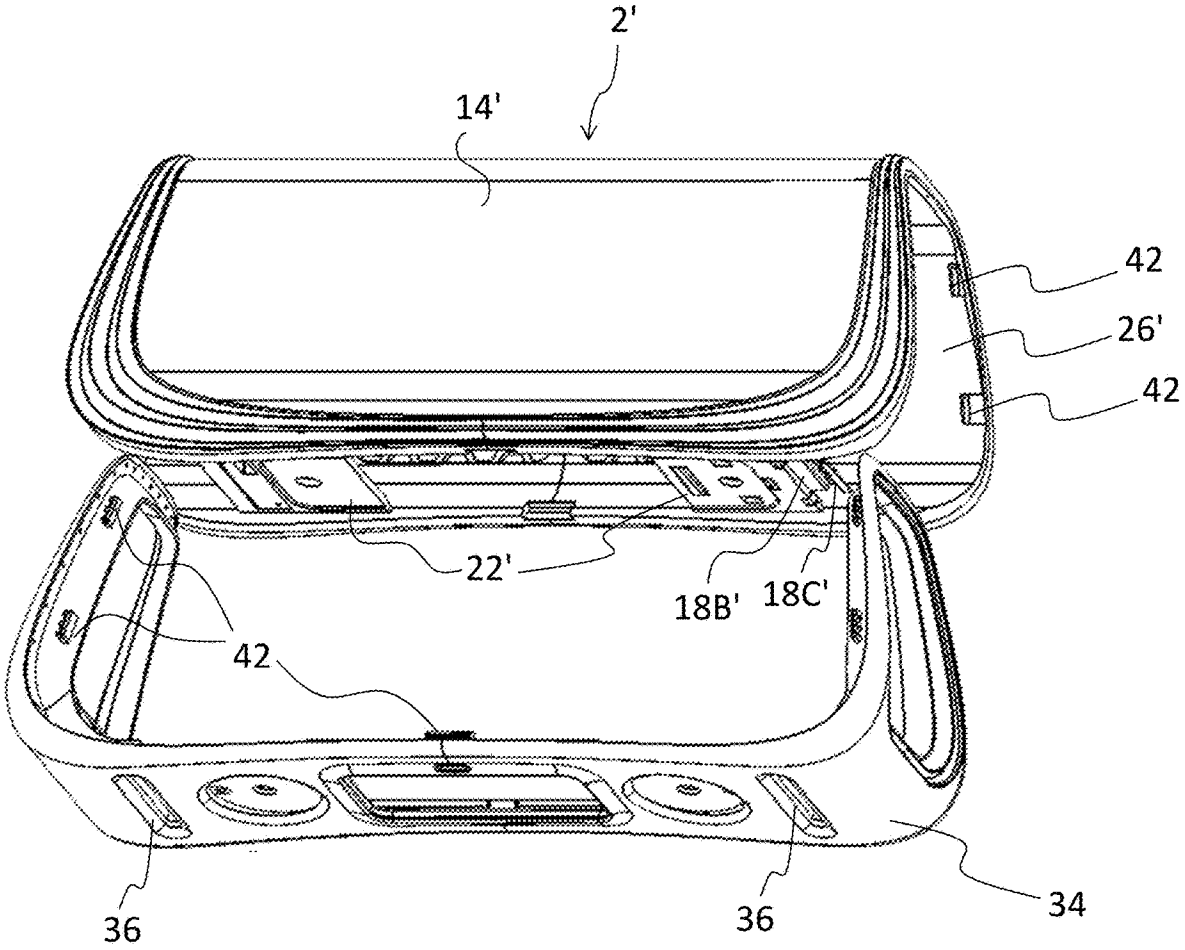
FIG. 9 shows a partially disassembled view of the jacket of FIG. 8A.

Looking now at FIGS. 8A-9, another embodiment of jacket 2' is shown. Numerical reference to components is the same as previously described, except that a prime symbol (') has been added to the reference. Where such references occur, it is to be understood that the components are the same or substantially similar to previously-described components. It should be understood that the illustrated jacket includes each of the features designated by the numbers used herein. However, as emphasized repeatedly herein, these features need not be present in all embodiments.

The jacket 2' is similar in many respects to the previously described jacket 2. For example, as can best be seen with reference to FIG. 10, the illustrated jacket 2' has a deflection arm 18B' and protrusion 18C' so as to connect to the speaker core 4 in a similar manner to the jacket 2. Thus, the jacket 2' can be slid onto the speaker core 4.

One of the main differences, besides the outside appearance, is that the jacket 2' includes a base member 34. The base member 34 can attach to the secondary frame 26' on the bottom and sides as seen in FIG. 9. The base member 34 and secondary frame 26' can attach via fasteners 42, such as the illustrated snapfit connectors, though other types of fastener can also be used. Thus, after the jacket 2' is slid onto the speaker core, the base member 34 can be snapped into place. This can allow the jacket 2' to provide additional protection and coverage of the speaker core. Thus, a jacket that is merely slid onto the speaker core may only cover a limited number of sides. The jacket 2' can cover all six sides of the speaker core 4.

In addition to providing a particular outward appearance, the base member 34 and/or secondary frame 26' may also provide shock and drop protection to the speaker system. In some embodiments, at least one of the base member 34 and secondary frame 26' are made of an elastic material such as a rubberized plastic. The base member 34 and secondary frame 26' can also attach to form a tight seal to prevent water or debris from entering the jacket 2' along the bottom or sides of the system. Thus, if the system were to be placed on grass or sand, the sealed base member 34 and secondary frame 26' can prevent debris from entering through the connection points.

At the same time, the jacket can also provide one or more drainage hole 36 (FIGS. 8B-9). In this way, if debris, such as sand were to enter the speaker system, such as through the fabric 14', it can be easily drained from the system without requiring removal of the jacket 2'. In the illustrated embodiment, there are two drainage holes 36 located on the bottom of the jacket 2'. It will be understood that the drainage holes can be located in other locations as well. It can also be seen that there is a gradual transition between the bottom of the base member 34 and the illustrated drainage holes 36. Thus, the openings of the drainage holes 36 are recessed from the bottom of the base member. This can help prevent or limit debris from entering the system through the drainage holes 36. In some embodiments, the jacket can also include internal channels to direct fluid and debris to the drainage holes 36. The holes 36 can also be used to attach a strap to the jacket. Thus the holes 36 can be elongated so to orient the strap in the desired direction such as along sliding or connecting axis of the jacket, perpendicular there to, or at some other angle.

The illustrated jacket 2' can be ideally suited for active outdoor use. The jacket 2' can be used at the beach, pool, or park, while also protecting against impacts.

Figure 10B:
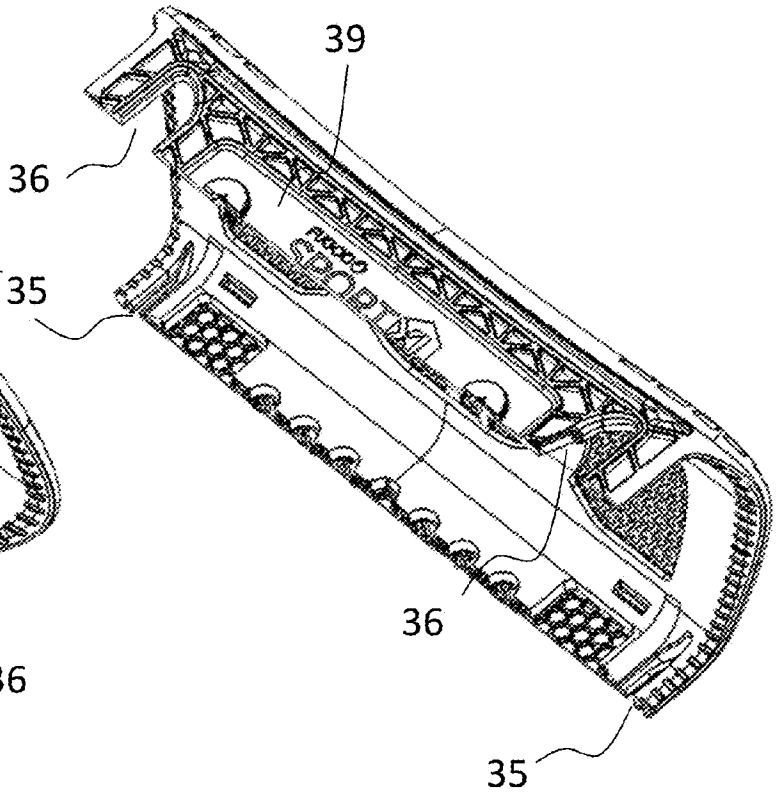
FIG. 10B shows an upside-down cross-sectional view of the jacket of FIG. 10A.
Figure 10A:
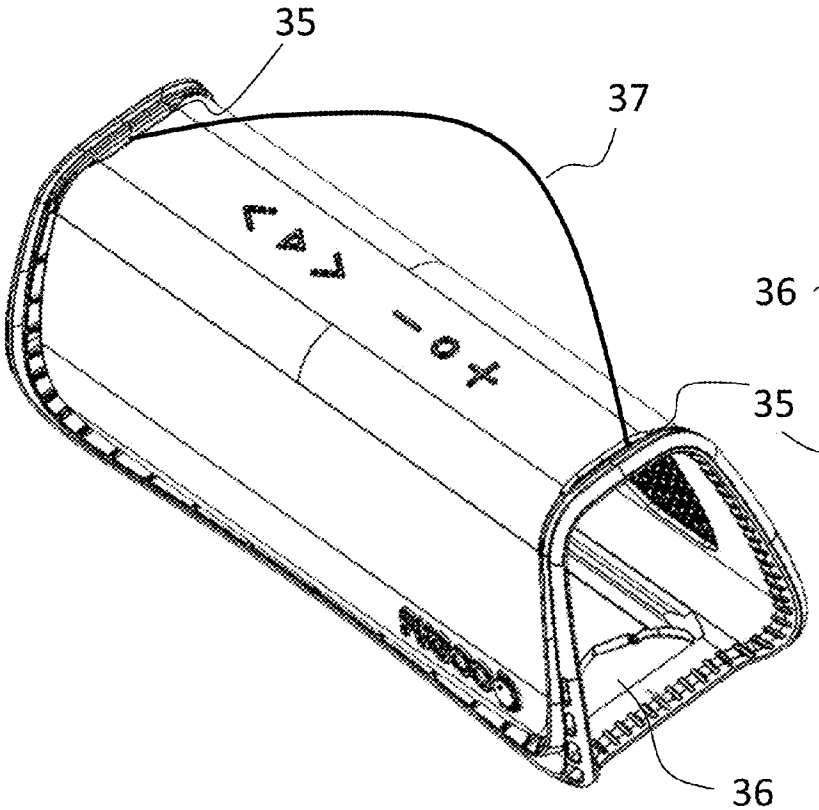
FIG. 10A is another embodiment of jacket.

FIGS. 10A-B show a variation on the jacket of FIGS. 8A-9. This jacket can slide onto a speaker core and does not use a base member 34 to connect to the jacket. In addition, it can be seen that the jacket includes additional buttons similar to the jacket of FIG. 5B. The jacket can be used with the speaker core 400 of FIG. 5A.

The jacket of FIGS. 10A-B is shown with holes 36 on the bottom. FIG. 10B shows the jacket upside-down; in this view, it can be seen that the bottom of the jacket can be shaped to facilitate the passage of a strap along the bottom between the two holes 36. The strap can pass through the holes and out the sides of the jacket. This can allow a strap to connect to the jacket along the long axis of the jacket. The bottom of the jacket can have a raised portion 39 with respect to the ends to allow the strap to be positioned along the bottom without interfering with the contact of the bottom of the jacket with a surface. The sides of the jacket can form the feet or low points to contact a surface.

The jacket can also have holes 35 on the top of the jacket. The holes 35 can be used to attach a strap or handle 37 to the jacket. An arc line 37 schematically represents a handle or strap 37 in FIG. 10A.

Turning now to FIGS. 11A-13, still another embodiment of jacket 2" is shown. Numerical reference to components is the same as previously described, except that a double prime symbol (") has been added to the reference. Where such references occur, it is to be understood that the components are the same or substantially similar to previously-described components. It should be understood that the illustrated jacket includes each of the features designated by the numbers used herein. However, as emphasized repeatedly herein, these features need not be present in all embodiments.

The jacket 2" can be assembled onto the speaker core 4 in multiple pieces. Thus, instead of sliding the jacket on from the side, a first piece 12A (FIG. 12) of the grill or protective enclosure 12" can be placed on the front or back of the speaker core 4, and then additional pieces 12B can be placed around the speaker core until the jacket is secured together. In some embodiments, a first piece 12A can be place on the top, bottom, or a side of the speaker core. The jacket 2" may be formed of two or more pieces. In some embodiments, the jacket is hinged to form a clam shell and to thereby envelop the speaker core.

The jacket 2" may use an alignment feature on the speaker core 4 such as one or more of the notches 20A (FIG. 3) to ensure proper alignment between the jacket 2" and the speaker core 4. A protrusion 20B (FIG. 12) on the grill 12 can fit within the notch 20A on the speaker core.

Figure 11A:
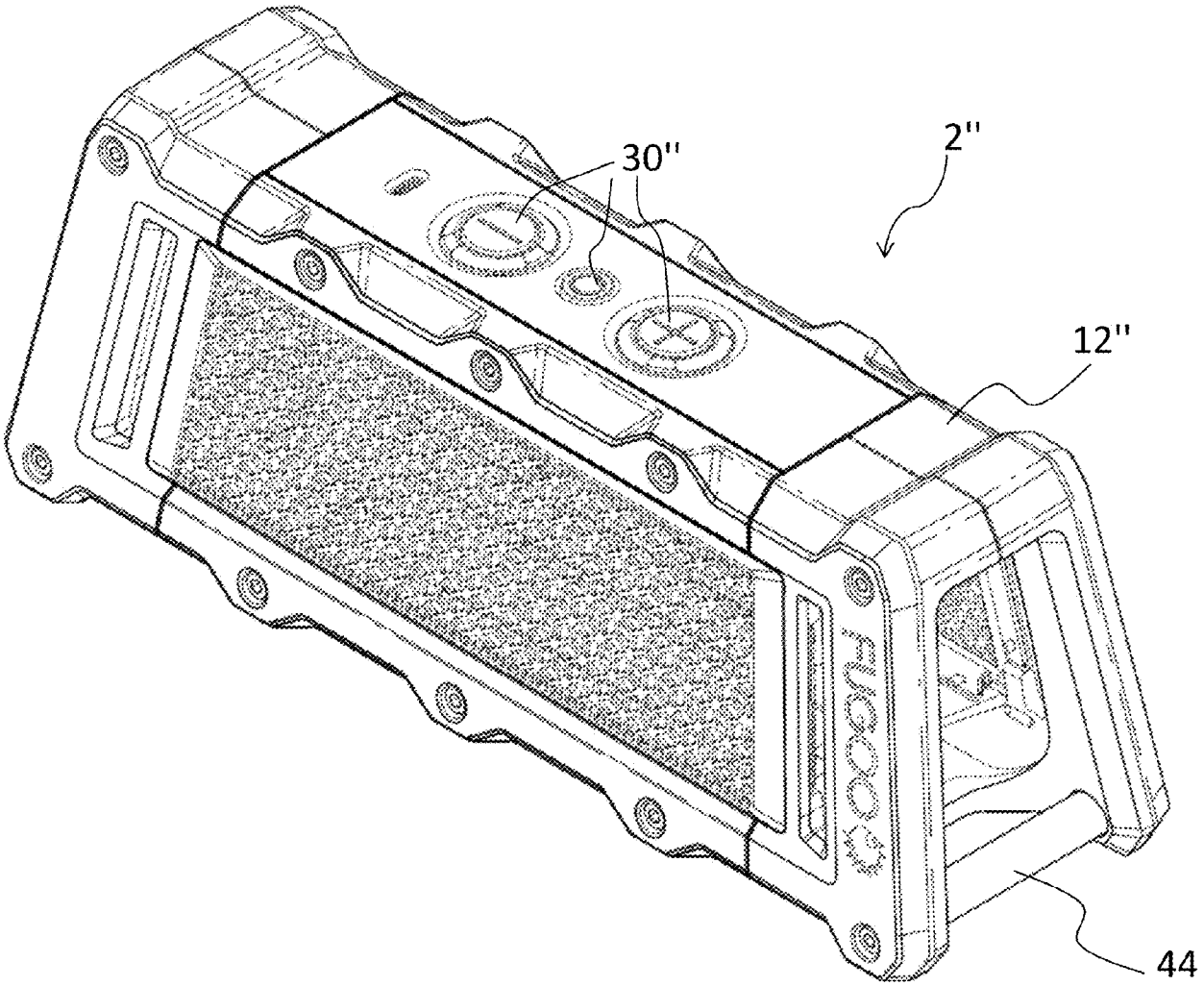
FIG. 11A illustrates a top, front and side perspective view of another embodiment of jacket.
Figure 11B:
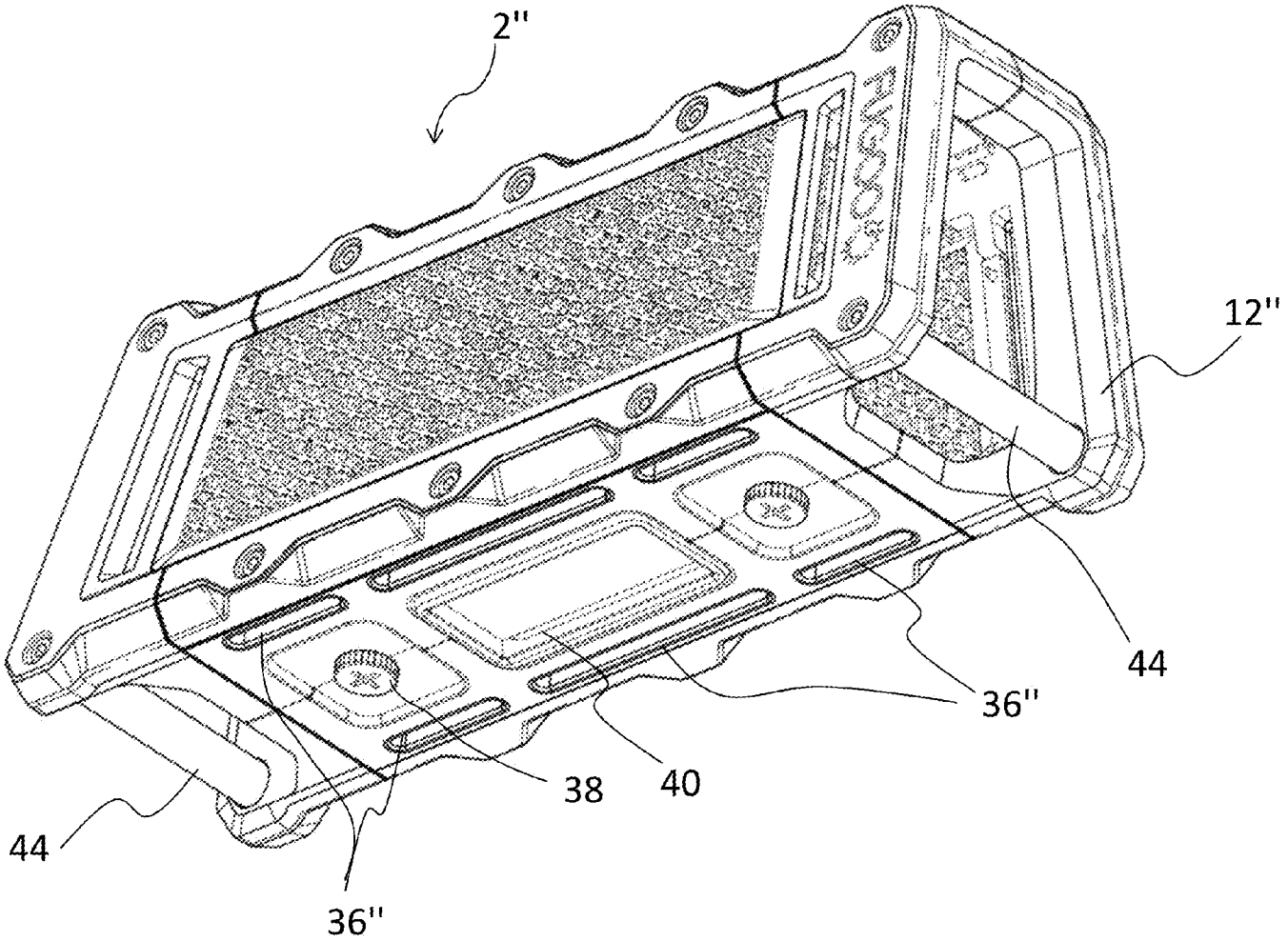
FIG. 11B is a bottom, front and side perspective view of the jacket of FIG. 11A.
Figure 12:
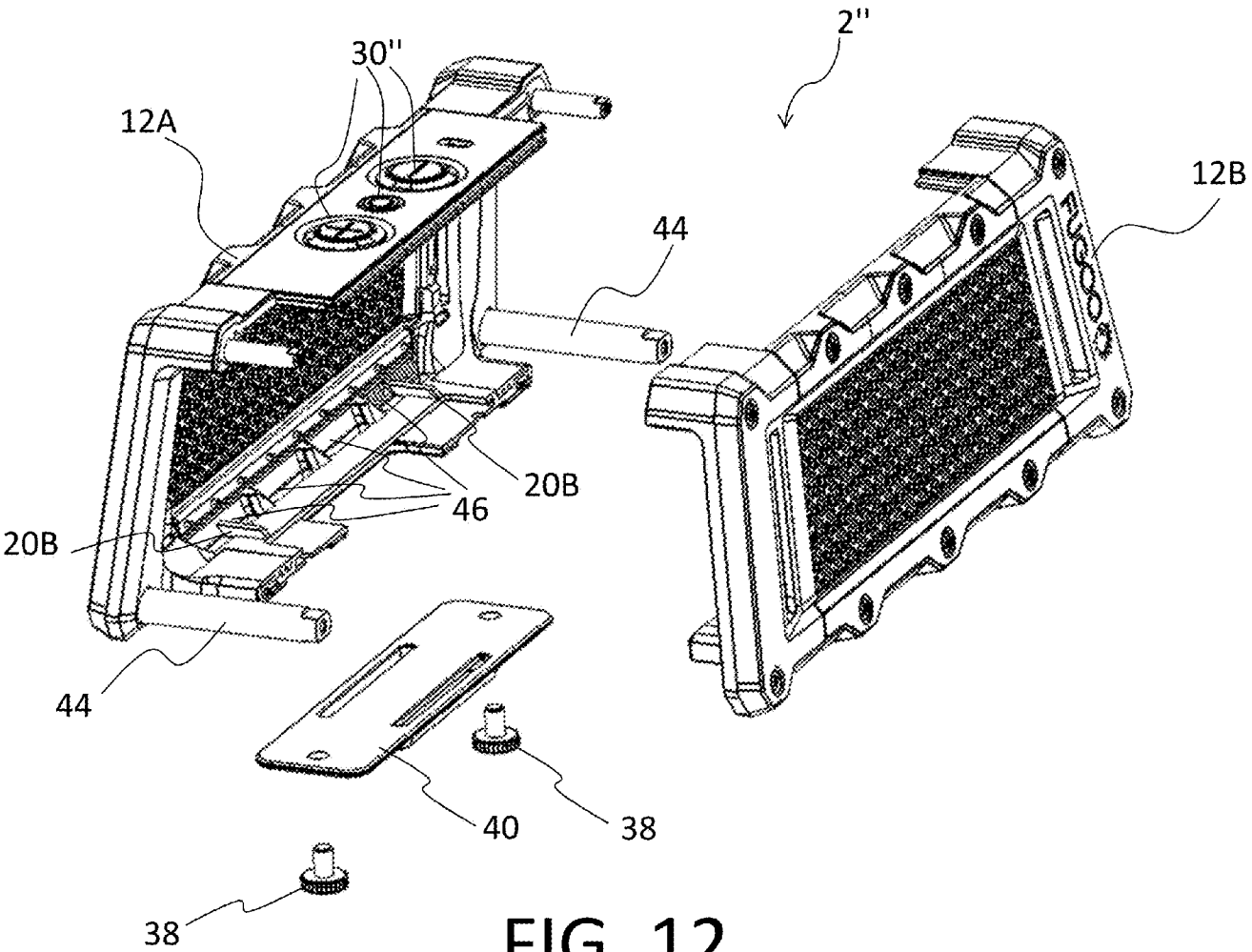
FIG. 12 shows a partially disassembled view of the jacket of FIG. 11A.

Referring now to FIGS. 11B and 12, the jacket 2" may also provide one or more drainage hole 36". The drainage hole(s) 36" can allow for easy draining of sand, water or other debris from the speaker system. The jacket 2" may further include one or more drainage channel 46. The one or more drainage channel can lead to one or more drainage hole to better facilitate drainage from the speaker system. In the illustrated jacket 2" there are three drainage holes 36" and six drainage channels 46 on each side. Other embodiments may include other numbers of and combinations of drainage holes 36" and channels 46. The sides of the drainage channels can be sloped to direct water or debris to the drainage holes. In addition, the walls of the jacket and/or speaker core may also be sloped to better facilitate drainage of the system.

In some embodiments, the jacket 2" can include one or more bar 44. The bar 44 can be used to hold the speaker system, among other uses. For example, a separate clip, hook, bungee, tether, and/or carabineer can engage the bar to facilitate attaching the speaker system to another object.

Figure 13:
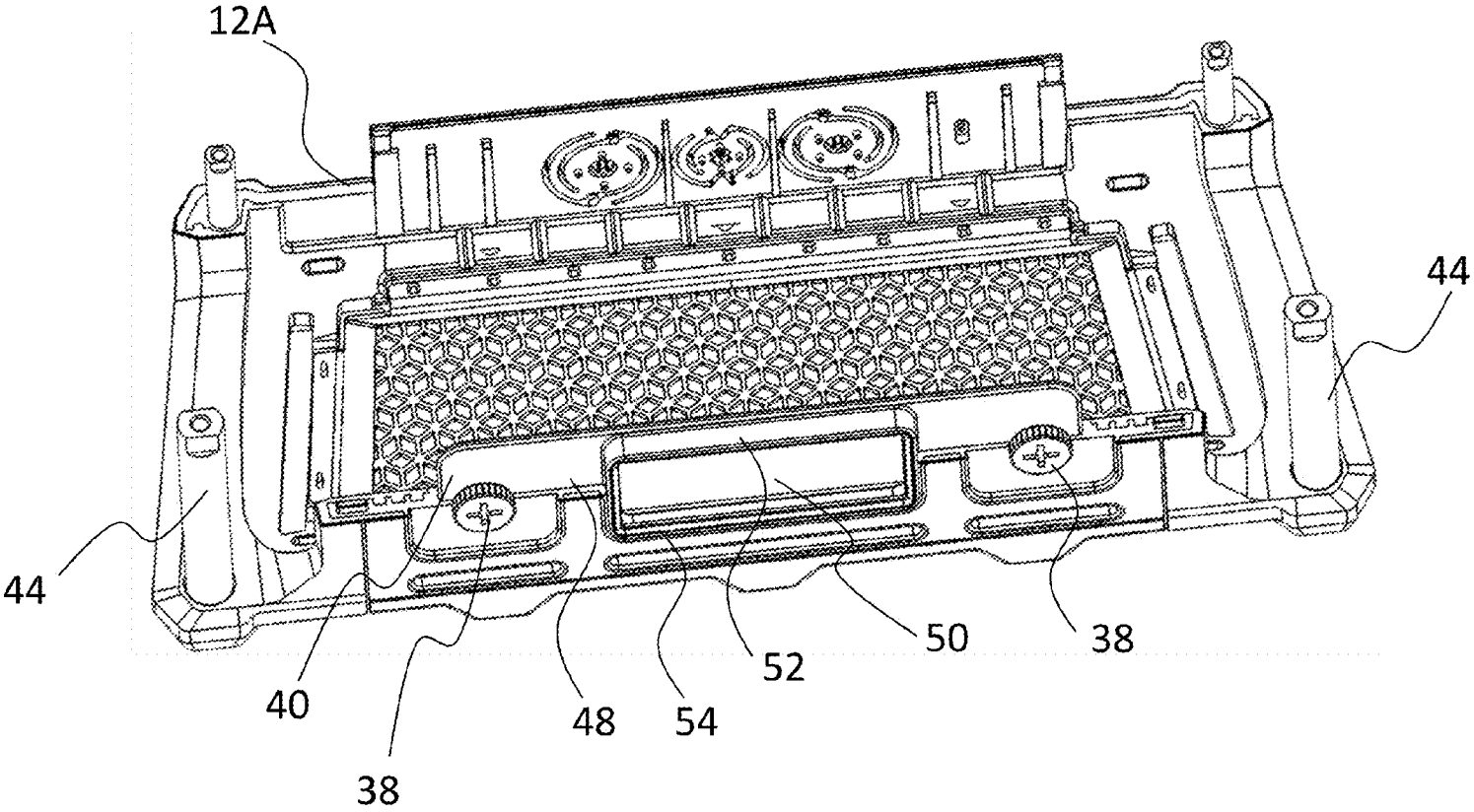
FIG. 13 illustrates an assembly position of an accessary mounting plate with respect to the jacket of FIG. 11A.

A speaker system may also include an accessary mounting plate 40. FIG. 13 illustrates an assembly position of an accessary mounting plate 40 with respect to the jacket 2". FIG. 12 shows the accessary mounting plate 40 removed from the jacket, while FIG. 11B shows an assembled configuration. An accessary mounting plate 40 can be used to attach accessories to the speaker system. The accessories can include any number of devices and systems such as a tripod or tripod mount, a bicycle mount, a clip, a carabineer, a strap, etc.

The accessary mounting plate 40 can include a base 48 and a receiving area 50. The receiving area 50 can be configured to receive an accessory. The receiving area 50 can comprise a slot, or opening configured to receive a portion of an accessory. Thus, the receiving area 50 can have surrounding wall 52. In some embodiments, the receiving area 50 can also include a lip or flange or other surface 54 that may extend from the wall 52. The receiving area 50 as illustrated has a raised wall 52 with an inwardly protruding lip or flange 54. An accessory can be received into the receiving area 50 and then can be locked in place. This can be done in many ways, such as by trapping a portion of the accessory between the base 48 and the lip 54 and/or expanding a member against the wall 52. Other attachment mechanisms or systems can also be employed.

Screws 38 can be used to attach the accessary mounting plate 40 to the jacket and/or speaker core. The accessary mounting plate 40 can attach directly to the speaker core without the use of a jacket. As can be seen in FIG. 13, the accessary mounting plate 40 can also form a part of the jacket 2", such as a part of the bottom surface. The accessary mounting plate 40 can also be used with other embodiments of jacket such as the jackets 2, 2' described previously. Additional details concerning accessories for use with the accessary mounting plate are provided in later parts of this detailed description.

Figure 14B:
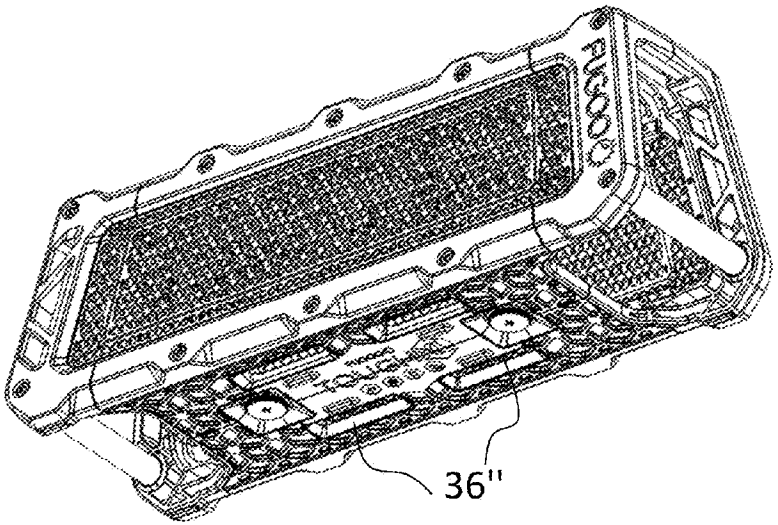
FIGS. 14A-B show top and bottom perspective views of another embodiment of jacket.
Figure 14A:
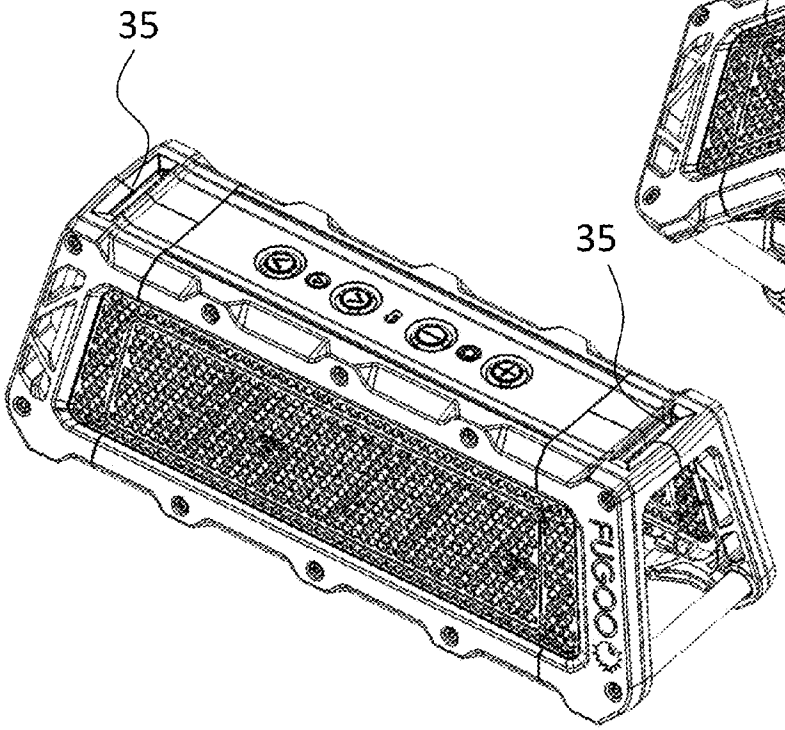
Figure 14C:
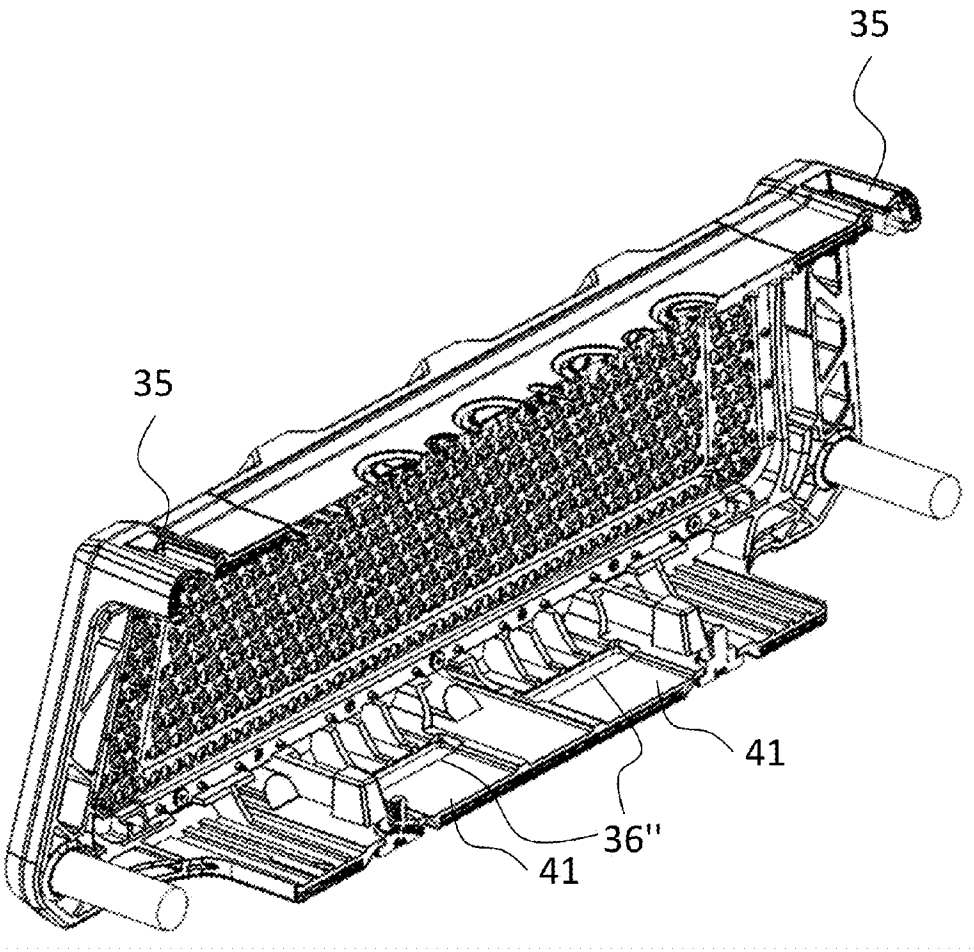
FIG. 14C shows a cross-sectional view of the jacket of FIGS. 14A-B.

FIGS. 14A-C show a variation on the jacket of FIGS. 11A-13. Certain differences will be apparent, such as the lack of accessory mounting plate, and the different location of the drainage holes 36". There are also two drainage holes 36" on each side, rather than three.

In FIG. 14B it can be seen that the bottom of the jacket can have two pairs of corresponding holes on either side. This can allow one or more straps to connect to the jacket in a direction generally perpendicular to the long axis of the jacket. As shown in FIG. 14C, an inside bottom portion 41 of the jacket can be recessed between corresponding holes (only one side shown) to facilitate the passage of a strap along the inner bottom between the two holes 36".

The jacket can also have holes 35 on the top of the jacket. The holes 35 can be used to attach a strap or handle to the jacket. In addition, it can be seen that the jacket includes additional buttons similar to the jacket of FIG. 5B. The jacket can be used with the speaker core 400 of FIG. 5A.

Figures 15A, 15B, 15C:
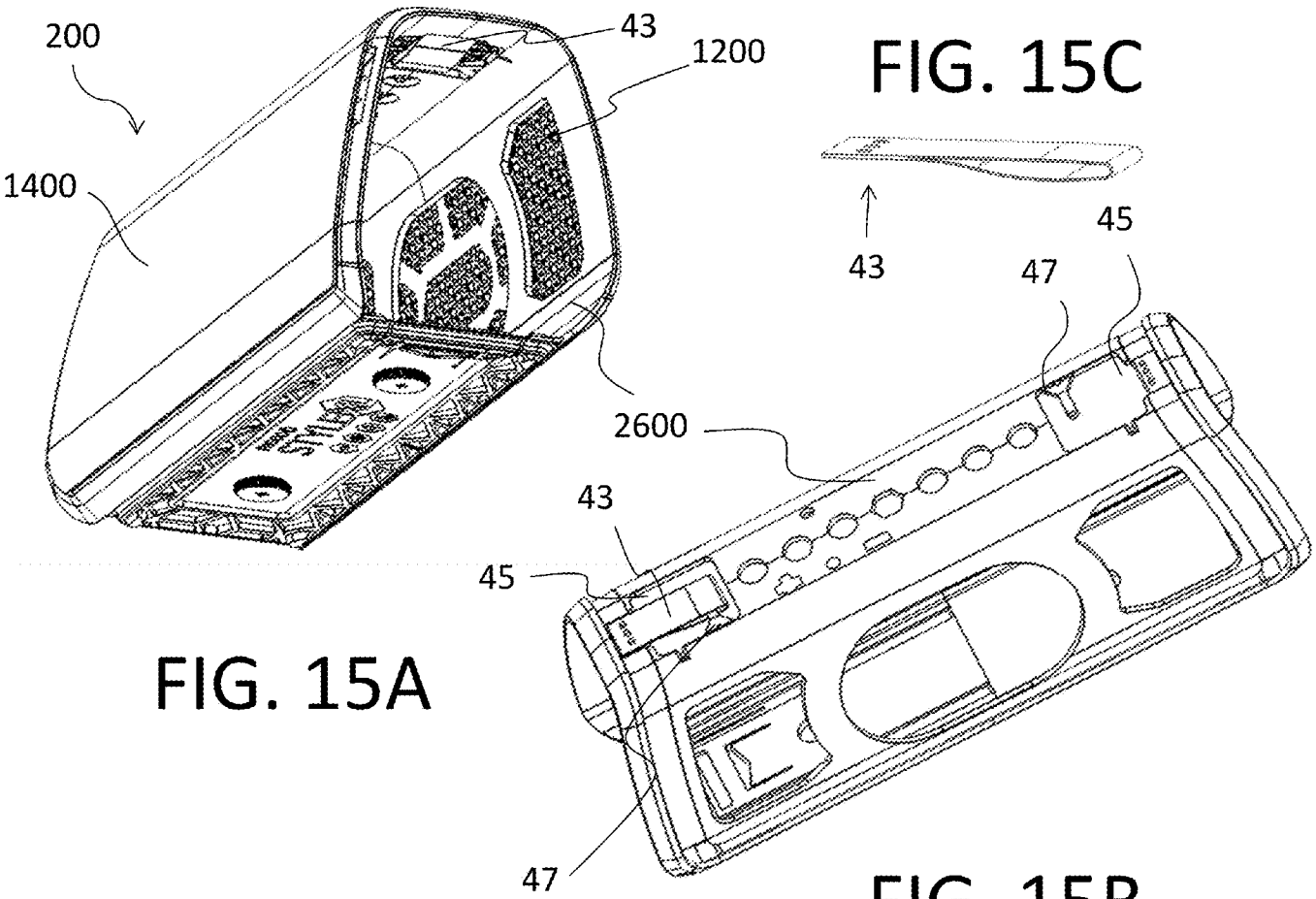
FIG. 15A illustrates a perspective view of the jacket of FIGS. 5B-D.
FIG. 15B shows certain components of the jacket of FIG. 15A.
FIG. 15C is a loop.

Looking now at FIGS. 15A-C, additional strap attachment points are shown. The two strap attachment points comprise two loops 43 on the jacket 200. The pair of loops 43 can have a ready for use position, and a stowed position. FIGS. 15A and 15B show a loop 43 in the stowed position. A detail view of a loop 43 is shown in FIG. 15C. In the ready for use position, the loop 43 can extend outside of the jacket to allow a strap to attach to the loop. For example, the loop 43 can be pulled out of the inside of the jacket.

In some embodiments, the jacket 200 can further include a space 45 cut out of the secondary frame 2600 to allow the loop 43 to not interfere with the speaker core. In this way, the loop 43 does not add any additional thickness to the jacket 200. In addition, sliding attachment of the jacket to the speaker core is not affected. In addition, the jacket can include a retention member 47 that can be used to help the loop 43 stay in place within the jacket. The retention member 47 can be an arm positioned within and/or extending to the space 45. The loop 43 can be positioned on or above the retention member 47 when not in use. This can help maintain the loop 43 out of the way when assembling the speaker system without making use of the loops externally. In FIG. 15B, one of loops is shown in place in the space 45, and one is removed to better illustrate the retention member 47.

When desired to use one or more loops 43, a user can pull one or more out from engagement with the retention member 47 and then out of the jacket. This is preferably done when the speaker core and jacket are separated. The user can then advance the jacket onto the core with them loops out. A strap, handle, or other accessory can be attached to the loop(s) when desired. In some embodiments, a jacket 200 includes one loop 43 or multiple loops 43. The loops 43 can be fabric or other flexible material. In some embodiments, the loop is made of nylon.

Speaker Core

Referring now to FIGS. 16A-20 various views of a speaker core 4 are shown. As has been mentioned, the speaker core 4 can be used with a jacket 2 to from a speaker system 10, such as a portable speaker system 10. The jacket 2 can be removable from the speaker core 4 and in this way, different speaker systems can be created based on the same or a similar speaker core. In some embodiments, the speaker core may respond differently electronically, or it may provide a different acoustic response, depending on the jacket that it is paired with. The speaker core 4 in some embodiments can be used without a jacket 2.

The speaker core 4 can provide the primary electronics and controls of the speaker system 10, as well as also including the speaker(s) 8. The speaker core 4 can include a housing 6 and one or more speakers 8 positioned within the housing 6. The speaker core 4 may connect via wires or wirelessly to one or more of a television, CD or Blue Ray player, router, repeater, stereo receiver, amplifier, cell phone, tablet, laptop, desktop computer, or storage drive, among other devices. For example, the speaker core 4 may stream music or other sound from a computer device such as a cell phone or tablet via wireless Bluetooth or other wireless standard.

Figure 20:
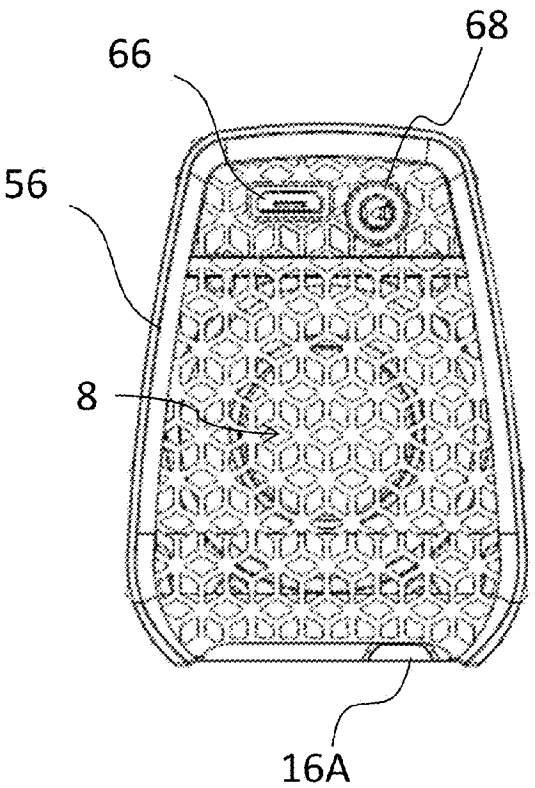
FIGS. 19 and 20 are side views of the speaker core of FIG. 16A.
Figure 19:
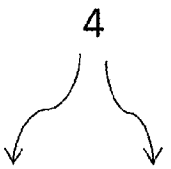
Figure 19:
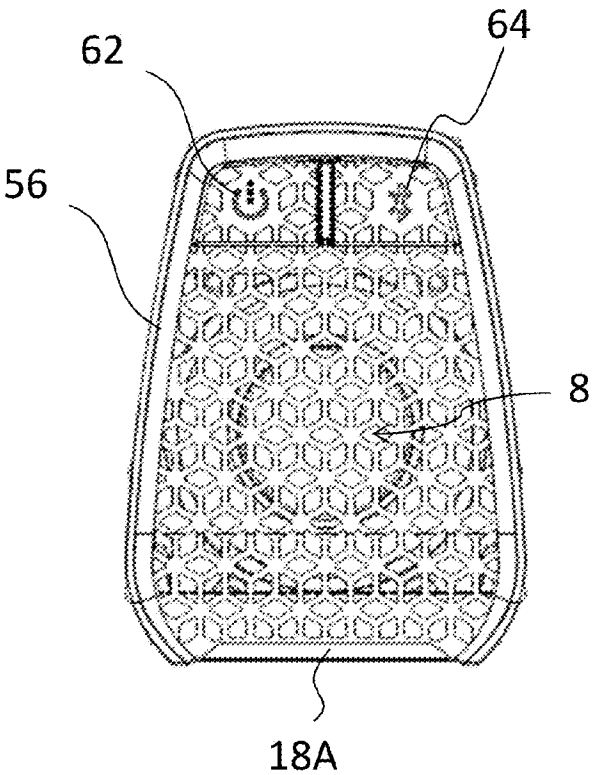

FIG. 19 shows a Bluetooth button 64 on the speaker core for syncing the speaker system with another Bluetooth device. The speaker core may include an auxiliary input 68 (FIG. 20) for plugging in audio devices, such as those that are not Bluetooth-enabled. FIGS. 19 and 20 also show a power button 62 and a microUSB connector 66. The speaker core 4 may include a built-in rechargeable battery that can be powered through microUSB. The speaker core may also require an external power source. Each of these buttons 62, 64 and connectors 66, 68 can also be on a jacket for attachment to the speaker core.

Figure 16A:
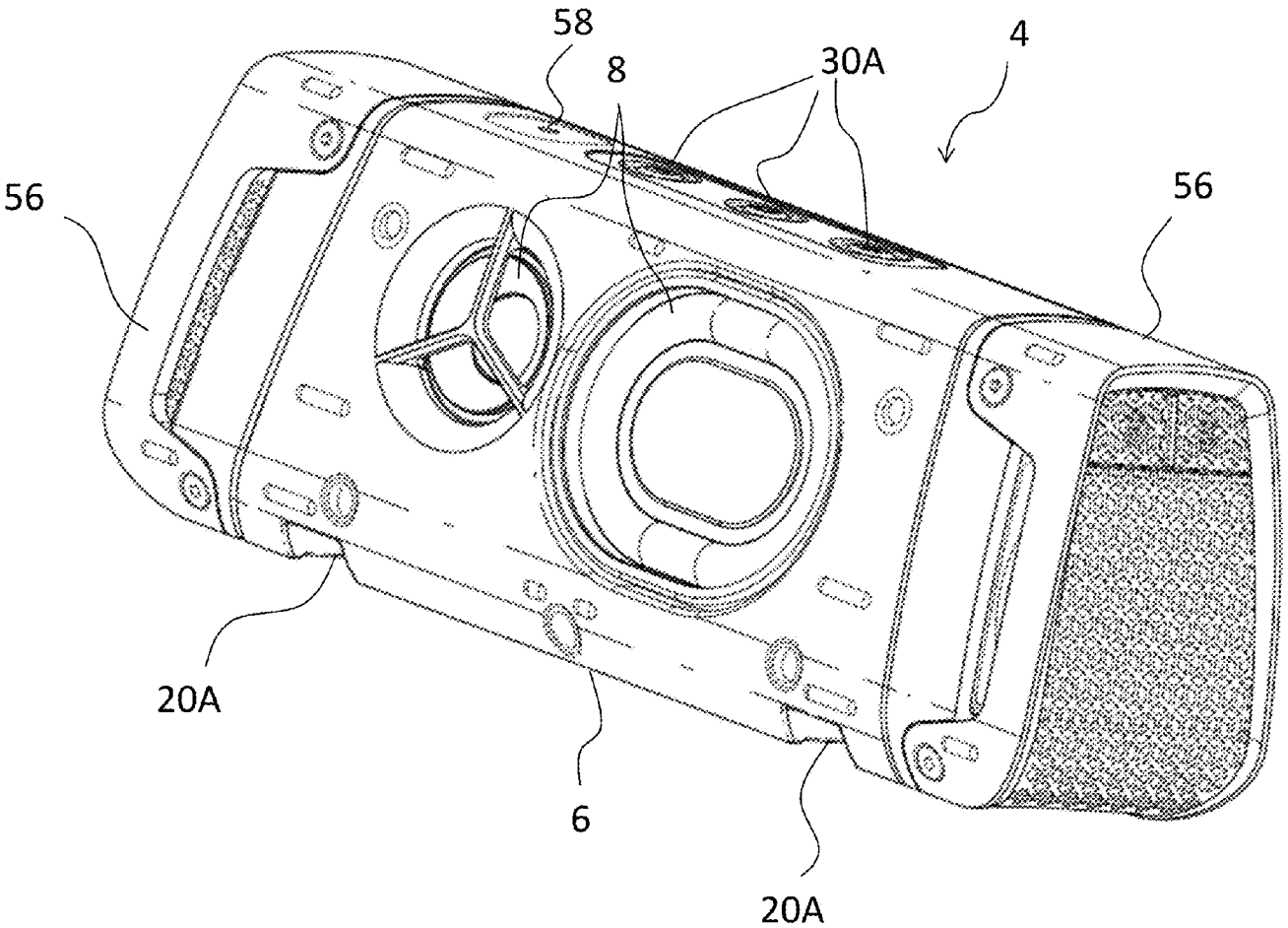
FIG. 16A shows a front, top and side perspective view of a speaker core.
Figure 16B:
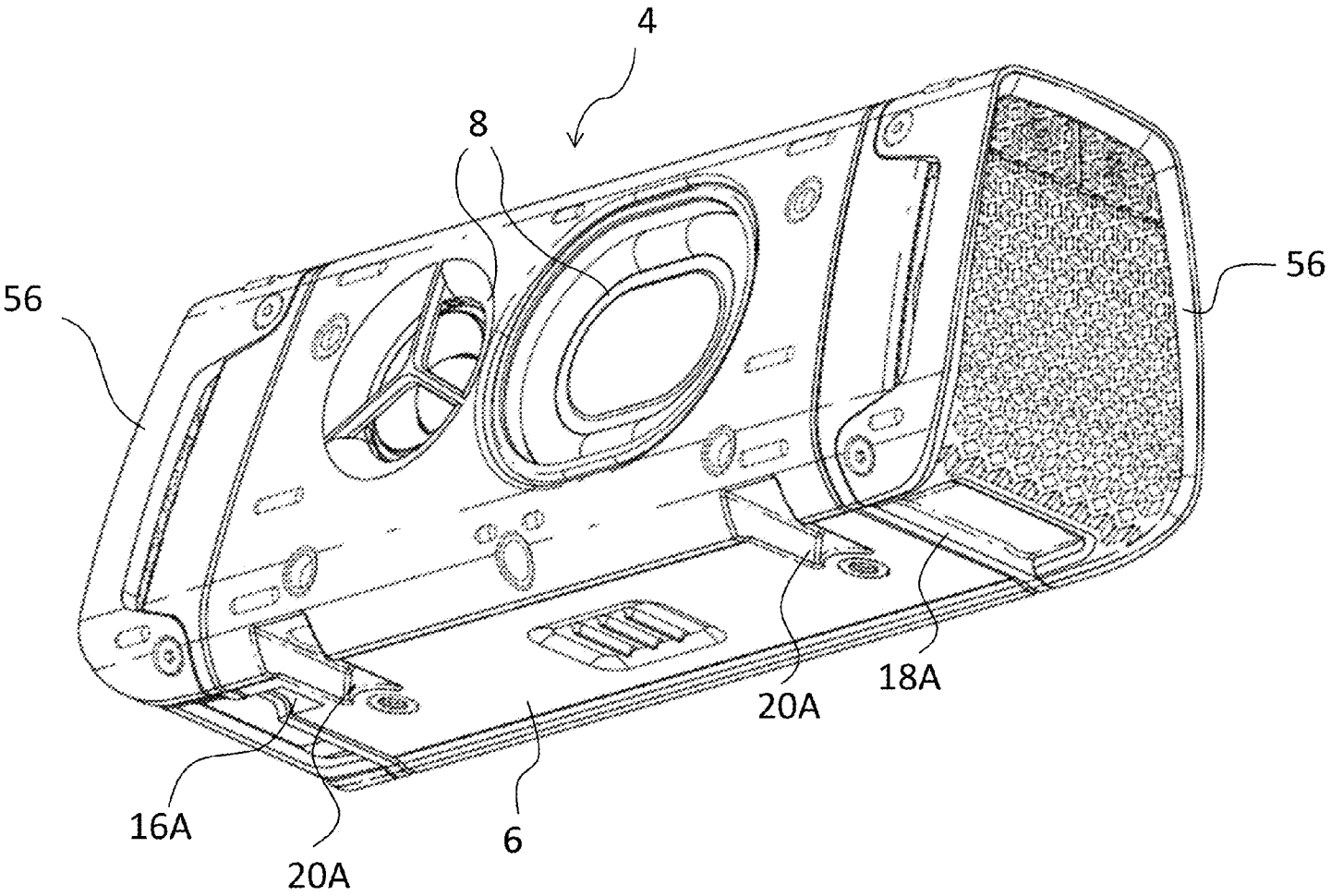
FIG. 16B shows a front, bottom and side perspective view of the speaker core of FIG. 16A.
Figure 17:
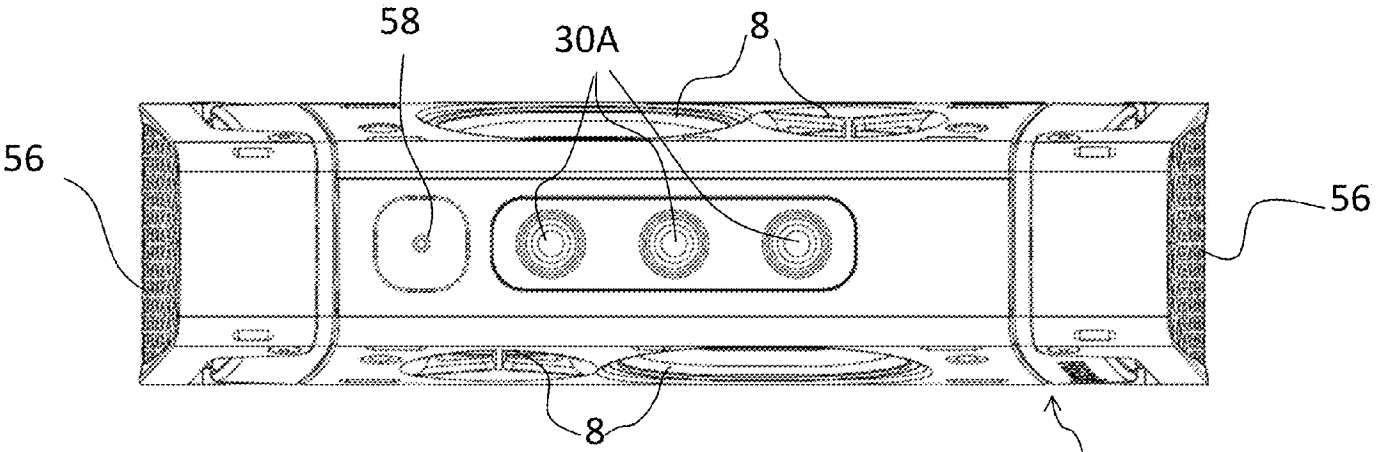
FIG. 17 is a top view of the speaker core of FIG. 16A.

Looking at FIGS. 16A and 17, the speaker core 4 may also have a microphone 58. When the speaker system is connected to a cell phone, the speaker system 10 can serve as a speaker phone with both a microphone 58 and speaker(s) 8. In some embodiments the speaker core 4 can be a compact Bluetooth speaker that has a built-in rechargeable battery and speakerphone capabilities.

Figure 21:
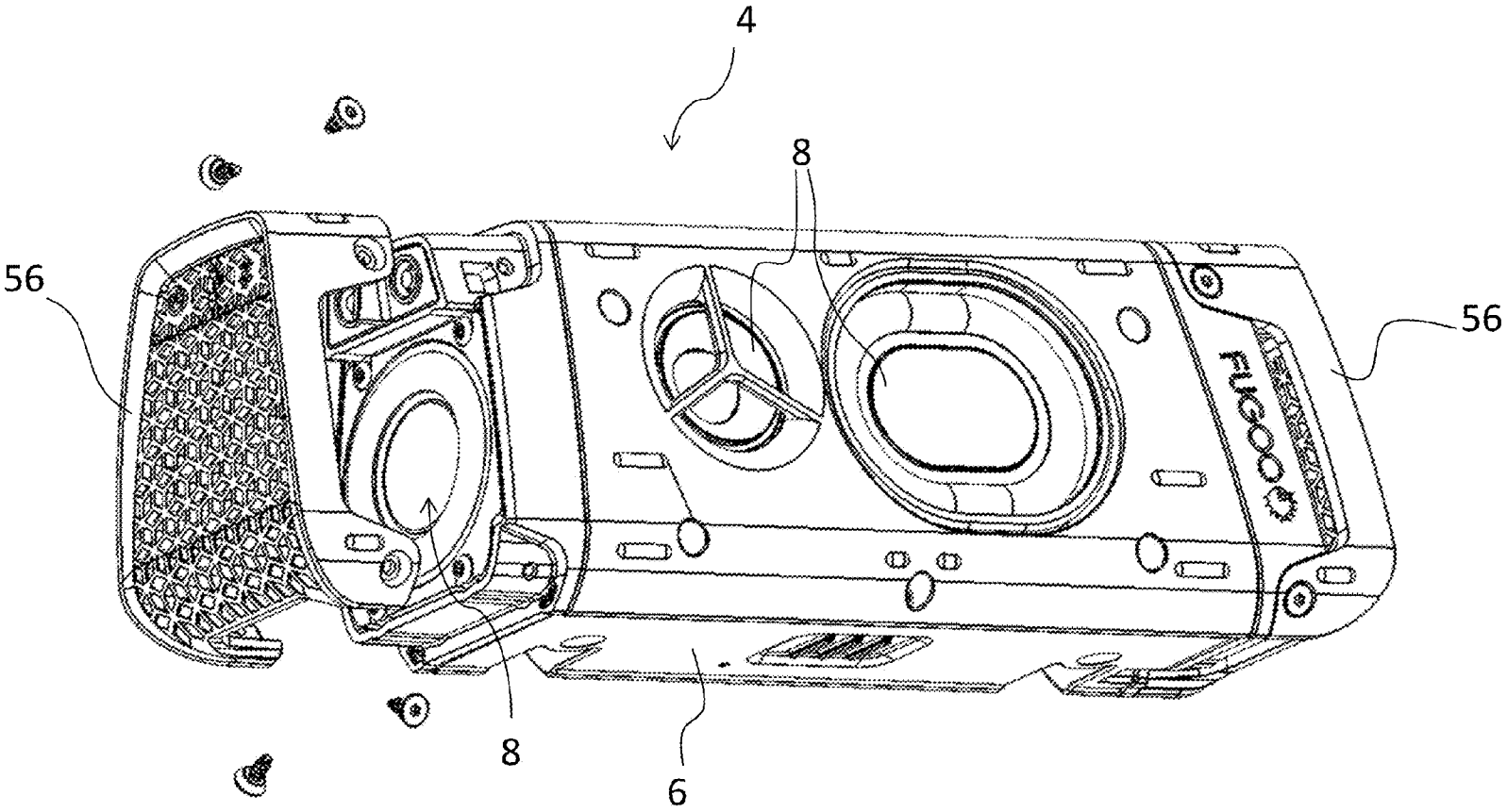
FIG. 21 shows a partially disassembled speaker core.

In addition to using a separate jacket 2, the housing 6 may further include end caps 56 to cover speakers 8 on the ends of the speaker core 4 as best seen in FIG. 21. The end caps 56 can be rubberized to provide additional protection against shock and impacts. In some embodiments, the jacket 2 covers the speakers on the front and back of the speaker core, while the end caps 56 cover the speakers on the ends or right and left sides of the speaker core 4. In some embodiments, both the end caps and the jacket cover the speakers on the ends. In addition to a grill, the end caps are shown with large holes on their sides (the front and back of the speaker core). These large holes can allow sound to more easily radiate from the speakers 8 outwards and to the sides of the end cap (front and back of the speaker core). This can help to project 360 degrees of sound as explained in more detail below.

Figure 22:
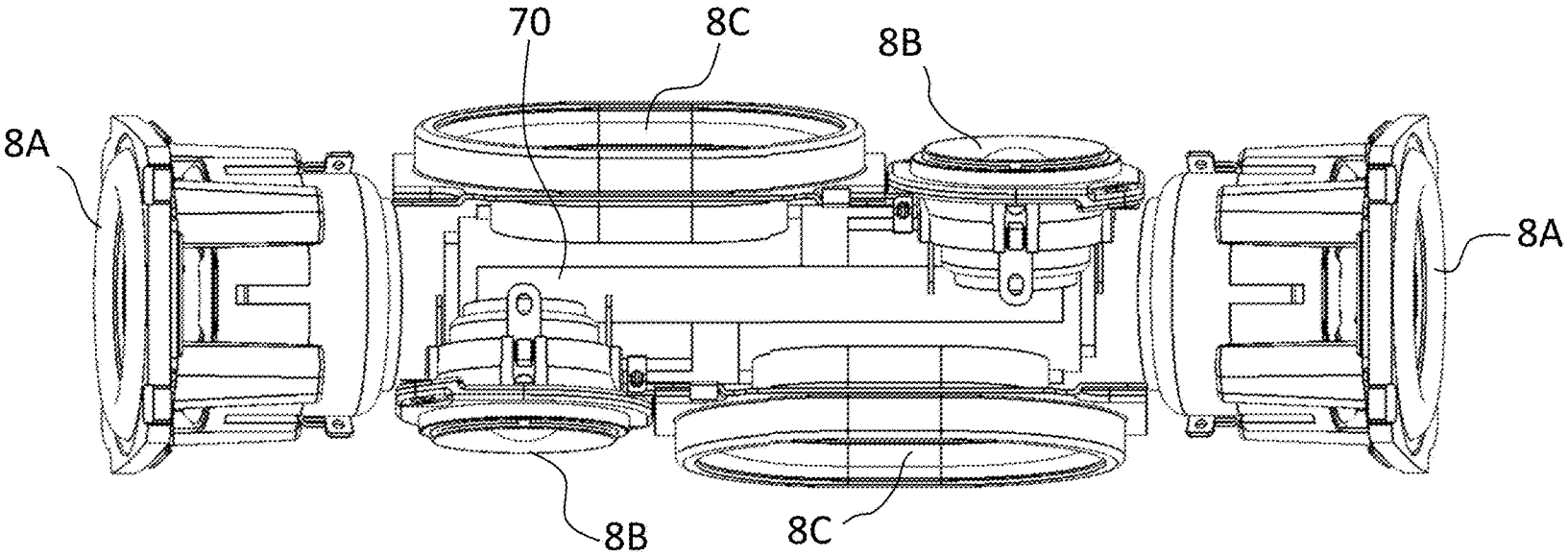
FIG. 22 illustrates the placement of certain components inside the speaker core.

As can be seen in FIG. 21, the speaker core 4 can include a number of speakers 8. The speakers can be similar or different. FIG. 22 shows a top down view of the placement of speakers 8A, 8B, 8C and battery 70 inside the speaker core 4 according to some embodiments. As shown, the speakers 8A on the ends of the core are mid-range speakers and the small speakers 8B on the front and back are a high-range speakers or tweeters. The larger speaker 8C on the front and back can be a low range speaker such as a subwoofer. The low range speaker 8C may be a passive radiator speaker. The mid-range speakers 8A can be the primary speakers for the speaker core. In the illustrated embodiment, the speaker core can project 360 degrees of sound with no sweet spot or dead spot.

In addition, by having the primary speakers 8A opposite each other in the speaker core, the speaker core can alleviate the common problem of "walking" experienced by many small portable Bluetooth speaker systems. In these other systems, when the volume is increased, the vibration of the speakers can cause the speaker system to rattle and "walk." The primary speakers 8A balance each other out. In addition, the illustrated arrangement of a tweeter 8B and a passive low range speaker 8C on the front and a mirror image on the back also acts to counter balance the system to prevent walking.

FIGS. 25A-E show another embodiment of speaker core 400. In this embodiment, the front and back sides are both symmetrical and mirror each other. Thus, the three speakers on the front are paired with three speakers on the back. This can further help reduce walking and undesired vibration.

Speaker pairs can be placed symmetrically or substantially symmetrically on the sides of the housing 6. In some embodiments, the speaker system 10 does not produce substantially any vibration or produces low vibration even while playing back audio at high sound intensity (e.g., high volume). This can be achieved due to using a small number of speakers, and arranging the speakers in the enclosure as described above. Placing speakers of similar type in opposing orientations, such as on opposing sides facing in different directions, can limit or reduce overall vibration of the speaker system 10 because forces generated by opposing speakers are generally equal and opposite and tend to cancel. For example, substantially no vibration or low vibration can be achieved by symmetrical or substantially symmetrical arrangement of various pairs of speakers, such as primary speaker pairs, low frequency speaker pairs, tweeter pairs, etc. Reducing vibration can prevent undesired movement of the speaker system 10 due to vibration, improve user experience, etc.

Figure 23:
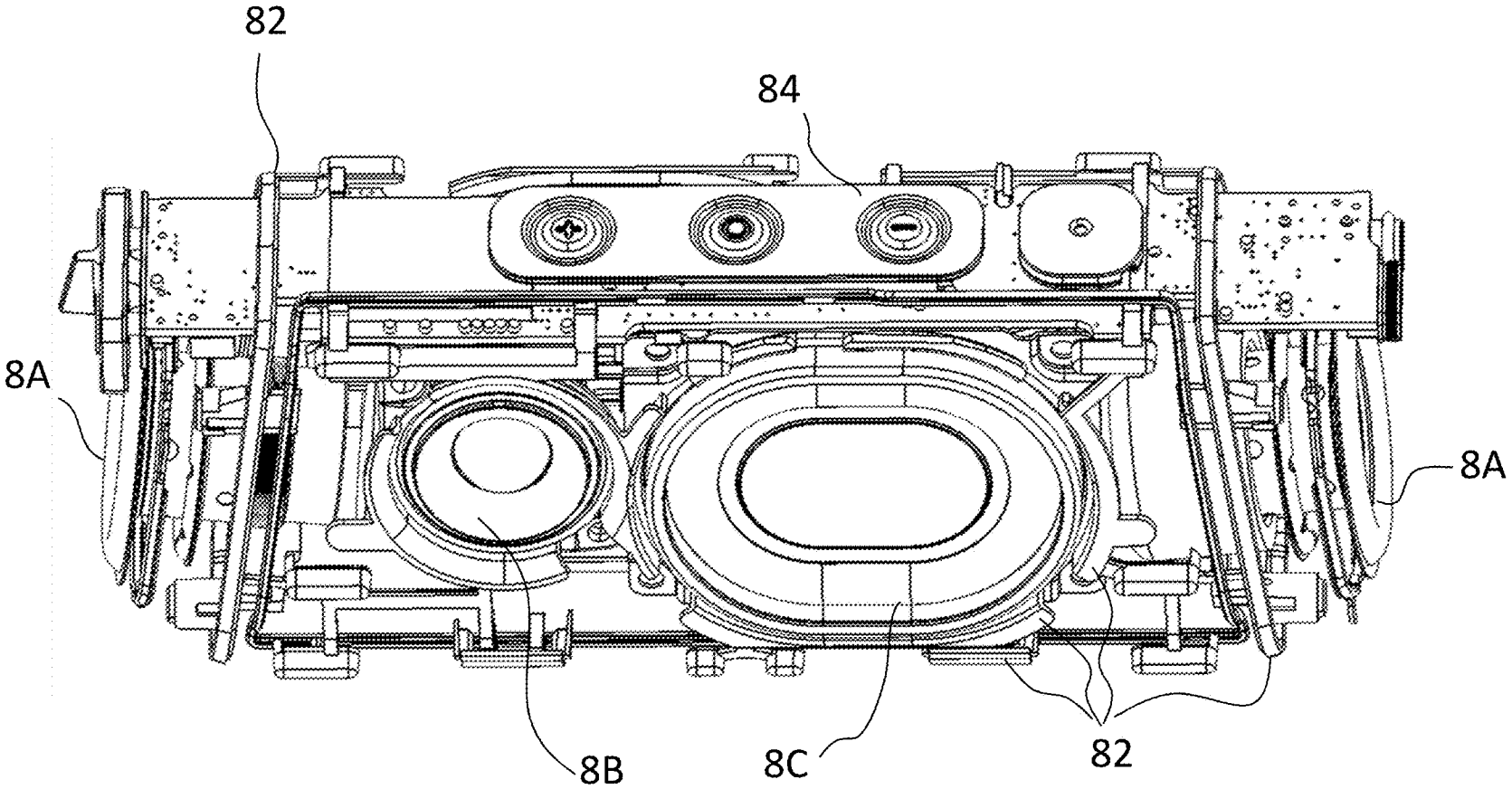
FIGS. 23 and 24 show certain components inside the speaker core.
Figure 24:
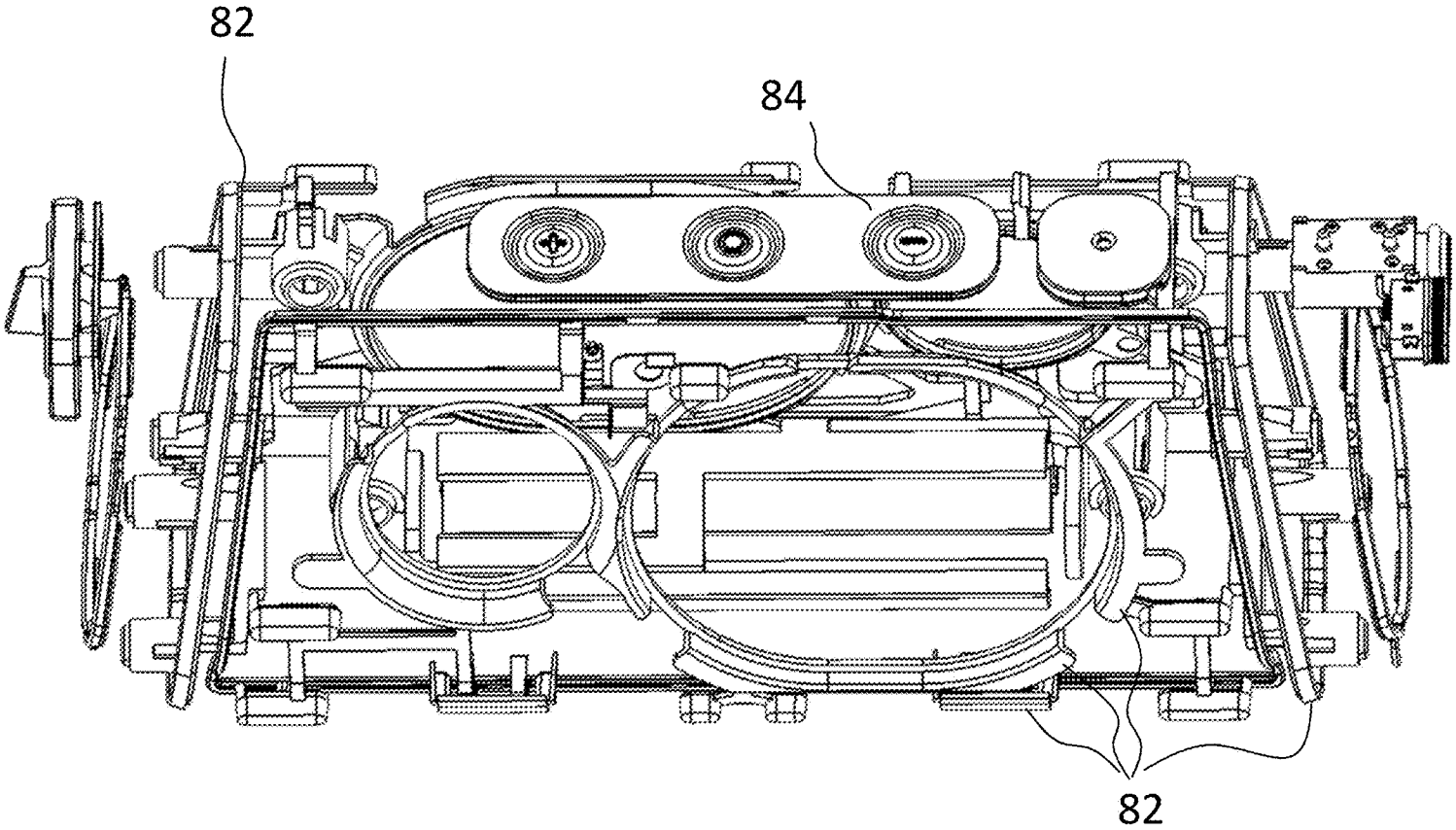

Turning now to FIGS. 23 and 24, certain additional internal components of the speaker core 4 are shown. In these views, the main housing has been removed, but a more elastic material 82 is shown that in reality is co-molded with the housing 6 and so does not generally exist in a standalone form as illustrated. The elastic material 82 can be thermoplastic polyurethane (TPU) or other elastic material. The elastic material 82 can be used to seal the housing internally for both acoustics and water-proofing. In addition, the elastic material can provide padding to isolate certain of the internal components of the speaker core. For example, the speakers and battery can be mounted or suspended by the elastic material 82. The elastic material 82 can provide just enough damping to reduce vibrations while not adversely affecting sound quality or vibration of the speaker itself. It can also isolate the speakers and certain other components from one another.

In some embodiments, all of the major components of the speaker core are mounted or suspended by the elastic material 82 and are therefore isolated from each other. For example, all of the speakers and the battery can be mounted or suspended by the elastic material 82 within the speaker core. FIG. 24 shows most all of the components remove except for the elastic material 82 and other materials used for sealing and/or damping.

In addition to the elastic material 82 providing acoustic benefits, it can also seal the housing to be waterproof. Other seals can also be used to ensure that the speaker core 4 is water proof. For example, a seal 84 can be placed around the buttons that allows mechanical inputs to be transferred through the seal. Also any connects, such as the microUSB connector and the audio connector can be waterproofed to not allow water into the speaker core.

Figure 18:
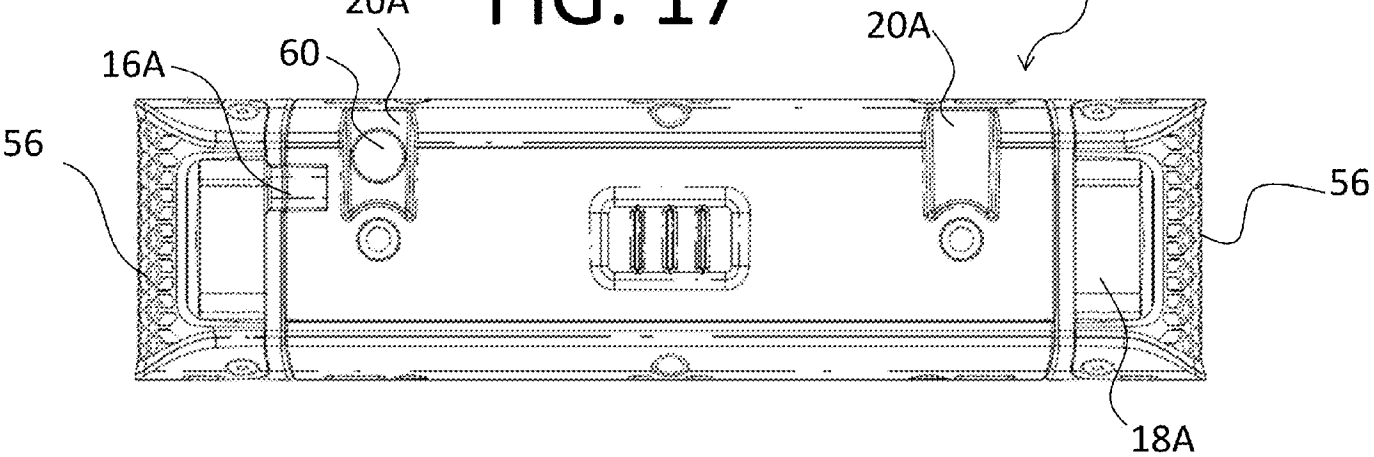
FIG. 18 is a bottom view of the speaker core of FIG. 16A.

Additionally, an atmospheric valve 60 as best seen in FIG. 18 may also be provided. The atmospheric valve 60 is a pressure relief valve that equalizes the air pressure within the housing 6, so air can pass through, but it does not let water in. As shown, the atmospheric valve 60 is mounted in a recess in the housing 6, within notch 20A. In this way, the atmospheric valve 60 can be protected from damage.

As has been mentioned, some of the jackets can include drainage holes and or channels to allow for fluid or debris to be drained from between the jacket and speaker core. The speaker core itself can also include self-draining features. For example, waterproofing of the speaker core and the having a shape with slightly angled sides can also facilitate usage of the system in wet environments. In the embodiments shown herein all of the surfaces are designed such that no water should get trapped in any cavities. For example, in some embodiments the side walls of the housing can be about 3, 5, 8, 10, 12, and 15 degrees from vertical. The angled sides can allow for self-draining while preventing pooling, even at the speakers. In addition, the large holes at the bottoms of the end caps 56 can also facilitate drainage.

In the illustrated embodiment, the speaker driver 8B is a tweeter having a diameter D of about 1.1 inches (approximately 28 mm). In various embodiments, the diameter D of the speaker driver 8B is at least about 0.5 inches, at least about 0.75 inches, or at least about 1 inch. In some embodiments, the diameter of the speaker driver 8B can be smaller than 0.5 inches or greater than about 1.1 inches. The depth of the speaker driver 8B can be selected to correspond to the depth of the speaker core 4. For example, the depth of the speaker driver 8B can be less than about 1.7 inches. As another example, the depth of the speaker driver 8B can be less than about 4 inches.

In the illustrated embodiment, the speaker driver 8C is a passive radiator for generating relatively low frequency output and having a length L' of about 2.1 inches (approximately 54 mm) and a height H' of about 1.7 inches (approximately 43 mm). In various embodiments, the speaker driver 8C can have a length L' of greater than about 1.0 inches, greater than about 1.5 inches, or greater than about 1.75 inches long, and a height H' of greater than about 0.75 inches, greater than about 1.0 inches, or greater than about 1.5 inches. In some embodiments, the length L' of the speaker driver 8C can be smaller than about 1.0 inches or greater than about 2.1 inches and the height H' can be smaller than about 0.75 inches or greater than about 1.7 inches. In certain embodiments, for example, the speaker driver 8C can be about 4.0 inches long (approximately 101.2 mm) and about 2.4 inches high (approximately 61.2 mm). The depth of the speaker driver 8C can be selected to correspond to the depth of the speaker core 4. For example, the depth of the speaker driver 8C can be less than about 1.7 inches. As another example, the depth of the speaker driver 8C can be less than about 4 inches.

The speaker system 10 can be portable. In some embodiments, the length L of the speaker system 10 can be about 6.5 inches (approximately 165.2 mm). The depth or width W of the speaker system 10 can be about 1.7 inches (approximately 43.5 mm), and the height H of the speaker system 10 can be about 2.3 inches (about 58.8 mm). In certain embodiments, the speaker system 10 is less than about 12 inches long, less than about 4 inches wide, and less than about 5 inches tall. In some embodiments, the speaker system 10 can be longer or shorter than about 6.5 inches, wider or thinner than about 1.7 inches, and taller or shorter than about 2.3 inches. For example, the speaker system 10 can be about 11.2 inches long (approximately 284 mm), about 3.4 inches wide (approximately 85.7 mm), and about 3.9 inches tall (about 98.6 mm). In certain embodiments, the speaker system 10 is less than about 24 inches long, less than about 8 inches wide, and less than about 10 inches tall.

While maintaining portability, the speaker system 10 can also generate audio output having a desired fidelity and loudness in part by being large enough to support a speaker driver architecture capable of providing such fidelity and loudness. For instance, the speaker system 10 can be large enough to support an arrangement of speaker drivers such as is shown and described. Moreover, the speaker core 4 can be large enough such that the housing 6 defines an interior cavity having a sufficient volume to provide a desired acoustic affect. Along these lines, certain embodiments of the speaker system 10 are at least about 1 inch wide, at least about 4 inches long, and at least about 1.5 inches tall. In further embodiments, the speaker system 10 is at least about 0.75 inches wide, at least about 3.5 inches long, and at least about 1.0 inch tall. In yet additional embodiments, the speaker system 10 is at least about 1.5 inches wide, at least about 5 inches long, and at least about 2 inches tall.

In the illustrated embodiment, the speaker driver 8A is a full range driver or woofer having a diameter D' of about 1.5 inches (approximately 39 mm). In various embodiments, the diameter D' of the speaker driver 8A can be at least about 0.5 inches, at least about 0.75 inches, or at least about 1.0 inch. In some embodiments, the diameter D' of speaker driver 8A can be smaller than 0.5 inches or greater than about 1.5 inches. In certain embodiments, for example, the diameter D' of the speaker driver 8A can be about 2.4 inches (approximately 60 mm). The depth of the speaker driver 8A can be selected to correspond to the depth of the speaker core 4. For example, the depth of the speaker driver 8A can be less than about 1.7 inches. As another example, the depth of the speaker driver 8A can be less than about 4 inches.

Figure 5A:
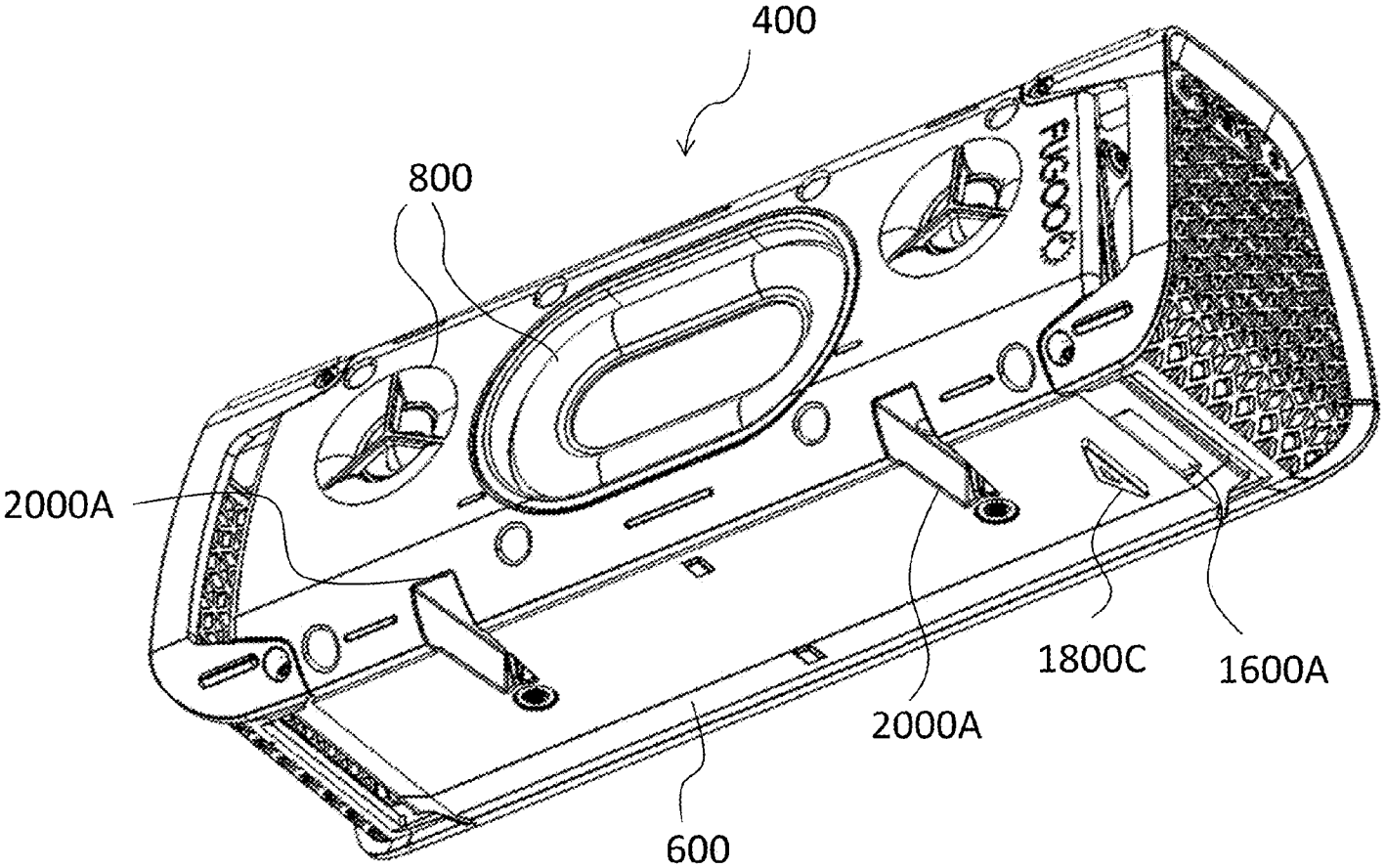
FIG. 5A depicts another embodiment of speaker core.
Figure 5B:
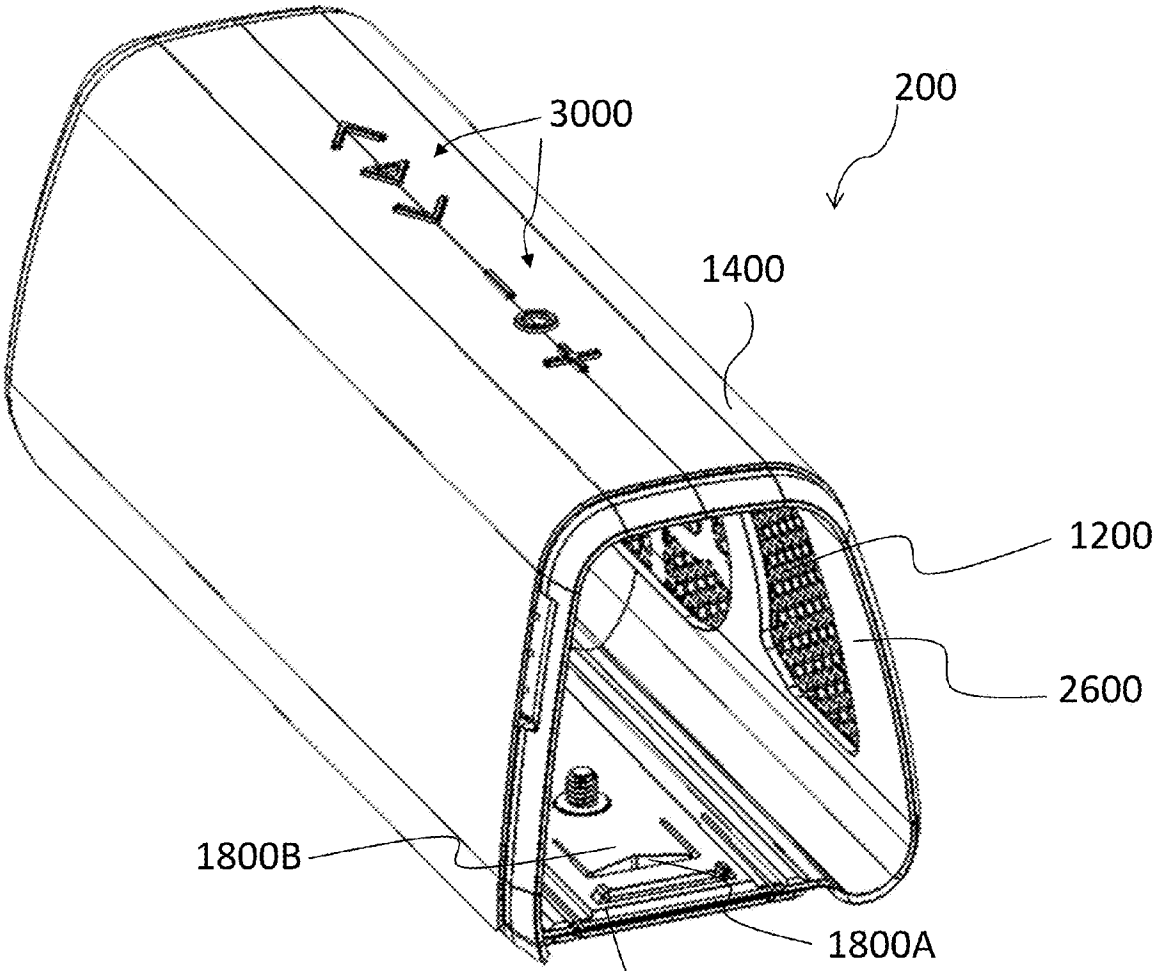
FIGS. 5B-D show another embodiment of jacket.
Figure 5C:
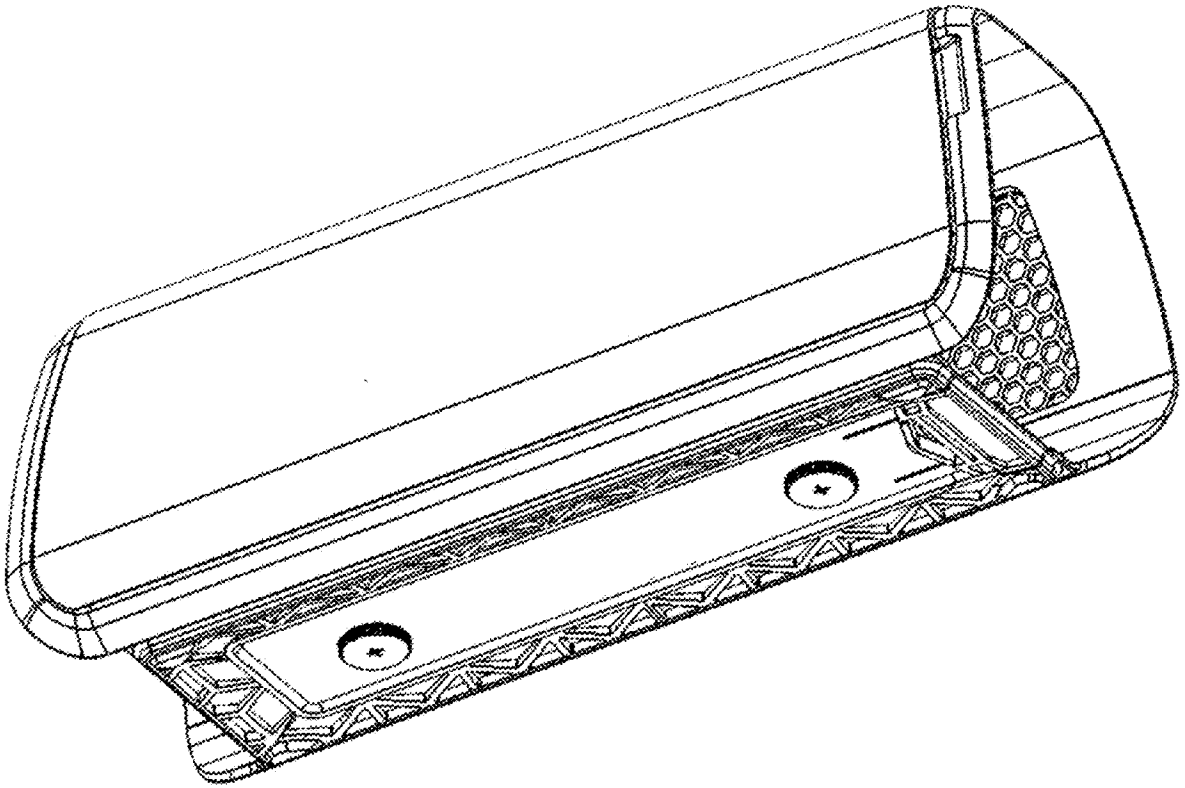
Figure 5D:
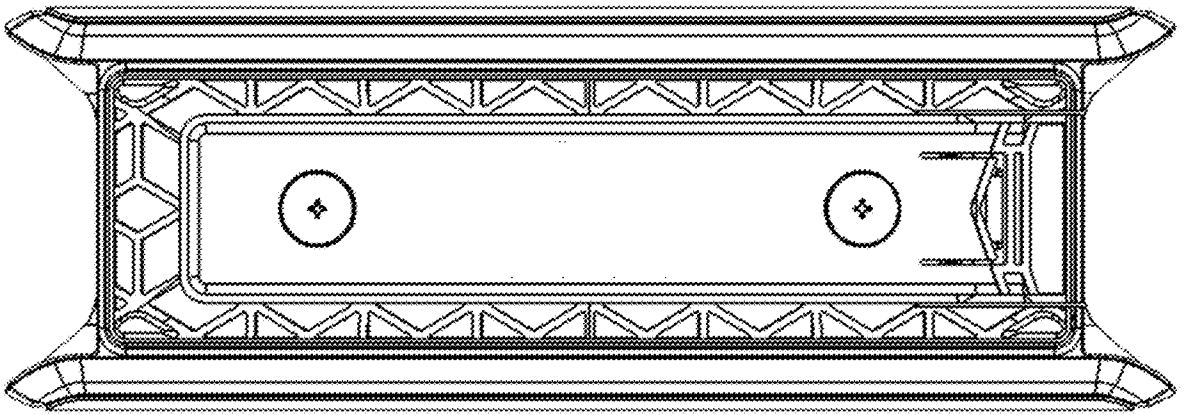

FIGS. 25A-D show additional views of the speaker core 400 of FIG. 5A. It will be understood that the speaker core 400 will be larger than the speaker core 4 at least because of the presence of additional speakers.

Figure 25A:
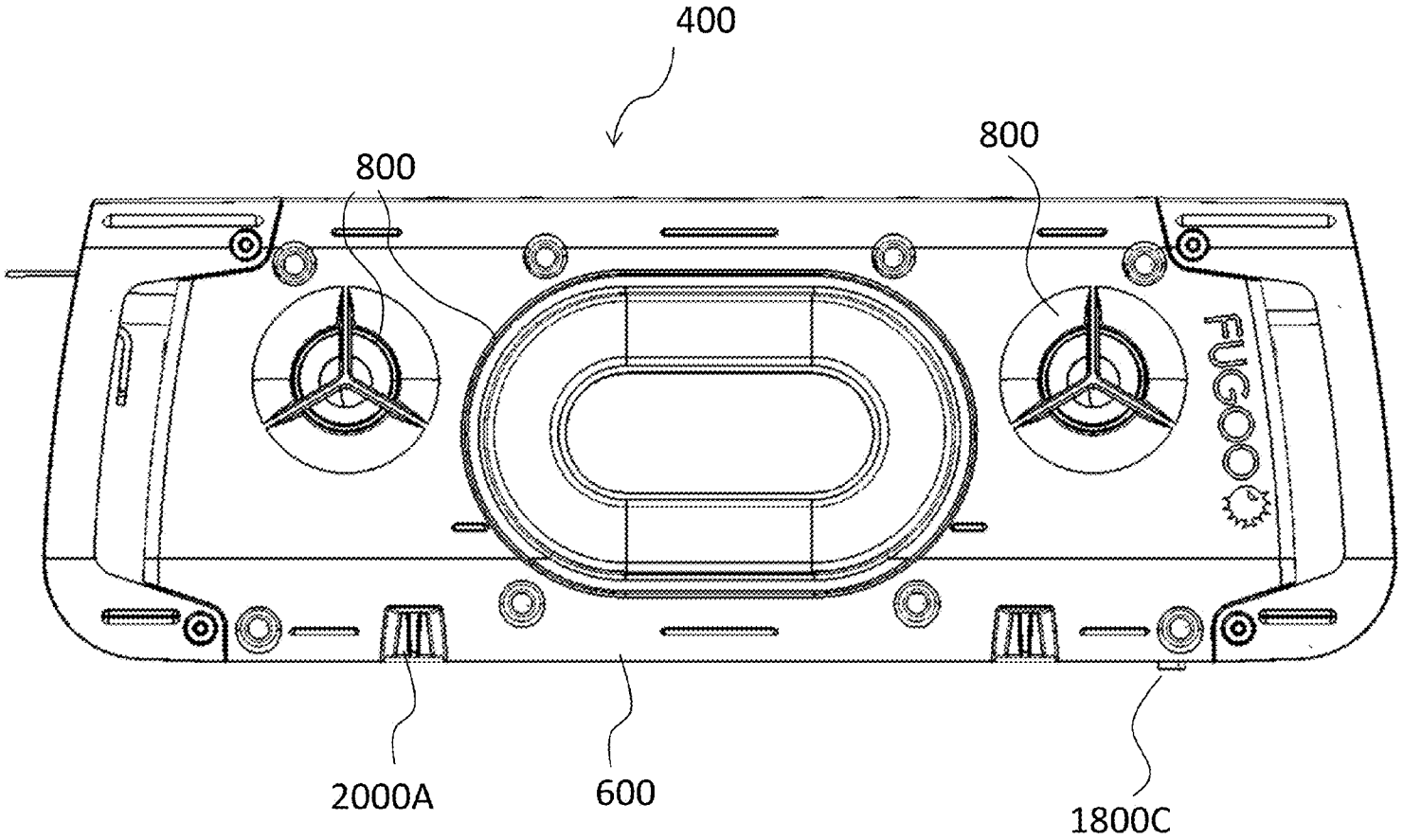
FIG. 25A is a front view of the speaker core of FIG. 5A, the back view being a mirror image minus the notches 2000A.
Figure 25B:
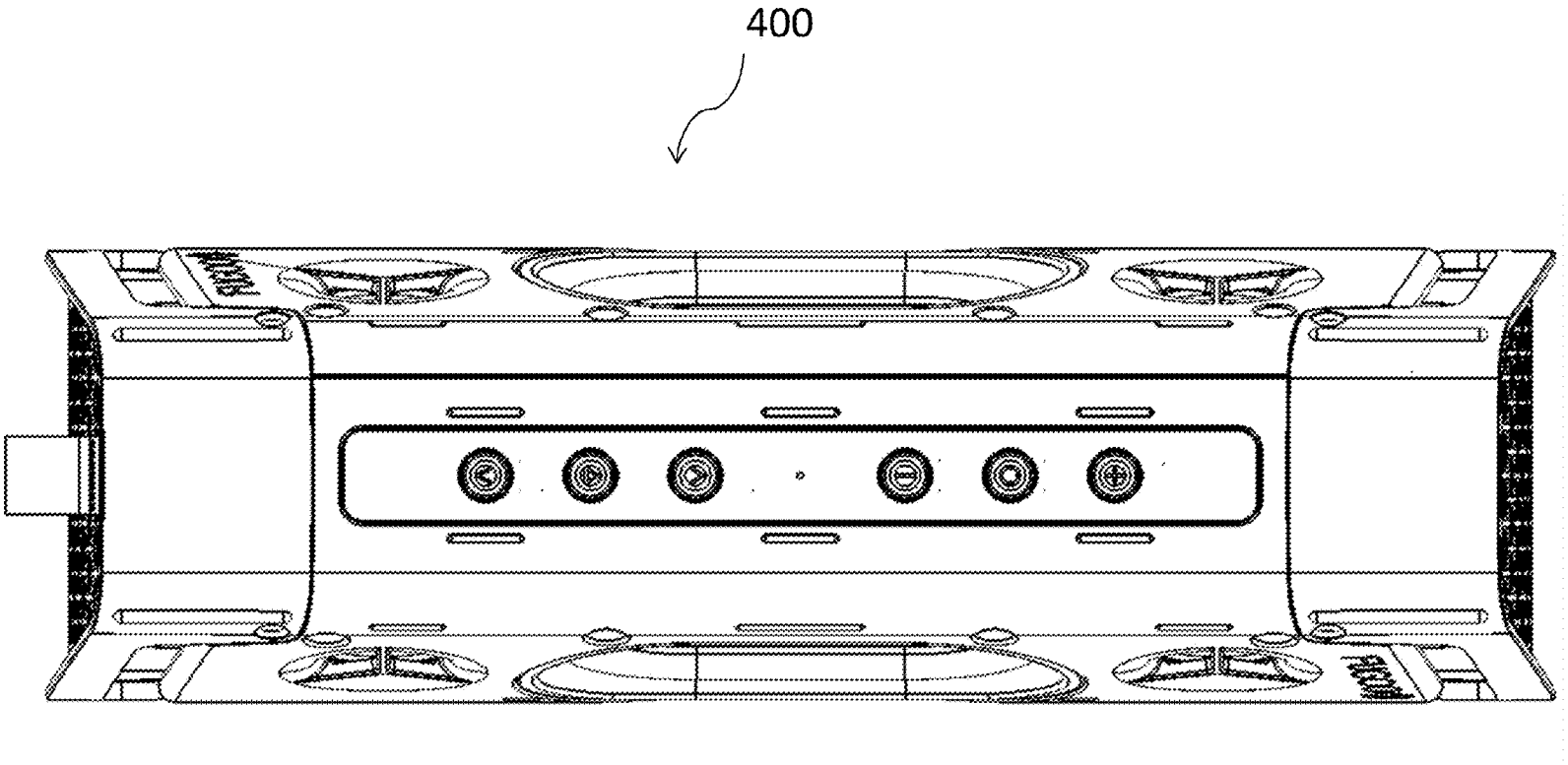
FIG. 25B is a top view of the speaker core of FIG. 25A.
Figure 25C:
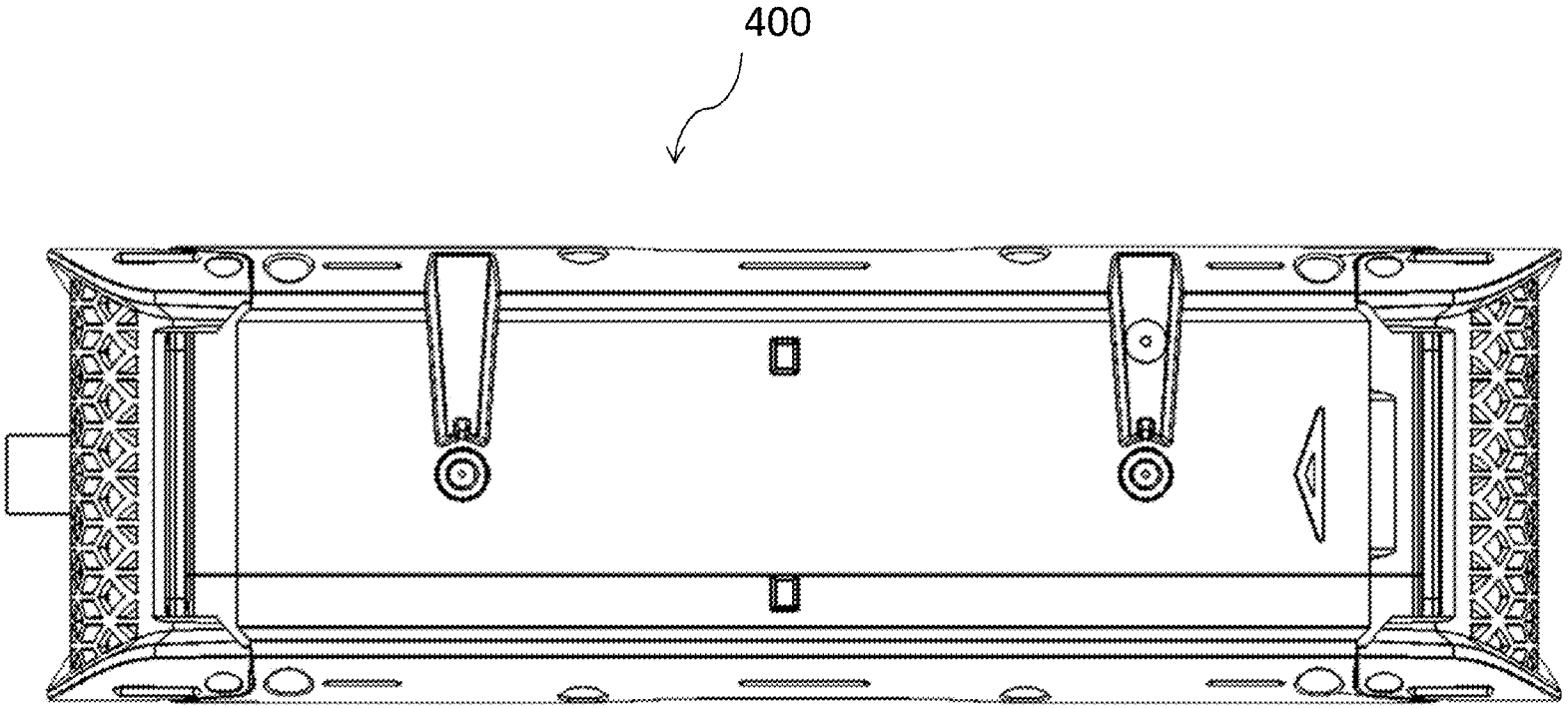
FIG. 25C is a bottom view of the speaker core of FIG. 25A.
Figures 25D, 25E, 25F:
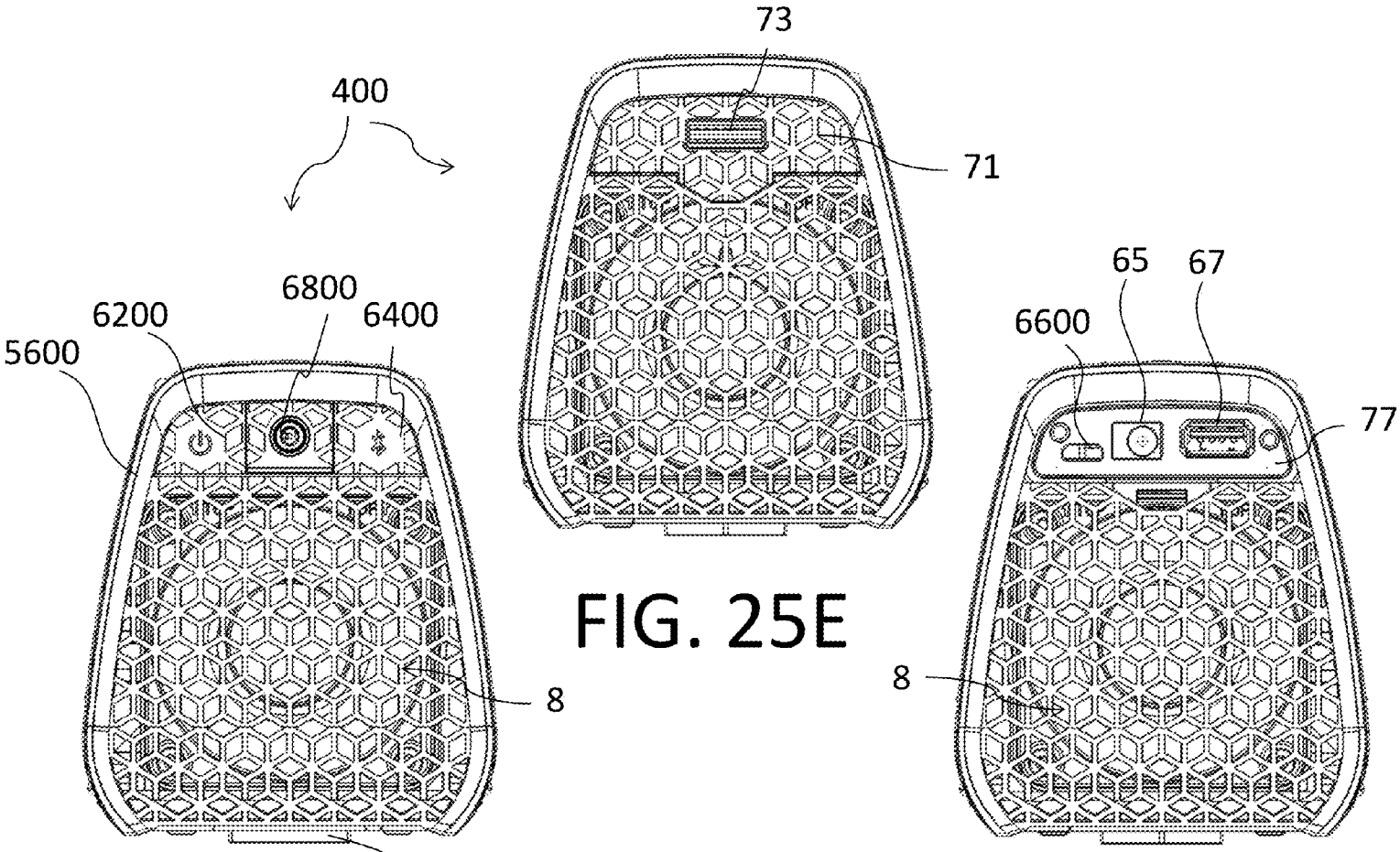
FIGS. 25D-E show respective first and second side views of the speaker core of FIG. 25A.
FIG. 25F illustrates the side view of the speaker core of FIG. 25E with a door and pull tab removed to show various connectors.
Figure 25H:
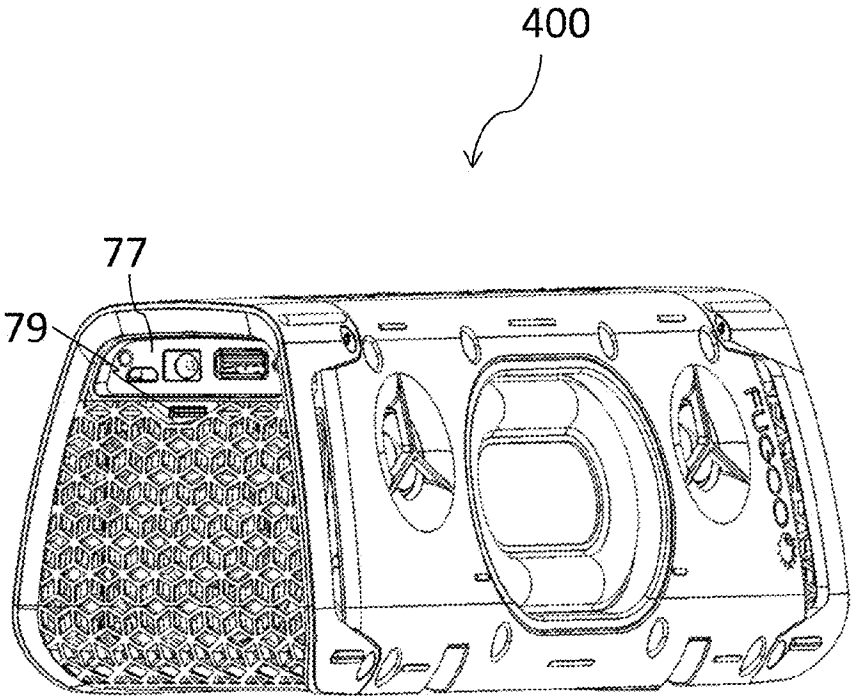
FIG. 25H is a perspective view of the speaker core with the door and pull tab removed.

In the embodiment of FIGS. 25A-D, the front and back sides are both symmetrical and mirror each other. Thus, the three speakers on the front are paired with three speakers on the back. FIG. 25F illustrates the side view of the speaker core of FIG. 25E with a door 71 and pull tab 73 removed to show various connectors 6600, 65, 67. FIG. 25D shows a Bluetooth button 6400 on the speaker core for syncing the speaker system with another Bluetooth device. The speaker core may include an auxiliary input 6800 for plugging in audio devices, such as those that are not Bluetooth-enabled. A power button 6200 and a microUSB connector 6600 are also shown. The speaker core 4 may include a built-in rechargeable battery that can be powered through the microUSB. The speaker core may also require an external power source; connector 65 can provide such a connection. In addition, a USB 67 is also shown. The USB 67 can be used to power other devices, among other uses. Each of the buttons and connectors can also be on a jacket for attachment to the speaker core.

Figure 25G:
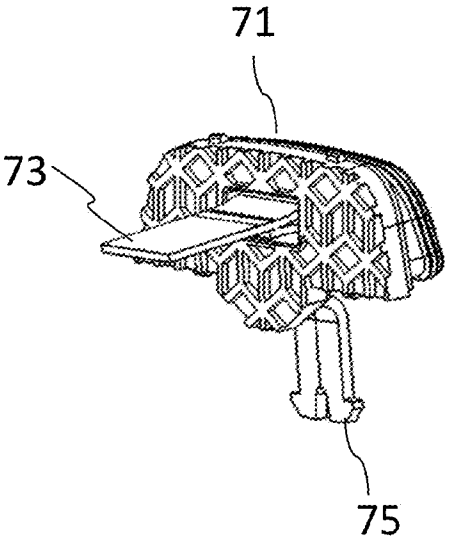
FIG. 25G shows the door and pull tab.

FIG. 25G shows the door 71 and pull tab 73 in more detail. In addition, an arm 75 is also shown. In some embodiments, the arm and a seal can be over molded onto the door 71. Thus, the arm can be flexible to allow easy movement of the door while helping the door stay connected to the speaker core. The arm 75 can be connected to a hole 79 on the speaker core. The door can be tethered to the housing through the arm. The door 71 can provide access to a chamber 77. The chamber 77 can provide one or more connectors. The connectors can be waterproofed and the door can provide additional waterproofing. In some embodiments, the connectors are not waterproofed, or are waterproofed less than the door, so that the door can provide additional protection to the connectors.

Looking now to FIG. 26, a cross-section of the speaker core 400 is shown. In this view, the side chamber 77 can be seen, as well as a main chamber 81 and a second side chamber 83. In some embodiments, a speaker core can include two or more separate chambers. Each chamber can be sealed or isolated with respect to the other with the exception of certain wires or other components that may pass between the chambers. For example, the wire can include a seal, or the wire may pass through a hole between the chambers, which is only slightly larger than the wire without being completely sealed.

The main chamber 81 can house the majority of the electronics, batteries, speakers, etc. The side chamber(s) can house certain electronic connectors, buttons, or other components. Wires can extend between two or more of the chambers. The chamber(s) may include access doors, such as door 71. The access door can also include a seal to help seal the chamber.

Figure 26A:
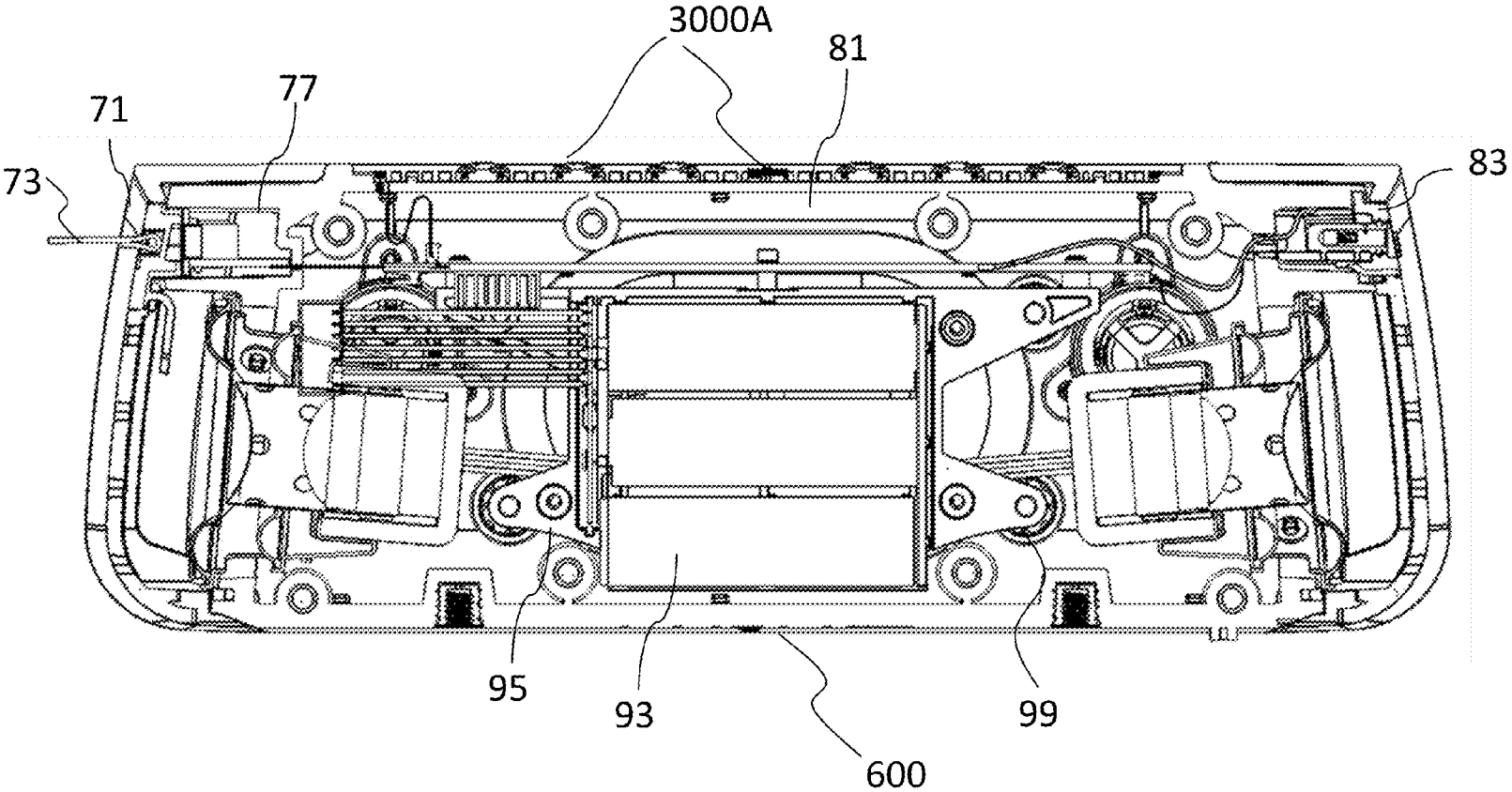
FIG. 26A is a cross-section of the speaker core.

In addition, FIG. 26A also illustrates that the electronics can be separated to help isolate the components from the housing, especially from vibrations experienced by the housing. Certain of the connectors/buttons can be connected to the housing, while other electronics, on other boards can be separate.

Figure 26B:
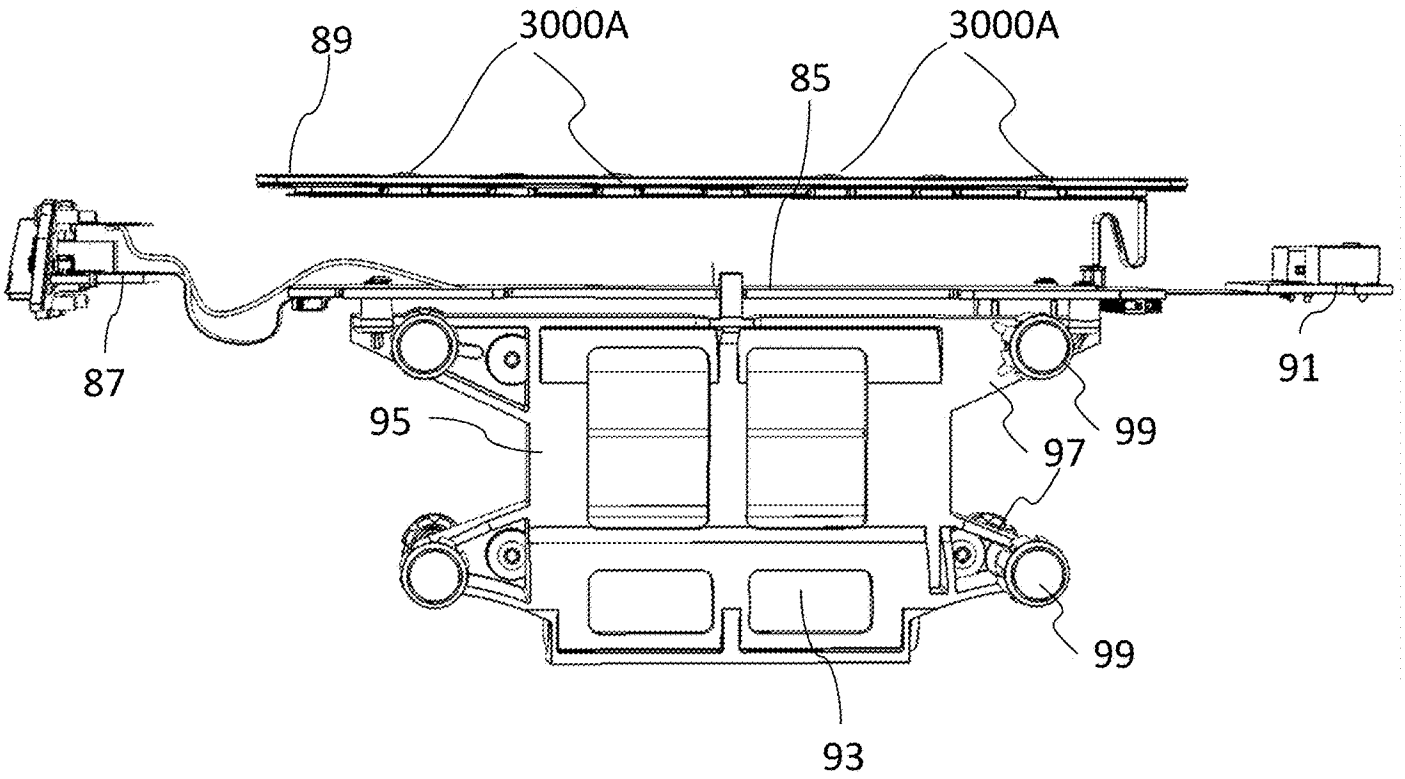
FIG. 26B-C shows certain internal components of the speaker core.
Figure 26C:
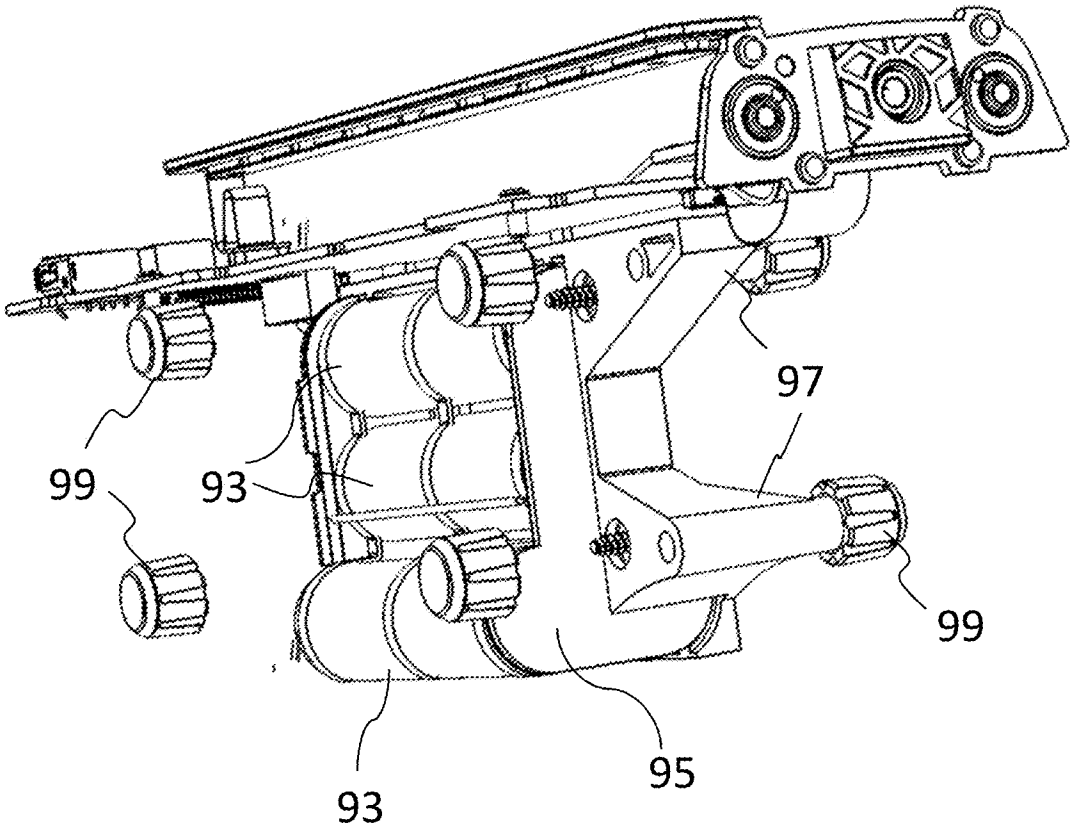

Looking at FIGS. 26B-C it can be seen that a printed circuit board (PCB) has been divided between a main board 85, and three daughter boards 87, 89, 91. The buttons and connectors are on the daughter boards which are directly connected to the housing, while the main board is only connected to the daughter board via wires. Thus, the battery 93, and main PCB 85 can be isolated from the housing 600.

The battery 93 and main PCB 85 can be further isolated from the housing through the use of shock absorbers 99. A frame 95 can be used to attach the battery 93 and the main PCB 85. Shock absorbers 99 can connect the frame to the housing 600. The shock absorbers 99 can be rubber stoppers connected to a frame. This can allow the frame and connected parts to be suspended by the shock absorbers not directly contacting any other part of the housing except through the shock absorbers.

The frame 95 can surround the battery 93 and the main PCB 85 can be mounted to the frame 95. The frame 95 can have four arms 97 with rubberized ends 99 which can connect to the housing 600. The four arms 97 can be connected to the front and back sides of the housing. The arms 97 can be connected to points of the housing 600 surrounding the passive speakers. The arms 97 can be not connected to the top or bottom of the housing. The arms 97 can further not be connected to the sides of the housing. Other connection positions or orientations can also be used.

Where an electrical connector is directly connected to the housing and to the main PCB board, the main PCB board, even if otherwise isolated and shock mounted, can still be subject to the vibrations of the housing through the direct mount of the electrical connector. As discussed above, the illustrated system can beneficially isolate certain components from the vibrations of the housing. In addition, the use of separate chambers and separate PCB boards and/or components in the separate internal chambers can also beneficially allow for certain parts of the housing to be treated differently, such as for waterproofing.

Accessories

Figure 27A:
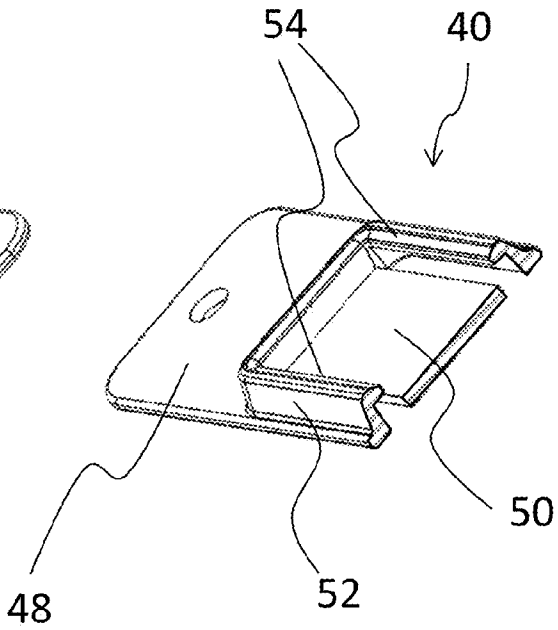
FIG. 27A shows a cross-sectional view of the accessory mounting plate of FIG. 27.
Figure 27:
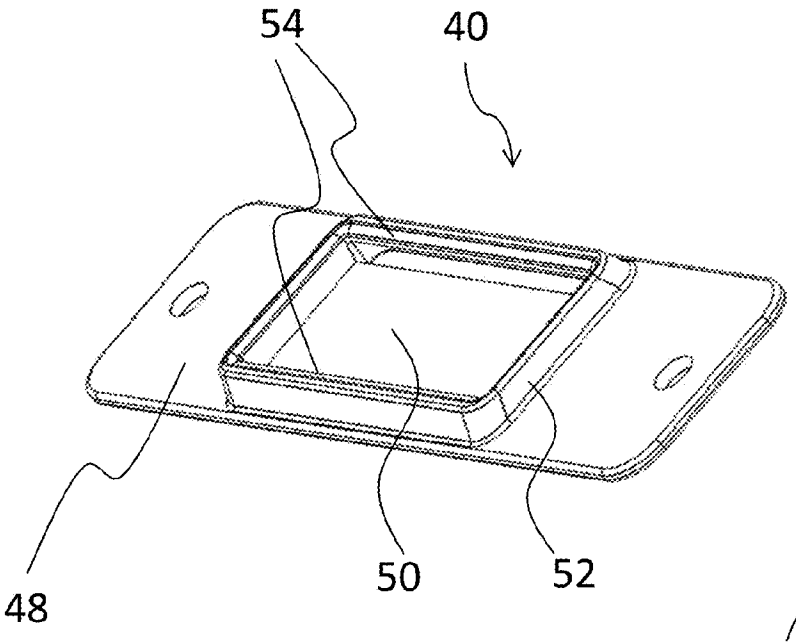
FIG. 27 is a perspective view of an accessory mounting plate.

As has been mentioned, a speaker system may include an accessary mounting plate 40. It will be understood that the accessary mounting plate and the accessories described below can be used for different types of speaker systems and different types of devices, including but not limited to cameras, GPS, cell phones, tablets, and bicycle computers. FIGS. 27 and 27A show an accessary mounting plate 40. Reference can be made to FIGS. 12-14 for a description of how an accessary mounting plate 40 can be connected to a jacket 2 or speaker core 4. The accessary mounting plate 40 can be used to attach accessories to the speaker system. The accessories can include any number of devices and systems such as a tripod or tripod mount, a bicycle mount, a clip, a carabineer, a strap, etc.

Still referring to FIGS. 27-27A, the accessary mounting plate 40 can include a base 48 and a receiving area 50. The receiving area 50 can be configured to receive an accessory. The receiving area 50 can comprise a slot, or opening configured to receive a portion of an accessory. Thus, the receiving area 50 can have surrounding wall 52. In some embodiments, the receiving area 50 can also include a lip or flange or other surface 54 that may extend from the wall 52. The receiving area 50 as illustrated has a raised wall 52 with an inwardly protruding lip or flange 54. An accessory can be received into the receiving area 50 and then can be locked in place. This can be done in many ways, such as by trapping a portion of the accessory between the base 48 and the lip 54 and/or expanding a member against the wall 52. Other attachment mechanisms or systems can also be employed.

Figure 28A:
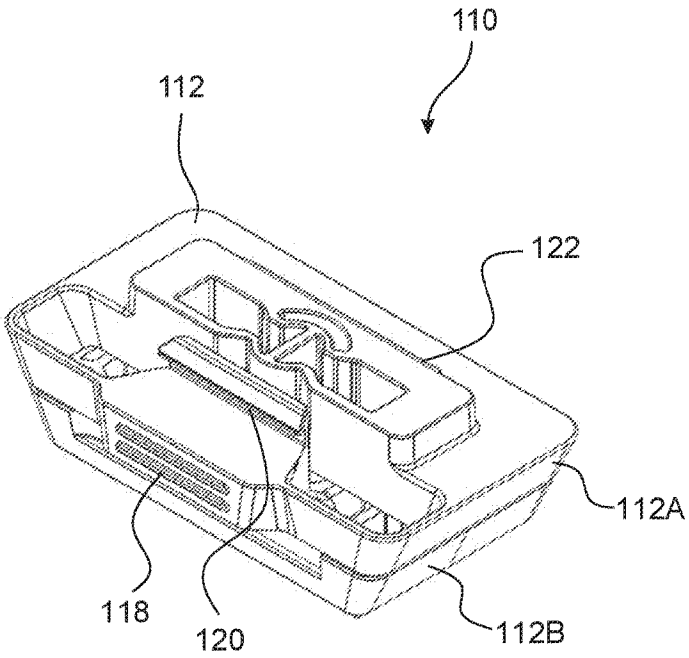
FIGS. 28-30 illustrate a mount in different positions and orientations.
Figure 28:
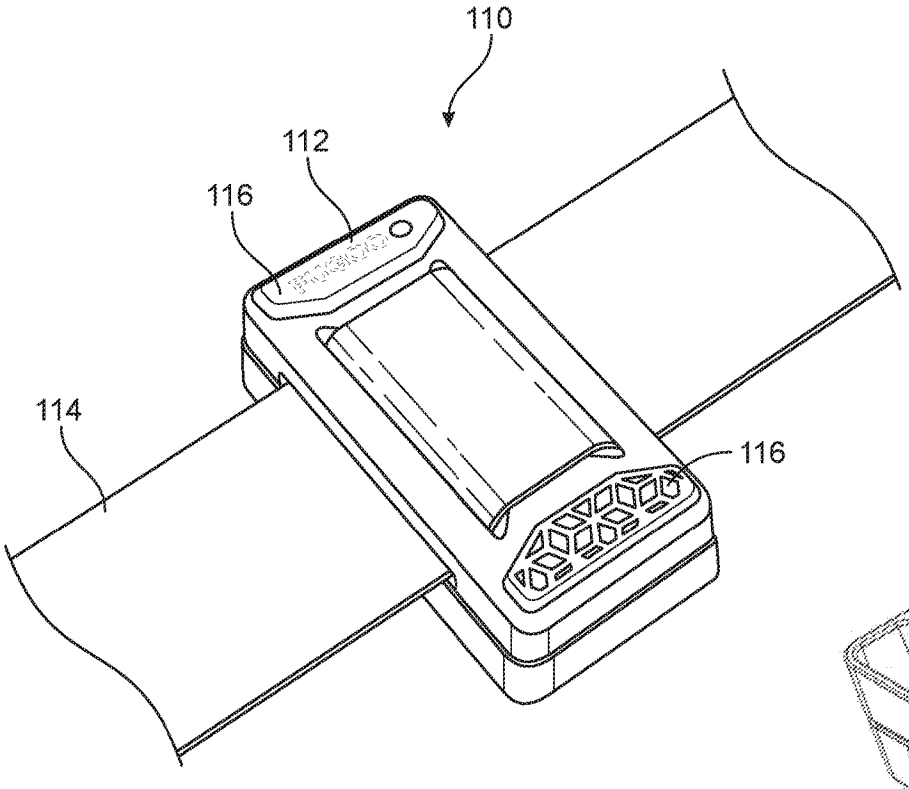
Figure 30:
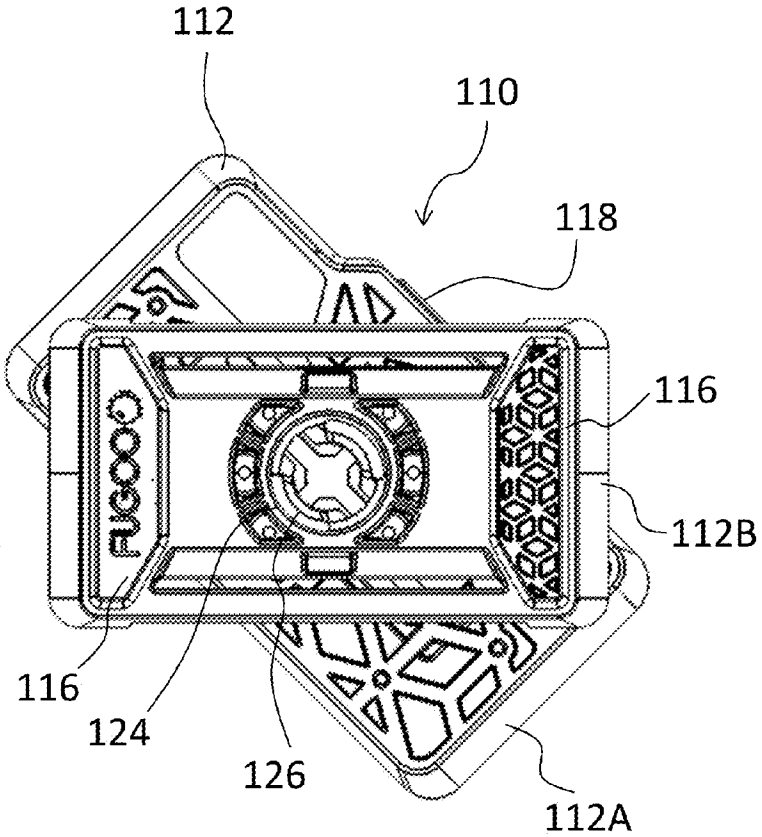
Figure 29:
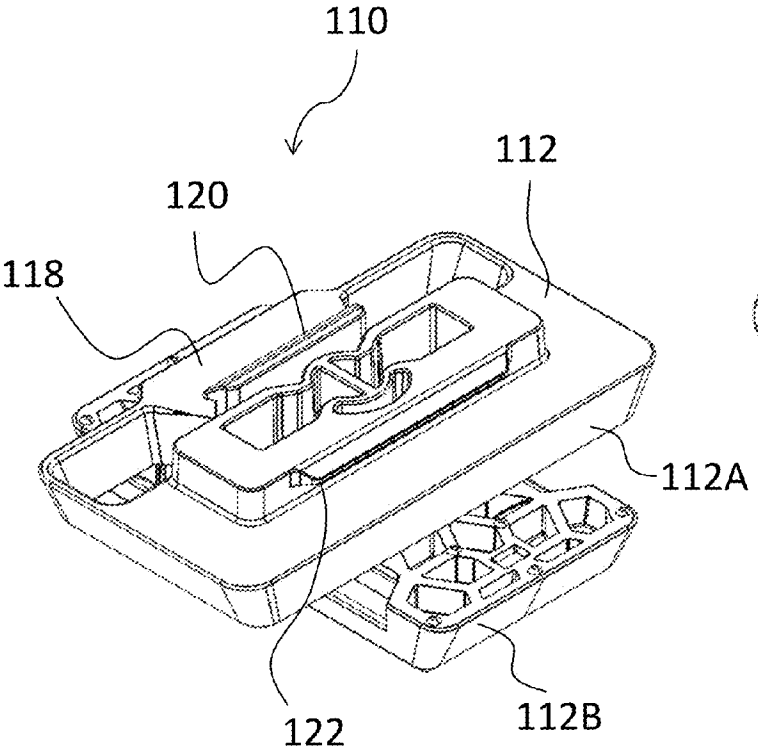

Turning now to FIGS. 28-30, a mount 110 is shown. The mount 110 can include a mounting body 112 used to attach the mount 110 to the accessary mounting plate 40. The mount 110 can also be used to attach the system to some other object. In its most basic form, the mount can attach to the accessary mounting plate 40 at one end and provide an additional surface to mount to another object. The surface can be a flat surface without additional features, such as to apply double-sided tape, or it can be a more complex surface or structure. In some embodiments, the mount 110 may controllably rotate or pivot.

The mounting body can include a pair of mount flanges 120, 122 that can be advanced into the receiving area 50 of the accessary mounting plate 40. The mount flanges 120, 12 can be positioned between the base 48 and the lip 54 to lock the mount 110 in place in the accessary mounting plate 40 (see FIG. 27A).

As best seen in FIG. 28A, the mounting body 112 can also include a button 118. The button can control the position of one or more of the mount flanges 120, 122. Thus, the button can be used to facilitate the connection and release of the mount 110 to the accessary mounting plate 40. As shown, the mount flange 120 is configured to move with the button 118 with respect to the mount flange 122. As also shown, the button 118 is a compliant mechanism, where the thinness of the material surrounding the button allows the button to deflect when pressed. Among other benefits, using compliant mechanisms reduces the part count for the button and the mount. It will be understood that other types of buttons can also be used.

In some embodiments, the mounting body 112 may include one or more feet 116 (two shown). The feet 116 can provide additional grip to secure the system in place.

In some embodiments, the mount 110 can also include a strap 114. The strap 114 can pass through the mounting body 112 and be used to attach the system to a pole, post, fence, chair, tree, backpack, bicycle, or another desired object. The strap 114 can include Velcro or other connecting system to connect the ends of the strap. The strap 114 can pass through one or more slots in the mounting body 112.

In some embodiments the mounting body 112 can be a two-piece body 112A-B. The mounting body may controllably rotate or pivot. The mounting body 112 can be seen in rotated positions in FIGS. 29 and 30. In both cases the first part 112A is rotated with respect to the second part 112B of the mounting body. FIG. 30 shows a pin 126 and hole 124 that connect to allow for rotation. The pin 126 can form a snapfit connection with the hole.

Figure 31:
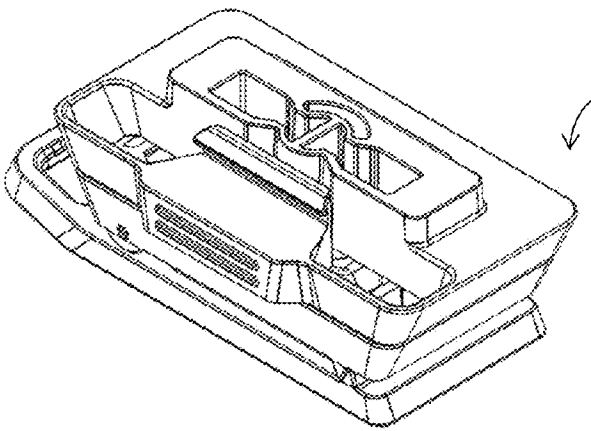
FIGS. 31-33 show another embodiment of a mount in various positions and orientations.
Figure 32:
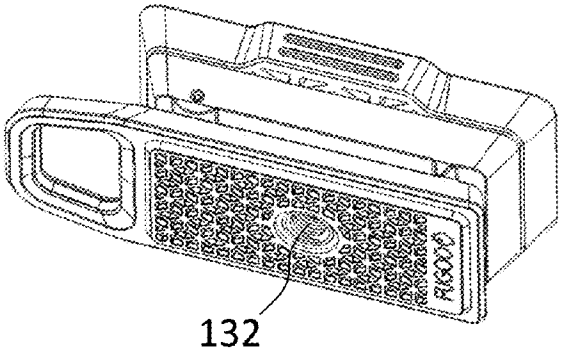
Figure 33:
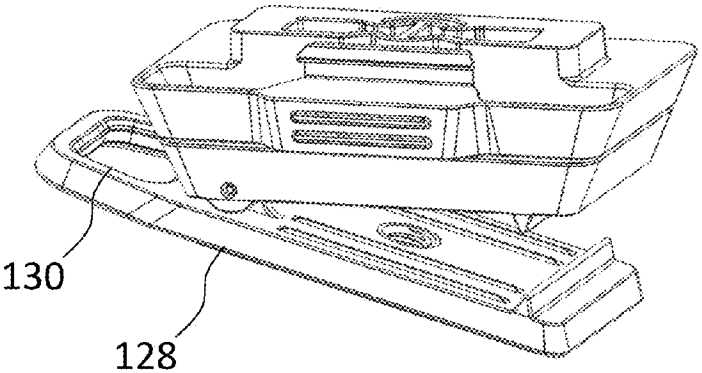
Figure 35:
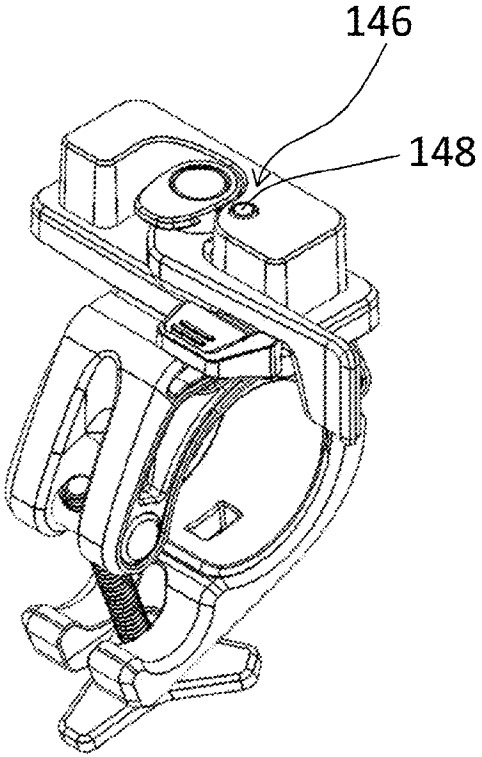
FIGS. 34-38 show a bicycle mount in various positions and orientations.

FIGS. 31-33 show another embodiment of a mount 110' in various positions and orientations. Numerical reference to components is the same as previously described, except that a double prime symbol (') has been added to the reference. Where such references occur, it is to be understood that the components are the same or substantially similar to previously-described components. It should be understood that the illustrated jacket includes each of the features designated by the numbers used herein. However, as emphasized repeatedly herein, these features need not be present in all embodiments.

The illustrated mount 110' is similar to the mount 110 and can provide many of the features described above. For example, the mount 110' is shown having a two-piece mounting body 112A-B that can allow for rotation. In addition, the mount 110' includes a spring loaded clip 128 on a bottom of the mounting body 112'. The clip 128 can be also used to attach the mount 110' to another object. A strap may also be passed through the clip for additional attachment options.

Additional features shown on the mount 110' include a loop 130 and a threaded hole 132. The loop 130 can be a full loop, a hook, a carabineer, etc. The threaded hole 132 can be used as part of a tripod mount.

Turning now to FIGS. 34-38, still another embodiment of mount 110" is shown. Numerical reference to components is the same as previously described, except that a double prime symbol (") has been added to the reference. Where such references occur, it is to be understood that the components are the same or substantially similar to previously-described components. It should be understood that the illustrated jacket includes each of the features designated by the numbers used herein. However, as emphasized repeatedly herein, these features need not be present in all embodiments.

The mount 110" can be used to attach the system to a pole or bar, such as on a bicycle. Thus, the mount 110" can be a bicycle mount, but may be used for other purposes. The mount 110" is shown with an adjustable screw tightening bar clamp 134. The bar clamp 134 is shown with two pieces that are pinned with respect to one another and a screw that controls the relationship between them. An elastic material can be positioned within the bar clamp 134 to provide grip and protect from scratching, among other benefits.

The mount 110" is also shown with a lever lock 136 instead of the button lock system described previously. It will be understood that a button lock system could be used on the mount 110" and a lever lock 136 could be used on systems similar to those described above.

Figure 34:
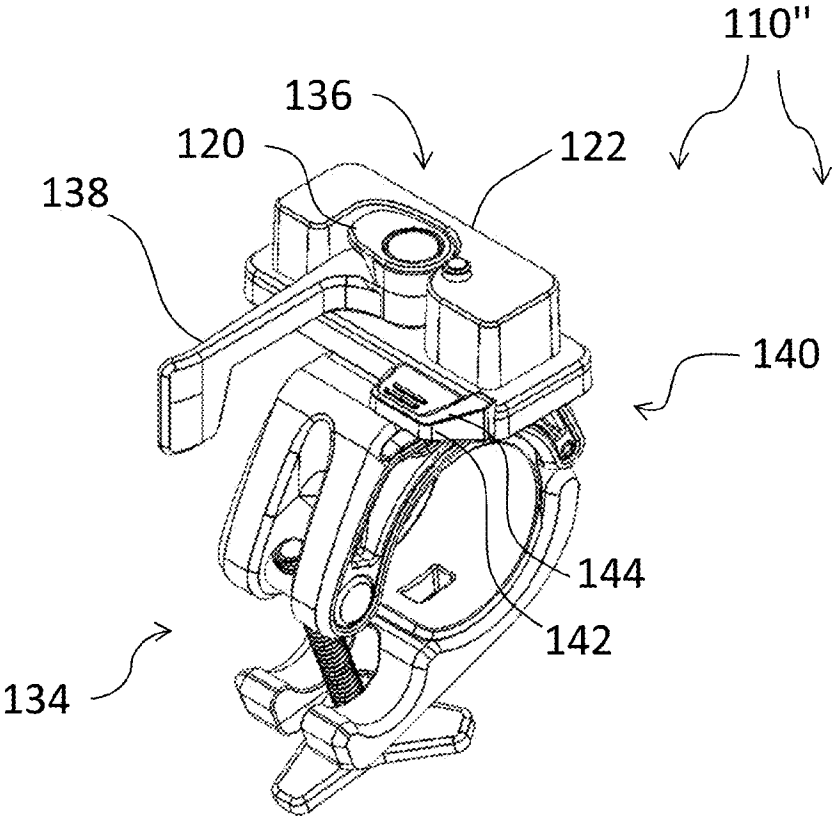

In the lever lock 136, a lever arm 138 controls the relationship between the mount flanges used to engage the accessary mounting plate 40. Rotating the lever 138 can engage or disengage the flanges 54 on the accessary mounting plate 40. FIG. 34 shows the lever 138 in a position for removal or pre-attachment, while FIG. 35 indicates the position for the lever 138 during attachment. In some embodiments, the lever arm 138 can remain in an engaged position based on friction between the various flanges 54, 120, 122.

In some embodiments, such as that shown, a separate lock 140 can be used to secure the lever in place and prevent premature disengagement. The illustrated lock 140 includes a button on a secondary lever that can lock the lever arm in position. Pressing down on the button 142 can release the lever 138 and allow it to more from the position shown in FIG. 35 to the position of FIG. 34. The lock 140 can comprise a secondary lever 140 that is spring loaded and thereby biased to the locked position. The secondary lever can be hinged at an end opposite the button 142. Pressing down on the lever or button 142 can allow the lever arm to be rotated to disengage the mount 110" from the accessary mounting plate 40.

The secondary lever can also have a ramp 144 that eases closing the lever. The ramp 144 can allow the lever 138 to push the button down as the lever is advanced from the open to the closed positions. Once in the closed position, the lever 138 will have passed the ramp such that the button can pop back up, locking the lever 138 in place.

The lever arm can also be spring biased to the open position. This can make connection easier for a user as the lever arm is maintained in the correct open position prior to connection to the accessary mounting plate 40.

Figures 36, 37:
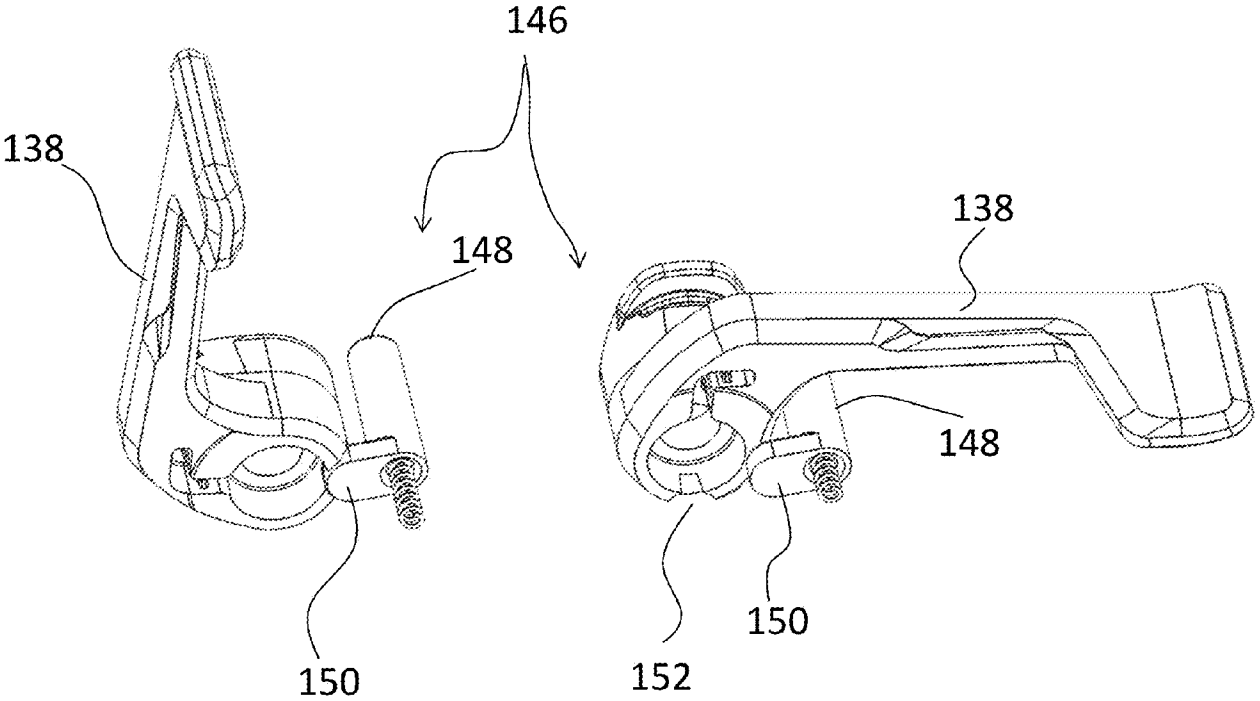
Figure 38:
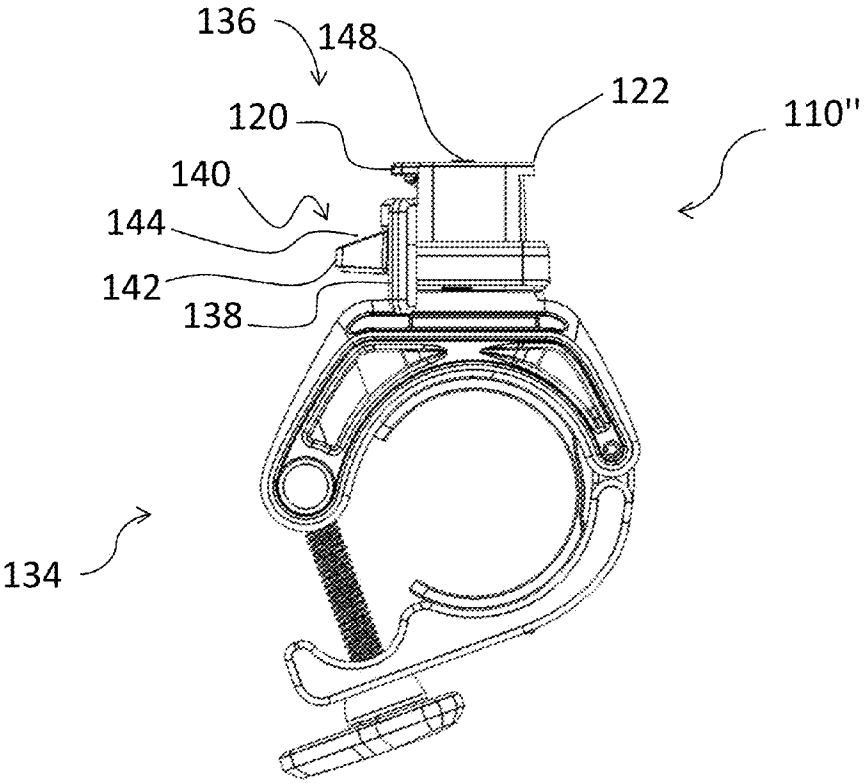

The mount 110" can also include a safety feature 146 to ensure proper connection to the accessary mounting plate 40. The safety feature 146 as shown, includes a spring biased pin 148 and a locking protrusion 150 that can engage the lever arm 138. The top of the pin 148, in a raised and then lowered position, can be seen respectively, in FIGS. 34 and 35. FIG. 36 illustrates how the protrusion 150 can engage the lever arm 138 and FIG. 37 shows the released position. The lever arm 138 can include a space, gap, notch, or other feature 152 configured to engage with the protrusion 150. In some embodiments the lever arm 138 can have a protrusion 150 and the pin 148 can include a space, gap, notch, or other feature 152 to engage the protrusion.

The pin 148 is configured to engage the base 48 of the accessary mounting plate 40. Only when the pin is fully engaged and pressed downward, will the pin release the lever arm for rotation. This safety feature 146 can help ensure that when the lever arm 138 is in the connected position, the mount 110" truly is connected to the accessary mounting plate 40. This can help prevent the user from believing that the mount 110" is connected when it is not, potentially dropping one of the mount 100" or the accessary mounting plate 40 including any device attached to the accessary mounting plate 40, such as a speaker system.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A speaker system comprising:

a speaker core comprising:

a housing having six sides: a top, bottom, front, back, left, and right;

two speakers positioned within the housing, each speaker positioned on a different side of the housing;

a button; and one of a notch and a protrusion on an outside surface; and a removable jacket to cover at least one of the two speakers on an outside surface of the housing, the jacket configured to extend along at least three of the six sides of the housing, the jacket comprising:

a button user interface to be positioned over the button when the jacket is positioned on the speaker core; and the other of the notch and the protrusion on an inside surface of the jacket configured to engage the respective notch or protrusion on the speaker core to help ensure proper alignment of the jacket on the speaker core;

wherein the system is configured for one-way sliding attachment of the jacket onto the housing, the notch and protrusion positioned and configured such that:

sliding the jacket onto the housing from a first side of the six sides of the housing allows the protrusion to engage the notch and the button user interface to be the positioned over the button; and sliding the jacket onto the housing from a second side opposite the first side, the protrusion prevents the jacket from fully sliding onto the speaker core such that the notch and protrusion do not engage and the button user interface is not positioned over the button, wherein the speaker core is a wireless speaker configured to receive audio inputs from another device.

2. The speaker system of claim 1, further comprising a locking mechanism comprising a second protrusion and a second notch, the second protrusion configured to fit within the second notch, wherein one of either the second notch or the second protrusion is on the housing and the other is on the jacket.

3. The speaker system of claim 2, wherein the locking mechanism comprises a deflection latch configured such that locking or unlocking the locking mechanism requires articulation of the deflection latch.

4. The speaker system of claim 1, further comprising two additional speakers positioned within the housing, each of the four speakers positioned on a different side of the housing.

5. The speaker system of claim 1, wherein the jacket further comprises a drainage hole and a drainage channel configured to direct fluid between the jacket and speaker core towards the drainage hole.

6. The speaker system of claim 1, further comprising at least two strap attachment points.

7. The speaker system of claim 6, wherein the at least two strap attachment points comprise two loops on the jacket, each loop having a first position within the jacket for when the loop is not in use, and a second position extending outside of the jacket to allow a strap to attach to the loop.

8. The speaker system of claim 6, wherein the at least two strap attachment points comprise two slots on the bottom of the jacket to also serve as drainage holes.

9. The speaker system of claim 6, wherein the at least two strap attachment points comprise two holes that pass through the jacket.

10. The speaker system of claim 1, wherein the jacket further comprises speaker mesh surrounding an internal frame.

11. The speaker system of claim 1, wherein the jacket further comprises a protective grill.

12. The speaker system of claim 1, wherein the speaker core further comprises at least one rubberized end cap covering at least one of the two speakers not covered by the jacket.

13. The speaker system of claim 12, wherein the at least one rubberized end cap is on the first side such that the jacket is configured to slide over the at least one rubberized end cap onto the housing.

14. The speaker system of claim 1, wherein the first side is the front side of the speaker core housing, the speaker core comprising the notch positioned on the front side and the jacket comprising the protrusion.

15. The speaker system of 14, wherein the jacket comprises a two piece assembly, wherein the first piece is configured for sliding onto the front side of the speaker core and the second piece is configured for sliding onto the back side of the speaker core.

16. The speaker system of claim 1, wherein the speaker core is waterproof.

17. The speaker system of claim 1, further comprising a second jacket configured for one-way sliding attachment onto the housing from a second side.

18. The speaker system of claim 1, wherein the notch and protrusion are both triangular shaped.

19. The speaker system of claim 1, further comprising at least one screw to secure the jacket to the speaker core.

20. The speaker system of claim 1, further comprising an accessory mounting plate having a base and a receiving area, the receiving area configured to receive an accessory.

21. The speaker system of claim 20, wherein the receiving area comprises a wall extending outward from the jacket and having a lip extending from the wall.

22. The speaker system of claim 20, further comprising a mounting accessory configured to attach to the accessory mounting plate, the mounting accessory configured to allow the speaker system to connect to another device.

23. The speaker system of claim 1, wherein a cross-section of the speaker core is trapezoidal and a cross-section of the jacket is trapezoidal.

24. The speaker system of claim 1, wherein the jacket extends along at least four sides of the housing.

25. The speaker system of claim 1, wherein the jacket covers the top, front and back side of the housing.

26. The speaker system of claim 25, wherein the jacket further covers a bottom side of the housing.

27. The speaker system of claim 1, wherein the one of the notch and the protrusion is provided on a side of the six sides of the housing that is parallel to a sliding direction of the jacket.

28. The speaker system of claim 1, wherein the jacket further comprises a bar extending between two sides of the jacket, the bar configured to allow attachment of the speaker system to another device.

29. A speaker system comprising:

a speaker core comprising:

a housing; and two speakers positioned within the housing;

a removable jacket extending along at least three sides of the housing and covering the two speakers; and a notch and a protrusion, wherein one of either the notch or the protrusion is on the housing and the other is on the jacket;

wherein the system is configured for one-way sliding attachment of the jacket onto the housing with the notch and protrusion positioned to 1) align the housing and jacket when the protrusion is engaged with the notch when the jacket is slid onto the jacket in a first direction and to 2) prevent the housing and jacket from complete attachment when the jacket is attempted to slide onto the speaker core from a direction other than first direction, wherein the speaker core comprises two additional speakers positioned within the housing, each of the four speakers positioned on a different side of the housing.

30. The speaker system of claim 29, further comprising a locking system comprising a second protrusion and a second notch, the second protrusion configured to fit within the second notch, wherein one of either the second notch or the second protrusion is on the housing and the other is on the jacket.

31. The speaker system of claim 29, wherein the speaker core is waterproof.

32. The speaker system of claim 29, wherein the locking system comprises a deflection latch system.

33. The speaker system of claim 29, wherein the speaker core is configured to wirelessly receive audio inputs from another device.

34. The speaker system of claim 29, wherein the one of either the notch or the protrusion is on a side of the housing that is parallel to a sliding direction of the jacket.

35. A speaker system comprising:

a speaker core comprising:

a housing having six sides: a top, bottom, front, back, left and right side; and a speaker positioned within the housing;

a removable jacket covering the speaker on an outside surface of the housing, the jacket extending along at least three sides of the housing; and a notch and a protrusion, wherein one of either the notch or the protrusion is on the housing and the other is on the jacket;

wherein the system is configured for one-way sliding attachment of the jacket onto the housing with the notch and protrusion positioned to 1) properly align the housing and jacket when the protrusion is engaged with the notch and to 2) prevent the housing and jacket from complete attachment when the protrusion and notch are incorrectly orientated such that the jacket and housing are not properly aligned, wherein the speaker core is a wireless speaker capable of streaming music from a computer device.

36. The speaker system of claim 35, further comprising a locking mechanism comprising a second protrusion and a second notch, the second protrusion configured to fit within the second notch, wherein one of either the second notch or the second protrusion is on the housing and the other is on the jacket.

37. The speaker system of claim 36, wherein the locking mechanism comprises a deflection latch system.

38. The speaker system of claim 35, wherein the jacket comprises at least one of a fabric and a protective grill.

39. The speaker system of claim 35, wherein the jacket comprises a fabric over a protective grill.

40. The speaker system of claim 35, wherein a cross-section of the speaker core is trapezoidal and a cross-section of the jacket is trapezoidal.

41. The speaker system of claim 35, wherein the jacket extends along at least four sides of the housing.

42. The speaker system of claim 35, wherein the jacket covers a top, front and back side of the housing.

43. The speaker system of claim 42, wherein the jacket further covers a bottom side of the housing.

44. The speaker system of claim 35, wherein the jacket further comprises a drainage hole and a drainage channel configured to direct fluid between the jacket and speaker core towards the drainage hole.

45. The speaker system of claim 35, wherein the speaker core is waterproof.

46. The speaker system of claim 35, wherein the jacket further comprises a bar extending between two sides of the jacket, the bar configured to allow attachment of the speaker system to another device.

47. The speaker system of claim 35, wherein the speaker core is configured to wirelessly receive audio inputs from another device.

48. The speaker system of claim 35, wherein the one of either the notch or the protrusion is on a side of the housing that is parallel to a sliding direction of the jacket.

49. The speaker system of claim 35, wherein the speaker core comprises three additional speakers positioned within the housing, each of the four speakers positioned on a different side of the housing.

* * * * *